US011794066B2

(12) United States Patent
Ellis

(10) Patent No.: US 11,794,066 B2
(45) Date of Patent: Oct. 24, 2023

(54) UPPER AND LOWER BODY RECIPROCATING ARCING MOTION EXERCISE MACHINE WITH AN ADJUSTABLE ANGLE USER SUPPORT

(71) Applicant: Joseph K. Ellis, Ocala, FL (US)

(72) Inventor: Joseph K. Ellis, Ocala, FL (US)

( * ) Notice: Subject to any disclaimer, the term of this patent is extended or adjusted under 35 U.S.C. 154(b) by 13 days.

(21) Appl. No.: 17/507,634

(22) Filed: Oct. 21, 2021

(65) Prior Publication Data

US 2022/0111246 A1 Apr. 14, 2022

Related U.S. Application Data

(63) Continuation-in-part of application No. 16/876,239, filed on May 18, 2020, now Pat. No. 11,524,206, which is a continuation-in-part of application No. 15/848,656, filed on Dec. 20, 2017, now Pat. No. 10,653,914, which is a continuation-in-part of application No. 14/840,776, filed on Aug. 31, 2015, now Pat. No. 9,873,016.

(51) Int. Cl.
*A63B 22/00* (2006.01)
*A63B 21/00* (2006.01)

(52) U.S. Cl.
CPC ..... *A63B 22/001* (2013.01); *A63B 21/00069* (2013.01); *A63B 21/00192* (2013.01); *A63B 21/4034* (2015.10); *A63B 21/4035* (2015.10); *A63B 22/0025* (2015.10); *A63B 2225/093* (2013.01)

(58) Field of Classification Search
CPC ..... A63B 22/00–0046; A63B 22/0664–0694; A63B 22/20–208
See application file for complete search history.

(56) References Cited

U.S. PATENT DOCUMENTS 4,848,737 A 7/1989 Ehenfield
5,224,909 A * 7/1993 Hamilton ..... A63B 23/03575 601/33
5,370,594 A 12/1994 Grinblat
(Continued)

FOREIGN PATENT DOCUMENTS

EP 3124085 A1 * 2/2017 ..... A63B 21/00181
GB 2602334 A * 6/2022 ..... A63B 21/068

*Primary Examiner* — Nyca T Nguyen
(74) *Attorney, Agent, or Firm* — Laurence P. Colton; SMITH TEMPEL BLAHA LLC

(57) ABSTRACT

An upper and lower body reciprocating arcing motion exercise machine with an adjustable angle movable user support frame wherein, movable left and right lower body user support assemblies comprising foot platforms and shin support pads mounted on an arcing track, move along a rearward portion of the movable user support frame and movable left and right upper body user support assemblies comprising gripping handles mounted on pivoting levers, pivot about a forward portion of the movable user support frame. A linkage assembly operatively connects and synchronizes the movable upper and lower body user support assemblies. In certain embodiments, an adjustable resistance mechanism is operatively engaged with the movable upper and lower body user support assemblies for providing adjustable resistance to the exercise motion of the movable upper and lower body user support assemblies during an exercise motion.

16 Claims, 68 Drawing Sheets

(56) References Cited

U.S. PATENT DOCUMENTS 5,518,483 A * 5/1996 Oswald ..... A63B 21/012 482/130
5,554,086 A 9/1996 Habing
5,569,132 A 10/1996 Wu
5,580,340 A 12/1996 Yu
6,264,588 B1 7/2001 Ellis
6,287,241 B1 9/2001 Ellis
6,361,476 B1 3/2002 Eschenbach
7,104,933 B1 9/2006 Liao
7,220,221 B2 5/2007 Moismann
7,232,404 B2 6/2007 Nelson
7,244,217 B2 7/2007 Rodgers, Jr.
7,335,140 B2 2/2008 Webber
7,455,633 B2 * 11/2008 Brown ..... A63B 21/068 482/142
7,585,263 B2 9/2009 Brown
7,594,880 B2 9/2009 Webber
7,611,445 B2 * 11/2009 Brown ..... A63B 21/068 482/140
7,611,446 B2 11/2009 Chuang
7,662,076 B1 2/2010 Ho
7,727,128 B2 6/2010 Gianneli
7,731,638 B2 6/2010 Webber
7,780,585 B1 * 8/2010 Rivas ..... A63B 22/203 482/140
7,833,143 B1 11/2010 Tsai
7,867,149 B1 1/2011 Webber
7,963,890 B2 6/2011 Webber
8,025,609 B2 9/2011 Giannelli
8,043,199 B1 * 10/2011 Barker ..... A63B 22/0069 482/142
8,162,807 B1 4/2012 Webber
8,172,732 B1 5/2012 Webber
8,317,665 B2 11/2012 Webber
8,888,661 B2 11/2014 Ellis
9,028,375 B2 * 5/2015 Ho ..... A63B 23/0216 482/142
9,265,986 B1 * 2/2016 Godak ..... A63B 23/03541
9,649,529 B1 * 5/2017 Miller ..... A63B 22/0664
9,770,623 B2 * 9/2017 Ellis ..... A63B 21/00069
2002/0013199 A1 1/2002 Gianneli
2002/0019298 A1 2/2002 Eschenbach
2005/0148438 A1 * 7/2005 Carlsen ..... A63B 22/0015 482/52
2005/0159274 A1 * 7/2005 Chen ..... A63B 21/0051 482/63
2008/0070765 A1 * 3/2008 Brown ..... A63B 23/03525 482/140
2009/0018000 A1 * 1/2009 Brown ..... A63B 21/068 482/140
2009/0247370 A1 10/2009 Stearns
2010/0048367 A1 2/2010 Kiang
2010/0248919 A1 * 9/2010 Zhou ..... A63B 22/203 482/139
2010/0311555 A1 12/2010 Campanaro
2011/0028283 A1 2/2011 Webber
2013/0095981 A1 * 4/2013 Chung-Ting ..... A63B 22/205 482/66
2013/0331238 A1 * 12/2013 Ellis ..... A63B 21/4047 482/142
2014/0371036 A1 * 12/2014 Ellis ..... A63B 22/001 482/66
2015/0151158 A1 * 6/2015 Ellis ..... A63B 21/159 482/142
2015/0182787 A1 7/2015 Liu
2015/0283425 A1 * 10/2015 Zhou ..... A63B 22/0005 482/56
2015/0343250 A1 12/2015 Lagree
2016/0213970 A1 * 7/2016 Eschenbach ..... A63B 22/001
2017/0157460 A1 * 6/2017 Lin ..... A63B 69/0057
2017/0296865 A1 10/2017 Lagree

* cited by examiner

UPPER AND LOWER BODY RECIPROCATING ARCING MOTION EXERCISE MACHINE WITH AN ADJUSTABLE ANGLE USER SUPPORT

This patent application claims priority on and the benefit of U.S. patent application Ser. No. 16/876,239 having a filing date of 18 May 2020, which claims priority on and the benefit of U.S. patent application Ser. No. 15/848,656 having a filing date of 20 Dec. 2017, now U.S. patent Ser. No. 10/653,914 B2 having an issue date of 19 May 2020, which claims priority on and the benefit of U.S. patent application Ser. No. 14/840,776 having a filing date of 31 Aug. 2015, now U.S. Pat. No. 9,873,016 B2 2018-having an issue date of 23 Jan. 2018.

BACKGROUND OF THE INVENTION

Technical Field

This invention relates to the general technical field of physical fitness and exercise equipment and machines. This invention relates more specifically to the field of exercise equipment for concurrently exercising the user's upper and lower body at multiple angles or reciprocating arcing motions.

Prior Art

Exercise, physical fitness and physical therapy equipment and machines are available in various configurations and for various purposes, and are available for all of the major muscle groups. In the general exercise equipment field, there are generally two categories of machines. One category of machines known as strength or anaerobic training machines are geared more towards lower repetition, shorter duration, and higher resistance exercises and there are many configurations of strength training machines that exercise a specific muscle group or set of muscle groups. A second category commonly known as cardiovascular or aerobic training machines are generally geared towards longer duration, lower resistance, and higher repetition exercise. A third category of products that is increasing in popularity are machines that allow a user to stretch their skeletal musculature and to do so from various angles. Stretching prior to exercising is proven to help prevent injuries.

There are many configurations of cardiovascular training machines that exercise a specific muscle group or set of muscle groups such as treadmills, stationary bicycles, stair climbing machines, ladder climbing machines, elliptical striding machines, arcing strider machines, and other specialized machines. Most of these products produce a single exercise motion such as climbing, running, or bike riding that only engage a certain group of muscles. A treadmill for example can change the elevation of the running surface to create some exercise variety but it is engaging the user's lower body only and the user is weight bearing through their legs only regardless of the elevation of the running surface. Most of the other afore-mentioned products operate with a fixed frame to create exercise motions in a single plane. Many of the afore-mentioned products also incorporate a circular crank into the mechanical function of the machine causing all users regardless of their size, flexibility, or physical capabilities to follow a fixed pattern of motion that prevents the user from controlling the range of motion of the exercise function of the machine. All of the afore-mentioned products also cause the user to weight bear through either a sitting or standing position that also reduces the exercise variety and muscle groups engaged. Each of these deficiencies limits the effectiveness of the exercise function of these products.

Many machines have been developed that engage a user's upper and lower body into an exercise motion but each of these previous machines have deficiencies as previously described herein. U.S. Pat. No. 6,361,476 of Eschenbach discloses an "Elliptical Exercise Striding Machine" with individual left and right foot pedals, each movably mounted to and dependently connected by an adjustable rotational crank arm assembly proximal to a first end and supported by either a rolling wheel or pivoting handle linkage proximal to a second end. During operation of the machine, the foot pedals move dependently in a rotating ellipse with a closed loop range of motion and can be adjusted in stride length and the shape or motion pattern of the elliptical motion can be adjusted. The left-side foot pedals and handles and right-side foot pedals and handles are dependently connected in opposing positions of the range of motion and move in unison. This closed loop range of motion of the elliptical pattern requires the user to follow the machines complete range of motion requiring the range of motion to be adjustable to fit various size users with various capabilities adding additional components and wear components to the cost of the machine. This closed loop motion also creates momentum that decreases the force required by the user to keep the machine moving thus reducing the user's exertion level and effectiveness of the exercise motion. Furthermore, during operation of this machine the user is weight bearing in a standing position only, which limits the variation of muscle group engagement.

U.S. Pat. No. 8,025,609 of Giannelli et al. discloses a "Striding Exercise Machine" comprising a pair of pivotally supported individual foot pedals that are dependently linked together through a rotational crank assembly and move in unison in a back-and-forth fixed range of motion arcuate path with the arcuate path being adjustable to a selected segment. The apparatus includes handles or arms interconnected or interlinked to the foot pedals for upper body pushing or pulling energy input. The handles or arms pivot together with and in the same back and forth direction as the pedals to which they are inter-linked and the left-side pedals and arms are in an opposing position of the range of motion as the right said pedals and arms. The motions of the pedals and handles or arms are controlled by a circular rotating crank linkage assembly. This closed loop range of motion of the elliptical pattern requires the user to follow the machine linkage's complete circular range of motion requiring the range of motion to be adjustable to fit users of various sizes and capabilities. Adding this adjustment feature to the machine is costlier to produce and creates additional wear components. Furthermore, during operation of this machine the user is weight bearing in a standing position only which limits the variation of muscle group engagement US Patent Publication No. 2009/0247370 of Stearns et al. discloses an "Elliptical Striding Machine" comprising opposing left and right crank assemblies mounted to the base frame about a common axis. Left- and right-side foot support linkages are supported proximal to a first end by a movable rocker shaft that is mounted on opposing ends to the left- and right-side crank assemblies. Said left and right foot support linkages are operatively linked to and supported by left- and right-side handle bars that are pivotally mounted to an upper portion of the stationary frame. The rotating rocker support shaft and linkage assembly are configured such that the left foot support and left handle bar assembly are 180 degrees out of phase with the right foot support and right handle bar assembly such that the left- and right-side user engagement features are opposing in the range of motion of the machine and remain as such during operation of the machine. Left- and right-side draw bars are pivotally mounted at a first end to an upper portion of the stationary main frame and movably mounted at a second end to the left- and right-side crank assemblies such that the draw bars can be adjusted to alter the range of motion and shape of the elliptical motion of the foot pedal assemblies during operation of the machine. The motions of the left- and right-side foot support and handle bar assemblies are controlled by the closed loop circular rotating motion of the left- and right-side cranks and rocker shaft assembly such that the left- and right-side foot support assemblies are geometrically opposed along the shape of the elliptical motion path and remain that way during operation of the machine. This closed loop range of motion of the elliptical pattern requires the user to follow the machines complete range of motion requiring the range of motion to be adjustable to fit various size users with various capabilities and these additional components of the adjustment feature increase the cost of the machine and create additional wear components. Furthermore, during operation of this machine the user is weight bearing in a standing position only which limits the variation of muscle group engagement.

US Patent Publication No. 2015/0283425 of Zhou discloses an "Elliptical Prone Exerciser" machine that places a user in a prone crawling position. While this machine allows a user to weight bear with all four limbs, it utilizes a circular crank drive system connected to the upper body user supports and a separate circular crank drive system connected to the lower body user supports such that a user is required to follow a full close looped path of motion with their upper and lower body for each repetition. This prevents the user from controlling the range of motion of each exercise repetition which limits the exercise variety and does not fit all size users without making multiple adjustments to the machine prior to operating the machine. Moreover, Zhou teaches a machine that requires output ends of both the upper body drive system and the lower body drive system to be connected with a central dampening wheel and the dampening wheel creates the resistance to the exercise motion. Therefore, the Zhou machine will not operate without a dampening resistance system. This limits the capabilities of the Zhou machine as being operated as a stretching apparatus. Also, the closed loop pattern of motion greatly reduces the Zhou machine's capabilities from being operated as a stretching apparatus.

U.S. Pat. No. 9,155,933 of Ching-Yu discloses a "High Knees Exercise" machine that places the user in a seated weight bearing position for an exercise engagement of a user's legs only. A stationary seat is disposed on a station base frame. Left and right drive members are pivotally connected to the frame below the seat and positioned on either side of the seat to swing forward of the seat. Pedals are connected to the swinging ends of the left and right drive members. A linkage assembly connects the left and right drive members for leading the drive members in opposing motion relative to each another. While this machine allows the user to control the range of motion of the exercise motion provided by the machine, the user is weight bearing in a seated position only very similar to a stationary bicycle which limits the muscle groups engaged to certain parts of the legs and hips. Moreover, this machine operates with a fixed position frame such that the user can only exercise in one plane of motion.

An exercise machine that would greatly improve the efficiency and effectiveness of a workout regimen would concurrently engage the user's upper and lower body providing a natural and bio-mechanically correct reciprocating arcing motion wherein one arm pushes while the other arm pulls and one leg pushes while the other leg pulls to engage the maximum amount of skeletal musculature including the user's core into a single exercise motion. Such an improved machine would also allow the user's exercise motion to control the range of motion of the mechanical motion created by the exercise machine such that various size users could operate the machine comfortably without requiring any adjustments to the machine. Also, the exercise variety could be increased by using multiple ranges of motion based on the user's goal for a particular exercise regimen. Such an improved exercise machine could also be operated at various angles between horizontal and vertical to allow the user to exercise at a plurality of planes of motion and cause the user to weight bear at multiple angles with different portions of the user's body to create a greater variety of exercises and engage many more muscle groups to create a comprehensive total body workout. Moreover, if the mechanical features of such an improved exercise machine would allow the machine to operate without requiring a resistance mechanism, the machine could be utilized as a skeletal muscular stretching apparatus without the additional cost of an added resistance mechanism. The present invention provides just such an improved exercise machine as is further described herein.

BRIEF SUMMARY OF THE INVENTION

The present invention creates multiple arcing motion pushing and pulling exercises for the user's upper body and lower body that maximize a user's skeletal muscular engagement by adjusting the angle of the machine's user support frame to a plurality of angle positions from mostly vertical to mostly horizontal. The user support frame is elongated having a forward end and rearward end and the rearward end is pivotable relative to the floor and the forward end is operatively connected to an angle adjusting mechanism that supports the forward portion of the user support frame at multiple angles.

Mounted on the left side of the user support frame is a movable left side lower body support comprising a foot platform and shin support pad and a movable left side upper body support comprising a gripping handle and the left side lower body user support and the left side upper body user support are operatively connected such that the user's left leg and left arm can push in unison or pull in unison. Mounted on the right side of the user support frame is a movable right side lower body support comprising a foot platform and shin support pad and a movable right side upper body support comprising a gripping handle and the right side lower body user support and the right side upper body user support are operatively connected such that the user's right leg and right arm can push in unison or pull in unison. The left side upper and lower body user supports are operatively connected to concurrently perform a pushing motion or concurrently perform a pulling motion. The right side upper and lower body user supports are operatively connected to concurrently perform a pushing motion or concurrently perform a pulling motion. The left side user supports are operatively connected to the right side user supports and when the left side user supports perform a pulling or pushing motion, the right side user supports concurrently perform the opposite motion. The lower body user supports are pivotably and rollably engaged with the user support frame and the upper body user supports are pivotally engaged with the user support frame such that a user's hands and feet move in concurrent fixed arcing paths of reciprocating pushing and pulling motions that are defined by the machine but the range of the exercise motion is controlled by the user.

The multiple angles of operation of the machine allow the user to exercise in multiple planes of motion to perform a variety of exercises including ladder climbing, stair climbing, hiking, running, crawling, and other exercises utilizing natural and bio-mechanically correct exercise motions. In certain embodiments, the machine can be configured without a resistance mechanism for performing stretching exercises, physical therapy, and light cardiovascular training. In other embodiments, the machine can be configured with a variety of adjustable resistance mechanisms or assemblies that cooperate with the lower body user supports and the upper body user supports such that the user can select a resistance level that creates the desired exercise exertion level.

BRIEF DESCRIPTION OF THE DRAWINGS

In some figures, the invention is illustrated from one side and in these figures the invention looks the same, but in a general mirror image, from the opposite side, with both sides having similar structures, features, and components. In some figures certain components have been removed or are illustrated as outlined and transparent such that the view of other components is not obstructed.

DETAILED DESCRIPTION OF PREFERRED EMBODIMENTS

Figure 1:
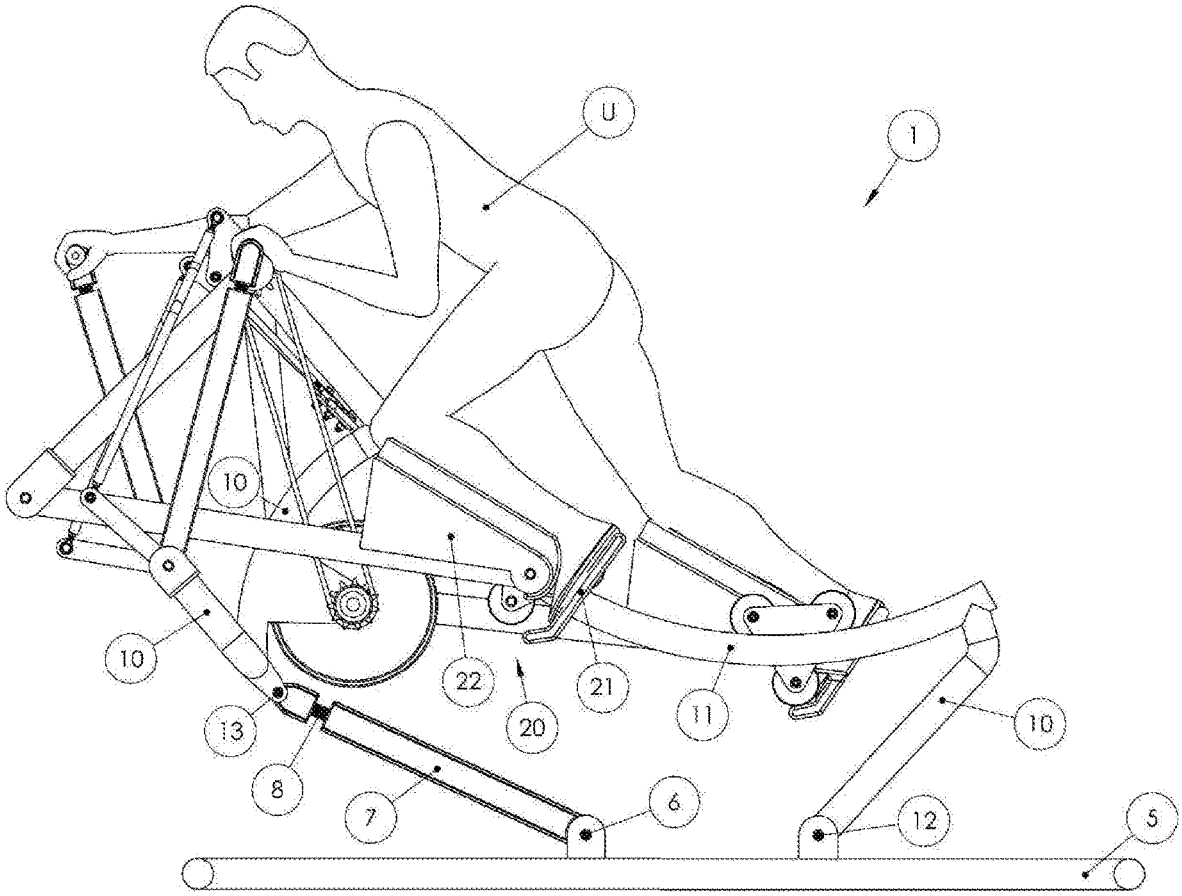
FIG. 1 is a side view of the invention at a lower angle position with a user performing a simulated crawling motion exercise.

Exemplary preferred embodiments are disclosed below in connection with the attached drawings. Throughout this specification, various terms will be used to describe various elements or sets of elements, features or sets of features, mechanisms and devices. For example, the term "movable frame" will refer to the frame that can change in angle and that supports the operational components of the machine. The term "rearward end or portion of the machine" will refer to the end or portion of the machine most near the user's feet and distal to the user's hands. The term "forward end or portion of the machine" will refer to the end or portion of the machine most near the user's hands and distal to the user's feet. The term "linkage" or "linkage assembly" will refer to the movable components that connect the user engage features and cooperate with the drive components and resistance components. The terms "push", "pushing", "press", "pressing", "pull", or "pulling" when referring to the user operating the machine will be used to describe any motion or movement by a user when they are maintaining or increasing their exertion force. The term "upper body" will refer generally to the user's arms and hands but may also refer to the user's chest, back, and torso as well. The term "lower body" will generally refer to the user's legs and feet but may also refer to the user's buttocks and hips as well. The term "lower legs" will refer to the user's shin, ankles, and feet and in some instances the user's knees. The terms "limbs" or "extremities" will refer to the user's arms and legs. The term "angle adjusting mechanism" will refer to any mechanism and its components that adjust the angle of the movable user support. The term "pivot" will refer to an axle or fastener in which a component or set of components rotate upon. The term "assembly" will refer to a group of components that cooperate together to create a function of the invention.

The invention is comprised of many identical left and right components as illustrated in various perspective views and many of these components will frequently be referred to and described in a plural context so as to prevent the duplication of descriptions of identical left and right components.

The exercise motion created by the invention is virtually identical to all embodiments of the invention. A first distinction between the embodiments is the mechanism and method for adjusting the angle of the movable user support. A second distinction between the embodiments is whether or not the movable user support is mounted on a stationary frame or the movable user support is in direct movable contact with the floor surface. A third distinction between the embodiments is whether a resistance mechanism or assembly is engaged with the exercise motion of the invention and if an embodiment of the machine comprises a resistance mechanism or assembly, what type of resistance mechanism or assembly is engaged with exercise motion of the invention. A fourth distinction between the embodiments is how the position of distance of the upper body gripping handles relative to the movable user support are adjusted.

To further comply with written description and enablement requirements, the following patents and patent application publications are also incorporated herein by this reference in their entirety. U.S. Pat. Nos. 9,155,933, 10,065,062, 10,994,169, and US Patent Publication 2015/0283425.

Figure 68:
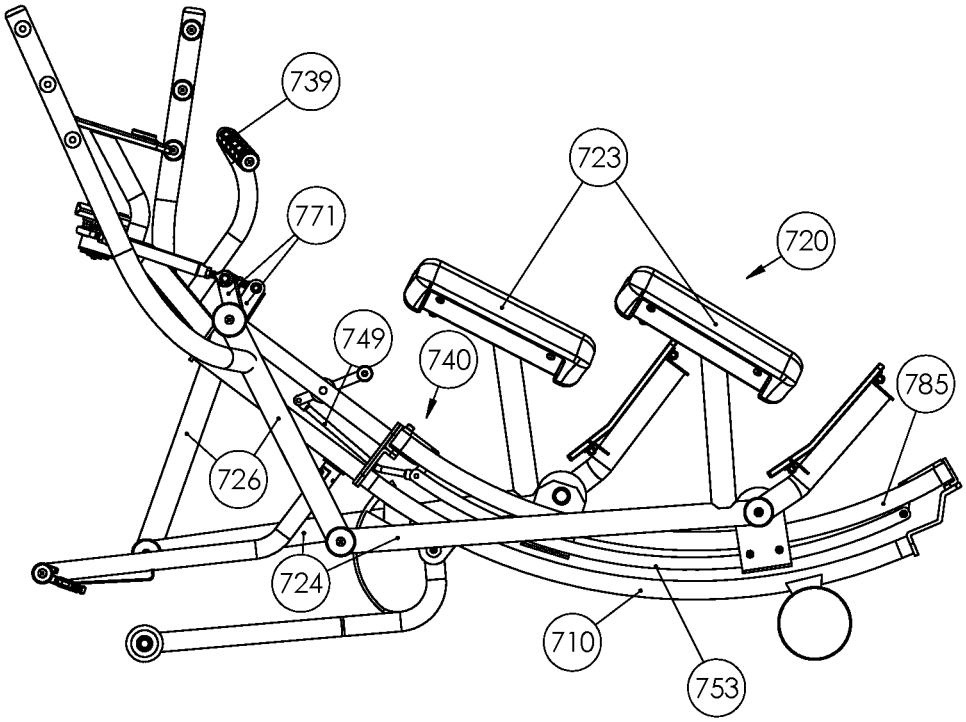
FIG. 68 is a left side view of the invention in a lower angle position with a manual angle adjustment assembly, without a stationary base frame, and with a reciprocating arcing friction resistance assembly.

FIGS. 1-68 are all views of embodiments of the invention this inventor refers to as "An upper and lower body reciprocating arcing motion exercise machine with an adjustable angle user support". Generally, the invention is a machine for concurrently pushing with the user's left side arm and left side leg while concurrently pulling with the user's right side arm and right side leg and vice versa in a reciprocating arcing motion wherein the user controls the range of the exercise motion. The user supports are operatively connected by a linkage assembly and operate in unison such that movement of any of the user support components will concurrently move all of the user support components. All of the exercise motion components of the machine are mounted on an adjustable angle user support frame that in certain embodiments is pivotally mounted on a stationary base frame and in other embodiments the adjustable angle user support directly engages the floor and does not require a separate base frame. In certain embodiments the machine does not require a resistance mechanism and is operated to performing stretching exercises, physical therapy, and light cardiovascular training. In other embodiments the machine requires a resistance mechanism for performing higher exertion exercises.

FIGS. 1-14 illustrate various views of these embodiments of the machine 1 and are shown to provide a more complete understanding of the invention. FIGS. 1-14 all illustrate a set of left and right curved lower body support rails 11 mounted on a rearward portion of movable frame 10. Traveling member assemblies 80 are rollably engaged with curved lower body support rails 11. Lower body user support assemblies 20 are pivotally connected to traveling member assemblies 80 with lower body user support pivots 29. Lower body user support assemblies 20 are connected to linkage connection hubs 70 with first lower body support linkage bars 24 and second lower body support linkage bars 26. Upper body user support assemblies 30 are pivotally connected to movable frame 10 at upper body user support pivots 34 and upper body user support assemblies 30 are connected to linkages connection hubs 70 with upper body user support linkage connection flanges 35, upper body user support linkage bars 37, and linkages connection hub flanges 71. Resistance axle 41 is connected to movable frame 10 with resistance axle connection flanges 42 and linkages. Connection hubs 70 are connected to resistance mechanism 40 with resistance drive assembly 50. Rocker arm linkage assembly 60 operatively connects left lower body user support assembly 20 and left upper body user support assembly 30 to right lower body user support 60 and right upper body user support 30 such that the left and right upper and lower body user supports move in unison during operation of machine 1.

FIGS. 1-9 illustrate an embodiment of the invention wherein movable frame 10 is pivotally mounted proximal to a rearward end of stationary base frame 5 with movable frame base pivot 12. Movable frame 10 is pivotally connected proximal to a forward end at angle adjusting device upper pivot 13 such that angle adjusting device 7 supports the forward portion of movable frame 10 and angle adjusting device 7 adjusts the angle of movable frame 10 by extending and contracting angle adjusting shaft 8 causing movable frame 10 to pivot about movable frame base pivot 12 such that the angle of movable frame 10 increases or decreases relative to stationary base frame 5 and the floor.

FIGS. 10-13 illustrate an embodiment of the invention wherein the rearward portion of movable frame 10 is in direct contact with the floor and pivots on movable frame foot 9. A central portion of movable frame 9 is connected to and pivots on angle adjusting support arm pivot 19 and a forward portion of movable frame 10 is connected to and pivots on angle adjusting device upper pivot 13. Angle adjusting device 7 is pivotally connected to angle adjusting support arm 16 at angle adjusting device lower pivot 6. Angle adjusting support arm cross brace 17 is connected in a perpendicular configuration at a central location to a forward end of angle adjusting support arm 16. An angle adjusting support arm wheel 18 is connected to each end of angle adjusting support arm cross brace 17. Angle adjusting support arm wheels 18 are in rollable contact with the floor. Angle adjusting support arm wheels 18 roll forward when the angle of movable frame 10 is decreasing relative to the floor as movable frame 10 pivots about movable frame foot 9. Angle adjusting support arm wheels 18 roll rearward when the angle of movable frame 10 is increasing relative to the floor as movable frame 10 pivots about movable frame foot 9.

Figure 13:
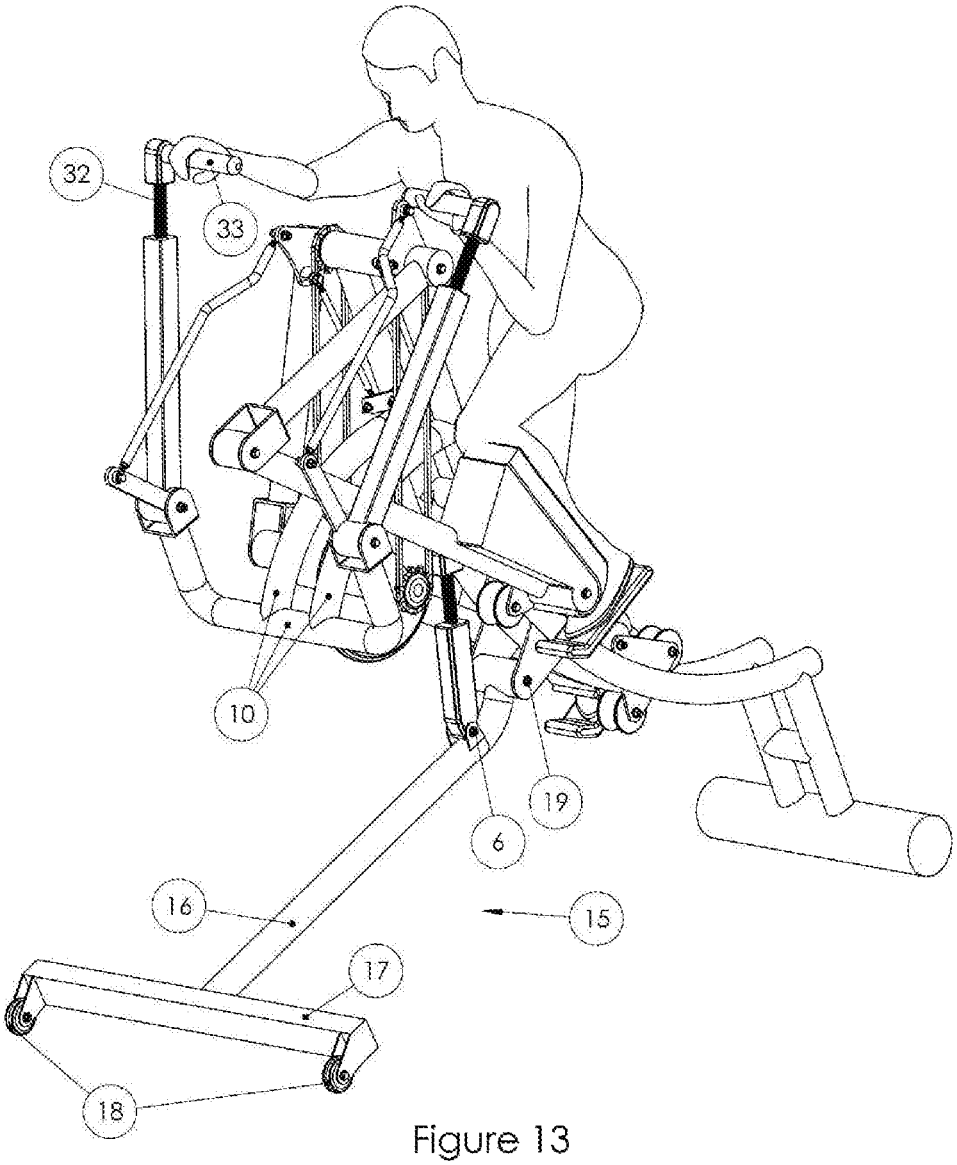
FIG. 13 is a front perspective view of the invention a mid-point angle position with a user performing a simulated hill climbing exercise.
Figure 14:
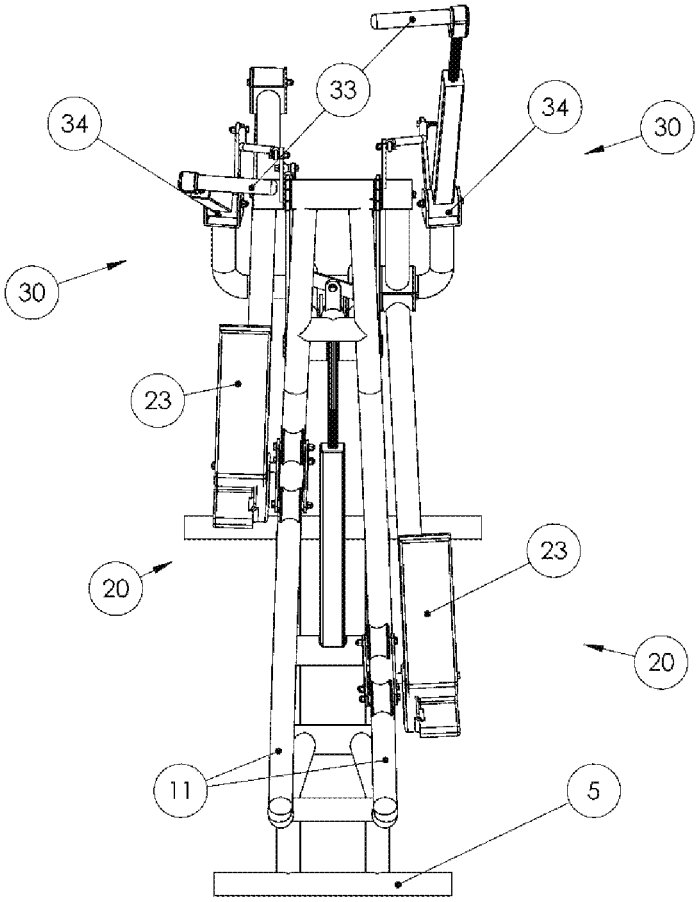
FIG. 14 is a rear view of the invention at a higher angle position with converging and diverging lower body supports and converging and diverging push and pull arms.
Figure 15:
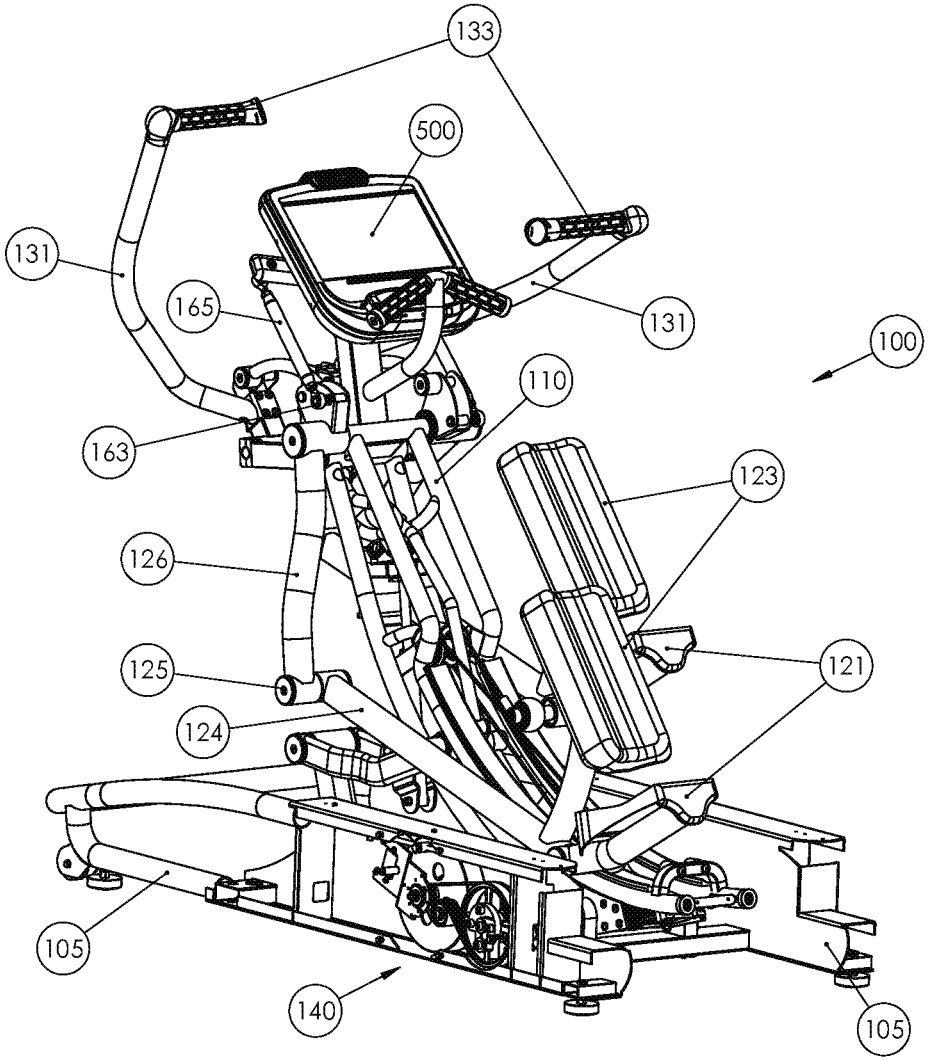
FIG. 15 is a left side perspective view of the invention at a higher angle position with an electrical angle adjustment mechanism.

FIG. 14 illustrates alternative configurations to the pushing and pulling motions of machine 1. FIGS. 1-13 illustrate the invention wherein the pushing and pulling arms move in a parallel motion to one another and the lower body supports move back and forth in a parallel motion to one another. In FIG. 14 the forward ends of lower body support rails 11 are mounted on movable frame 10 in a narrower more proximal distance to one another and the rearward ends of lower body support rails 11 are mounted on movable frame 10 in a wider more distal distance to one another such that the distance between lower body support rails 11 increases from front to back. Also, in FIG. 14 the pushing and pulling arms are pivotably mounted on movable frame 10 in an angled configuration such that each handle moves inward as it moves towards the front of the machine and each handle moves outward as it moves towards the rear portion of the machine.

Stationary base frame 5 can be constructed of any suitable material such as pipes or tubes and preferably is made of metal for strength and durability and is represented in the drawings herein as a metal tubing weldment or assembly with two parallel elongated tubes that are positioned below movable frame 10 and extend the substantial length of movable frame 10. A single tube is positioned on each end perpendicular to the two parallel tubes so as to join the two parallel tubes into a solid and sturdy base mostly rectangular shaped frame for supporting movable frame 10 and user U during operation of machine 1. However, stationary base frame 5 can be constructed in various configurations capable of supporting movable frame 10 and user U during operation of machine 1.

Angle adjusting support arm assembly 15 can be constructed of any suitable materials that can adequately support movable frame 10 and user U during operation of machine 1 and are presented in the drawings herein such that angle adjusting support arm 16 is constructed of an elongated tube that is fastened at a rearward end to a central portion of movable frame 10 and pivots about angle adjusting support arm pivot 19. A forward end of angle adjusting support arm 16 is connected to a central portion of angle adjusting support arm cross brace 17 in a perpendicular configuration to provide stability to angle adjusting arm 16. Angle adjusting support arm wheels 18 are connected to each end of angle adjusting support arm cross brace to allow angle adjusting support arm assembly 15 to roll forwards or backwards on the floor as angle adjusting arm support assembly 15 raises and lowers movable frame 10 during operation of machine 1.

Referring to embodiments illustrated in FIGS. 1-14, various assemblies and components are common to these two embodiments of the invention and are described in detail herein. Angle adjusting device 7 can be constructed of various components but is represented as an elongated outer cylinder having a first end and a second end and an inner angle adjusting shaft 8 having a first end and a second end that is represented as a threaded rod that rotates on the second end of angle adjusting device 7 outer cylinder as angle adjusting device 7 extends or contracts. Angle adjusting shaft 8 has a coupling on the second end that connects to movable frame 10 at angle adjusting device upper pivot 13. In the first embodiment as illustrated in FIGS. 1-9, the first end of angle adjusting device 7 outer cylinder connects to base frame 5 at angle adjusting device lower pivot 6 and, in the second embodiment as illustrated in FIGS. 10-13, the first end of angle adjusting device 7 is connected to angle adjusting support arm 16 at angle adjusting device lower pivot 6.

In these two embodiments, angle adjusting device 7 outer cylinder is operatively engaged with a center portion of angle adjusting shaft 8 and a first end of angle adjusting shaft 8 rotates inside of angle adjusting device 7 outer cylinder. Although not illustrated, angle adjusting device 7 is represented as being a known common actuating device that is powered by an electric motor to rotate threaded adjusting shaft 8 as it cooperates with a fixed threaded nut located at the second end of angle adjusting device 7 outer cylinder to cause threaded adjusting shaft 8 to extend or contract. However, alternatively, angle adjusting device 7 could operate with a hydraulic or pneumatic cylinder or similar device to extend and contract adjusting shaft 8. Also, not illustrated so as to more clearly illustrate the mechanical components of the invention, an electronic control panel commands and controls the motion of angle adjusting device 7 and therefore the angle of movable frame 10 relative to the floor in the first and second embodiments of the invention.

Lower body user support rails 11 can be constructed of any material capable of supporting lower body user support assemblies 20 but are represented as metal tubes that are curved in shape to match the natural motion pattern of a user's lower body during an exercise motion. The rearward ends of lower body user support rails 11 are rigidly connected to movable frame 10 and the forward ends of lower body user support rails 11 are rigidly connected to movable frame 10. The lower body user support rails 11 are mostly identical to each other and can be mounted to movable frame 10 in a parallel configuration or angled configuration.

Traveling member assemblies 80 can comprise various configurations for rollably engaging lower body user support rails 11 and are capable of supporting and moving lower body user support assemblies 20 and user U during operation of machine 1. Traveling member assemblies 80 are represented as triangular shaped inner and outer metal plates 81 fastened to concave wheels with a fixed axle protruding from the outer plate wherein two spaced traveling member wheels 83 engage the upper side of lower body user support rails 11 and are fastened in between traveling member inner frame plates 81 and traveling member outer frame plates 82. A traveling member wheel 83 engages the underside of lower body user support rails 11 and is fastened in between traveling member inner frame plates 81 and traveling member outer frame plates 82 such that the three wheels form a triangular configuration to capture the lower body user support rails 11. The traveling member outer frame plates 82 are rigidly connected proximal to the center of traveling member outer frame plates 82 to a traveling member axle 84 such that traveling member axle 84 extends from one side only from traveling member outer frame plates 82 in a perpendicular configuration.

Lower body user support assemblies 20 can be constructed of various materials capable of supporting user U's body weight and transferring the force exerted by user U's legs and providing adequate comfort to user U's lower legs and feet during operation of machine 1. Foot platforms 21 are mostly rectangular plates large enough to support substantially all of user U's feet with a small section near user U's toes angled upward to assist in keeping the user's feet securely positioned and to allow the user to impart maximum force during the pushing motion of the exercise. Shin pads 23 are mostly rectangular shaped boards or plates that are padded on the surface and configured to comfortably support user U's shins and ankles and support a substantial portion of user U's body weight and provide a cushioned exertion surface for user U's upper feet and ankles during the pulling motion of the exercise. Shin pads 23 are secured to an upper portion of lower body user support frames 22 and lower body user support frames 22 are formed metal components that are rigidly connected at a lower end to the first end of first lower body user support linkage bars 24 and lower body user support pivot 29. Lower body user support pivot 29 pivotally connects lower body user support assemblies 20 to traveling member assemblies 80 and pivots about traveling member axle 84 during operation of machine 1. First lower body user support linkage bars 24 have first ends and second ends and second lower body user support linkage bars 26 have first ends and second ends and the first ends of first lower body user support linkage bars 24 are rigidly connected to lower body user support pivots 29 and lower body user support frames 22 and pivotally connected at the second ends to the first ends of second lower body user support linkage bars 26. The second end of second lower body user support linkage bars 26 are rigidly connected to left linkages connection hub 70L and right linkages connection hub 70R.

Upper body user support assemblies 30 can be constructed of various materials capable of comfortably supporting user U's upper body and transferring the force of user U's arms during operation of machine 1. Upper body user support lever arms 31 have a first end and a second end and can be constructed of any rigid material but are represented as round metal cylinders that pivot at a first end about upper body user support pivots 34. Upper body user support pivots 34 can be mounted on movable frame 10 in a parallel configuration or in an angled configuration. Upper body user support adjusting shafts 32 have first ends and second ends and a central portion of upper body user support adjusting shafts 32 are operatively engaged with the second end of upper body user support lever arms 31 as the first ends of upper body user support adjusting shafts 32 rotate inside of upper body user support lever arms 31 when the length of upper body user support assemblies 30 are being adjusted. Second ends of upper body user support shafts 32 are rigidly connected to upper body user support grip handles 33 such that adjustment of the length of upper body user support assemblies 30 creates the correct motion for the exercise in cooperation with the angle of adjustment of movable frame 10.

Although some components are not illustrated, the angle adjusting device for upper body user support assemblies 30 is represented as being a known common actuating device that is powered by an electric motor to rotate threaded upper body user support adjusting shafts 32 as they cooperate with a fixed threaded nut located at the second end upper body user support lever arms 31 to cause threaded upper body user support adjusting shaft 32 to extend or contract. However, alternatively, upper body user support angle adjusting shafts 32 could operate with a hydraulic or pneumatic cylinder or similar device to extend and contract upper body user support adjusting shafts 32 and upper body user support grip handles 33. Upper body user supports 30 also comprise upper body user support linkage connection flanges 35 which have a first end and a second end and upper body user support linkage bars 37 which have a first end and a second end. A first end of upper body user support linkage bar flanges 35 is rigidly connected at a first end to a first end of upper body user support lever arms 31 and pivotally connected at a second end to a first end of upper body user support linkage bars 37 and a second end of upper body user support linkage bars 37 are pivotally connected to left linkages connection hub flange 71L and right linkages connection hub flange 71R at upper body user support linkage bar upper pivot 38. Although not illustrated so as to more clearly illustrate the mechanical components of the invention, an electronic control panel commands and controls the length of upper body user support assemblies 30 and synchronizes that length with the angle of adjustment of angle adjusting device 7 and the angle of movable frame 10 so as to optimize the motion of each exercise position for user U during operation of machine 1.

Rotational resistance mechanism 40 can be comprised of various components that create an adjustable resistance to the rotation of a flywheel, fan blades, paddle wheels, or the like. However, resistance mechanism 40 is represented as a flywheel with an electronically controlled resistance component such as a set of magnets. Rotational resistance mechanism 40 is rigidly mounted on rotational resistance axle 41 and preferably to a central portion of rotational resistance axle 41. Rotational resistance axle 41 is rotatably mounted on rotational resistance axle connection flange 42 and rotational resistance axle connection flange 42 is rigidly connected to movable frame 10 and preferably proximal to a central portion of movable frame 10 such that rotational resistance mechanism 40 moves with movable frame 10 when it is adjusted to various angles of exercise position relative to the floor. Although not illustrated, the resistance setting of rotational resistance mechanism 40 is controlled and adjusted by way of an electronic control panel, which can comprise a microprocessor and associated components memories for programming and controlling the machine, as is known to those of ordinary skill in the art.

Resistance drive assembly 50 is comprised of multiple components for transferring the synchronized force of pushing and pulling motions imparted by user U upon lower body user support assemblies 20 and upper body user support assemblies 30 to rotate rotational resistance mechanism 40 during operation of machine 1. An upper resistance drive sprocket 51 is rigidly connected to left linkages connection hub 70L and an upper resistance drive sprocket 51 is rigidly connected to right linkages connection hub 70R and lower resistance drive sprockets 52 are mounted on one-way clutches 53 that are mounted on and rotate rotational resistance axle 41. Upper resistance drive sprockets 51 and lower resistance drive sprockets 52 are operatively connected with flexible drive members 54 such that the reciprocal partial rotations of upper resistance drive sprockets 51 cause lower resistance drive sprockets 52 to rotate one-way clutches 53, which cause one directional rotation of rotational resistance axle 41 and rotational resistance mechanism 40 during operation of machine 1.

Left linkages connection hub 70L and right linkages connection hub 70R rotate less than 360 degrees in both directions on fixed linkages connection hub axle 72. Left linkages connection hub flange 71L is rigidly connected to left linkages connection hub 70L and right linkages connection hub flange 71R is rigidly connected to right linkages connection hub 70R.

Rocker arm linkage assembly 60 can be constructed of various components capable of operably connecting and transferring the pushing and pulling force of lower body user support assemblies 20 and upper body user support assemblies 30 during operation of machine 1. Rocker arm linkage assembly 60 is represented as rigid rocker arm 61 having a left end and a right end and a center rocker arm pivot 62 such that rocker arm pivot 62 pivotally connects rocker arm 61 to a central portion of movable frame 10, and rocker arm linkage bars 65 having first ends and second ends such that the left end of rocker arm 61 is pivotally connected to a first end of a linkage bar 65, the second end of said linkage bar 65 is pivotally connected to left linkages connection hub flange 71L, the right end of rocker arm 61 is pivotally connected to a first end of a linkage bar 65, and the second end of said linkage bar 65 is pivotally connected to right linkages connection hub flange 71R.

FIGS. 1-14 represent various angle positions of movable frame 10 relative to the floor. Each of the angles position the user U to perform a different type of exercise as gravity forces user U to support his or her body with different muscle groups and increase or decrease the exertion required from different muscle groups to perform each of the exercises. To optimize the biomechanical motion of each exercise, an electronic control panel synchronizes and controls the length of the upper body user support assembly 30 with the angle of the movable frame 10 such that any time the movable frame 10 is adjusted in angle the length of upper body user support assembly 30 is concurrently adjusted.

Figure 2:
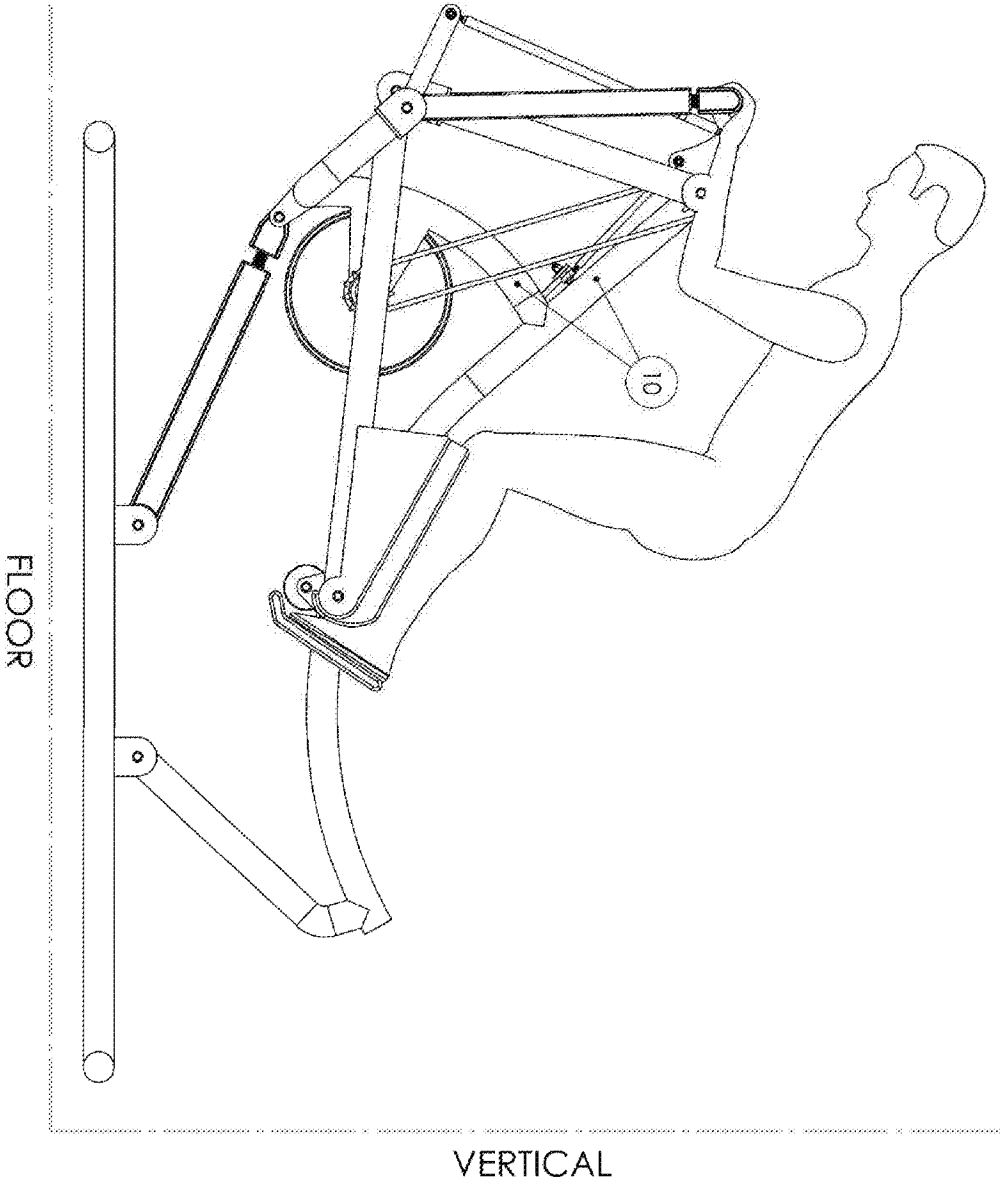
FIG. 2 is a side view of the invention at a lower angle position with a user in a mid-point position of a simulated crawling motion exercise.
Figure 10:
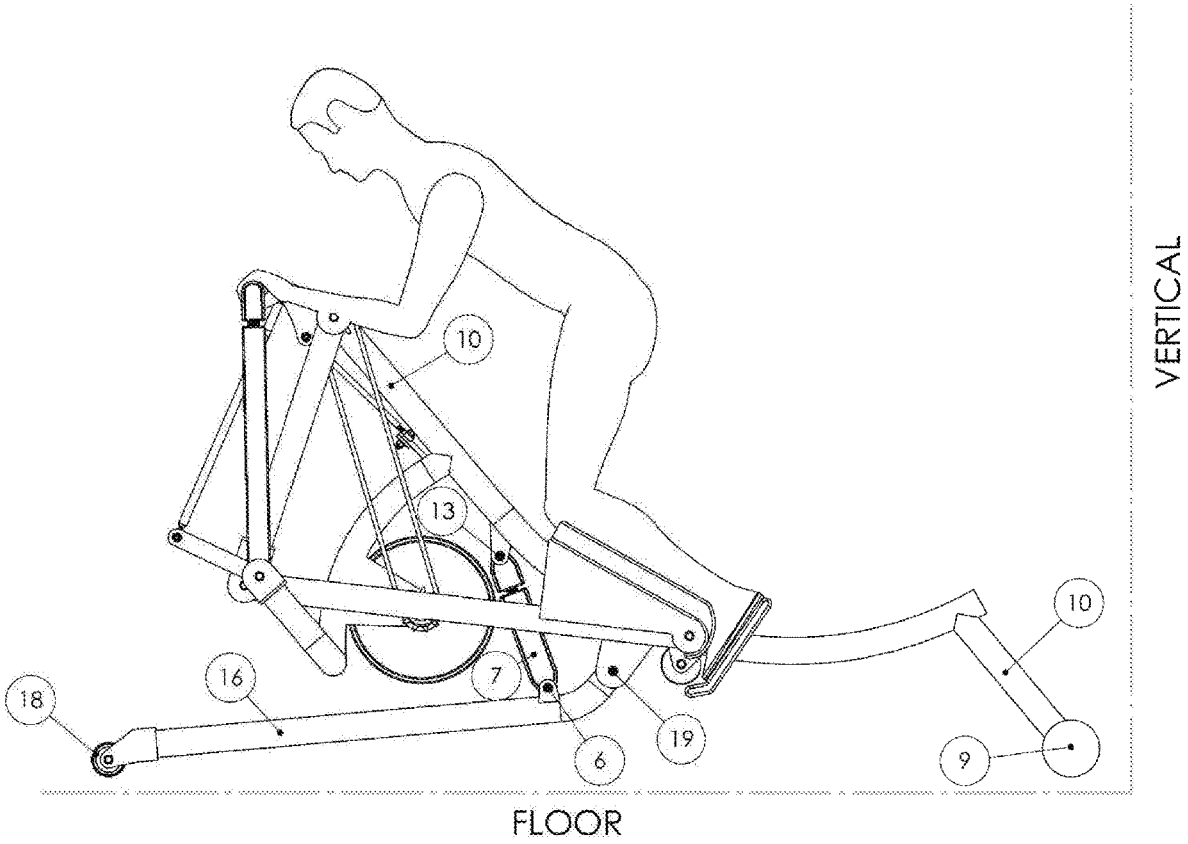
FIG. 10 is a side view of the invention at a lower angle position with a user in a mid-point position of a simulated crawling motion exercise.

FIGS. 1, 2, and 10 represent a simulated crawling motion exercise wherein the user U is proximal to a maximum forward leaning position and user U's weight bearing is divided between the upper body user supports 30, and the angle of the movable user support and the length of the upper body user support assemblies are synchronized proximal to their lower settings to maximize the biomechanical motion of the exercise. In this exercise position, most of user U's lower body weight is supported by the left and right shin pads 23. In FIG. 1, user U is proximal to full pushing extension of user U's right arm and leg and proximal to full pulling contraction of user U's left arm and leg. In FIGS. 2 and 10, user U is at a mid-point in the exercise motion such that user U's left arm and left leg or right arm and right leg are at a mid-point of pushing and the other arm and leg are at a mid-point of pulling.

Figure 3:
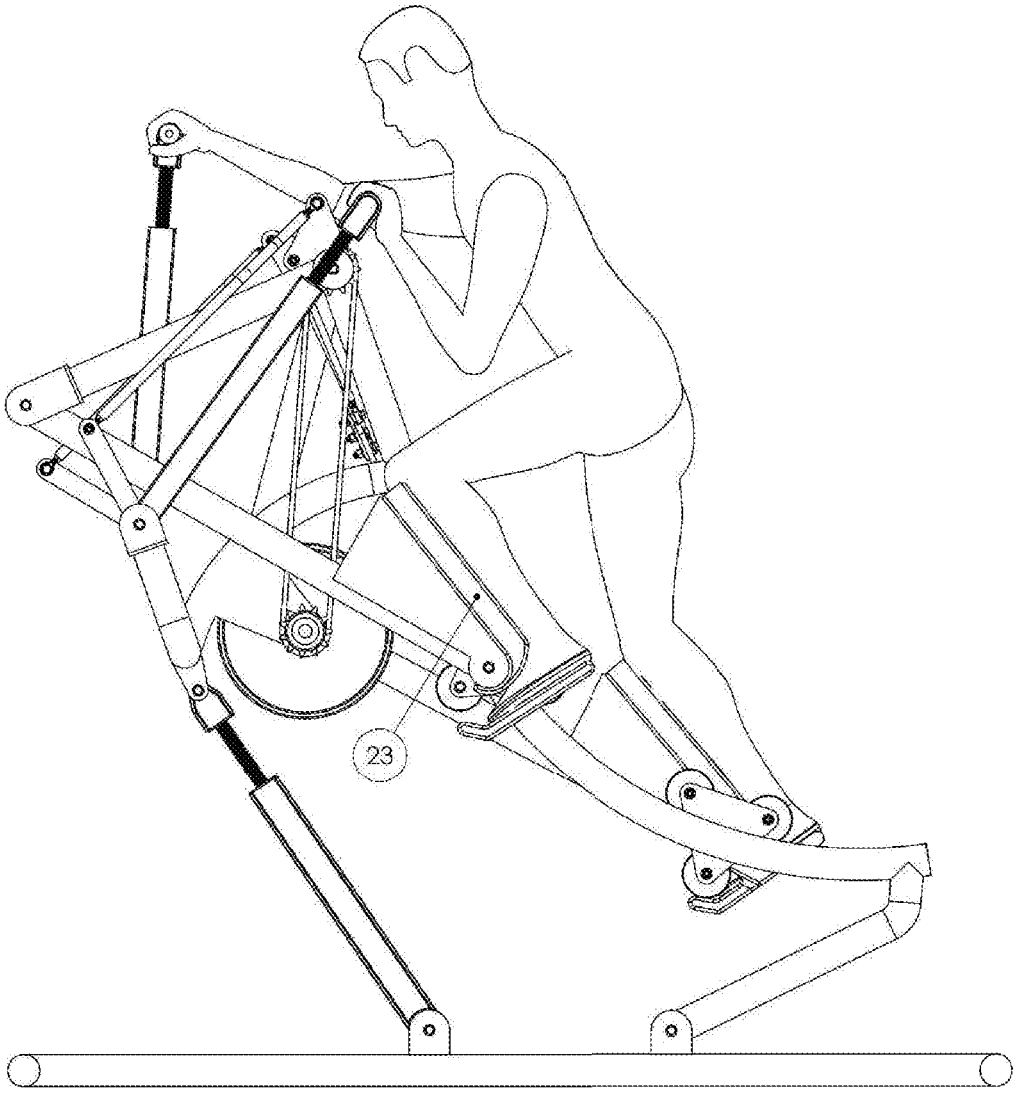
FIG. 3 is a side view of the invention at a mid-point angle position with a user performing a simulated hill climbing exercise.
Figure 4:
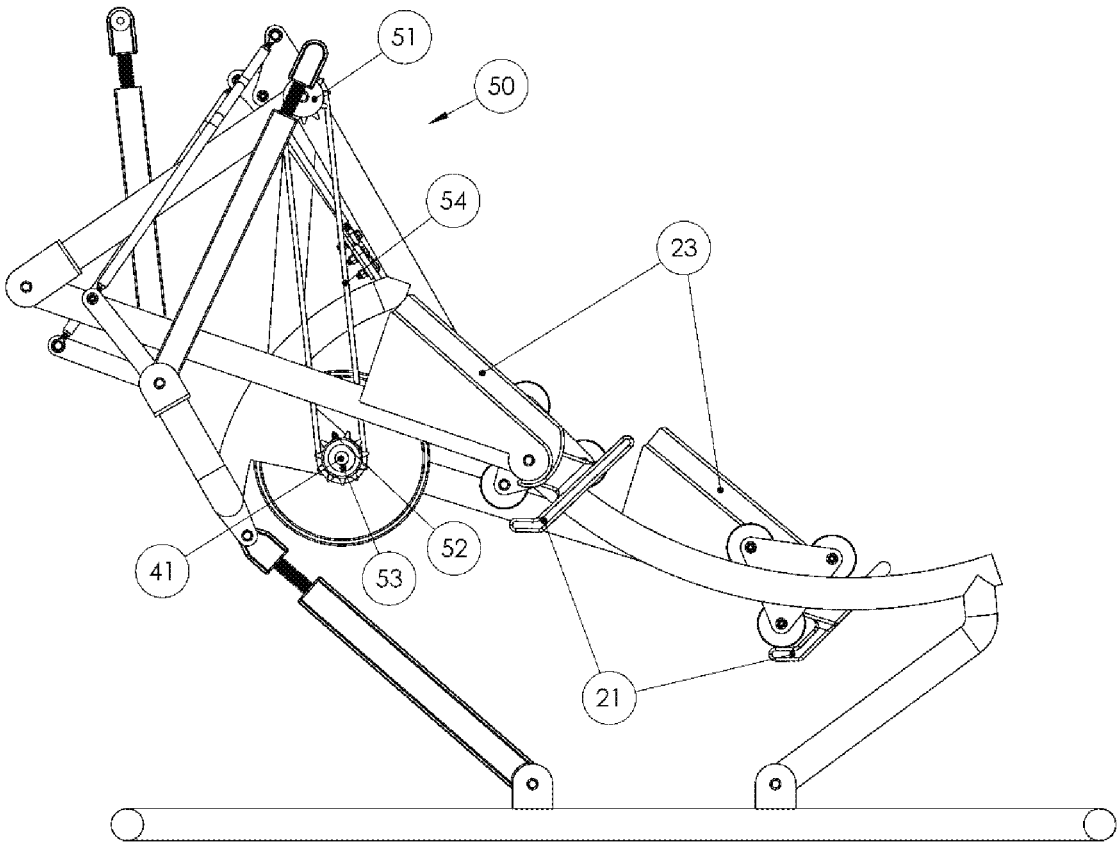
FIG. 4 is a side view of the invention at a lower angle position.
Figure 5:
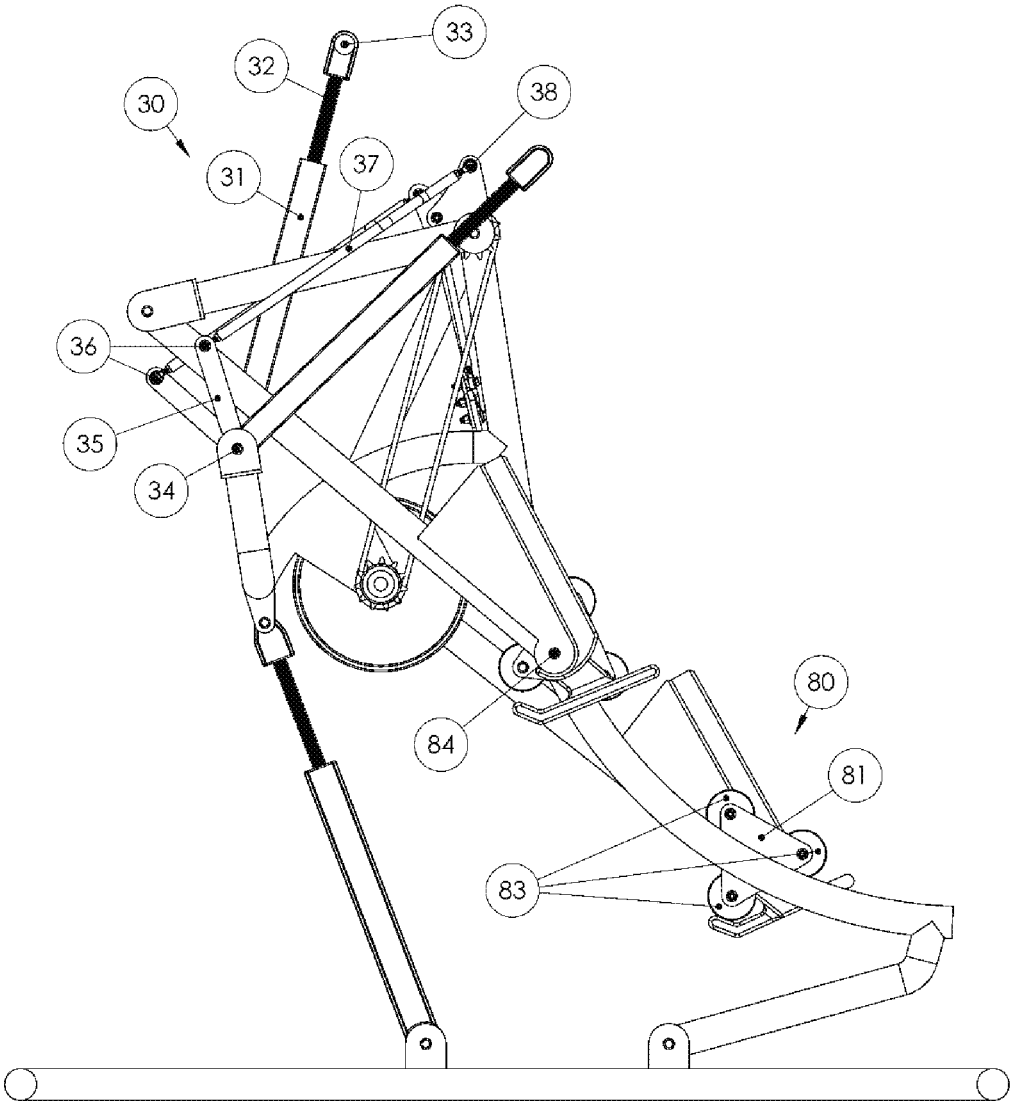
FIG. 5 is a side view of the invention at a higher angle position.

FIGS. 3 and 13 represent a simulated hill climbing exercise wherein user U is in a mid-point forward leaning position and most of user U's weight bearing is supported by lower body user supports 20, and user U is capable of maximizing his or her leverage and pushing and pulling force by leaning into lower body user support shin pads 23 while gripping upper body user support grip handles 33. The angle of movable frame 10 and the length of upper body user supports 30 are synchronized at a mid-point location to optimize the biomechanical motion of the exercise.

Figure 6:
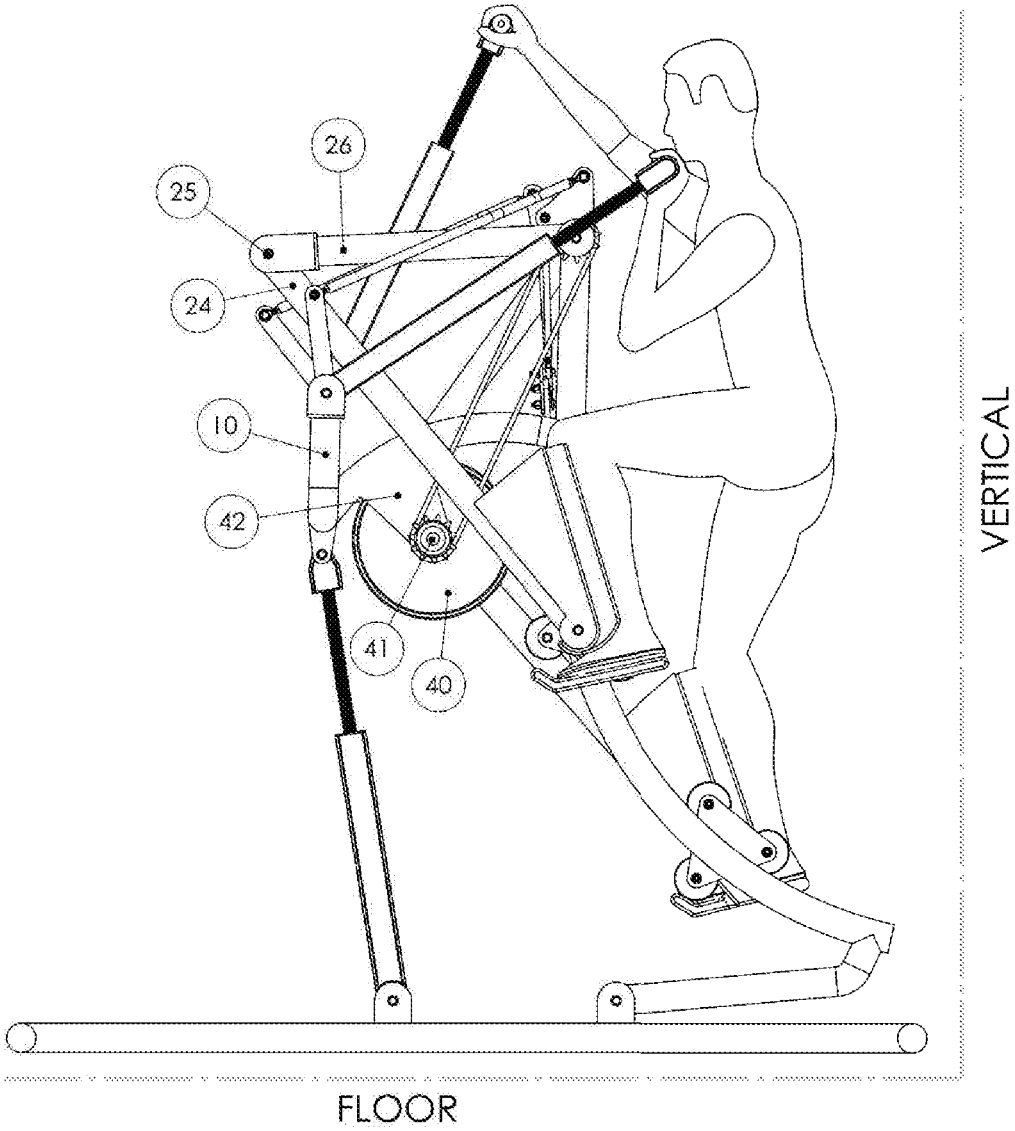
FIG. 6 is a side view of the invention at a higher angle position with a user performing a simulated ladder climbing exercise.
Figure 7:
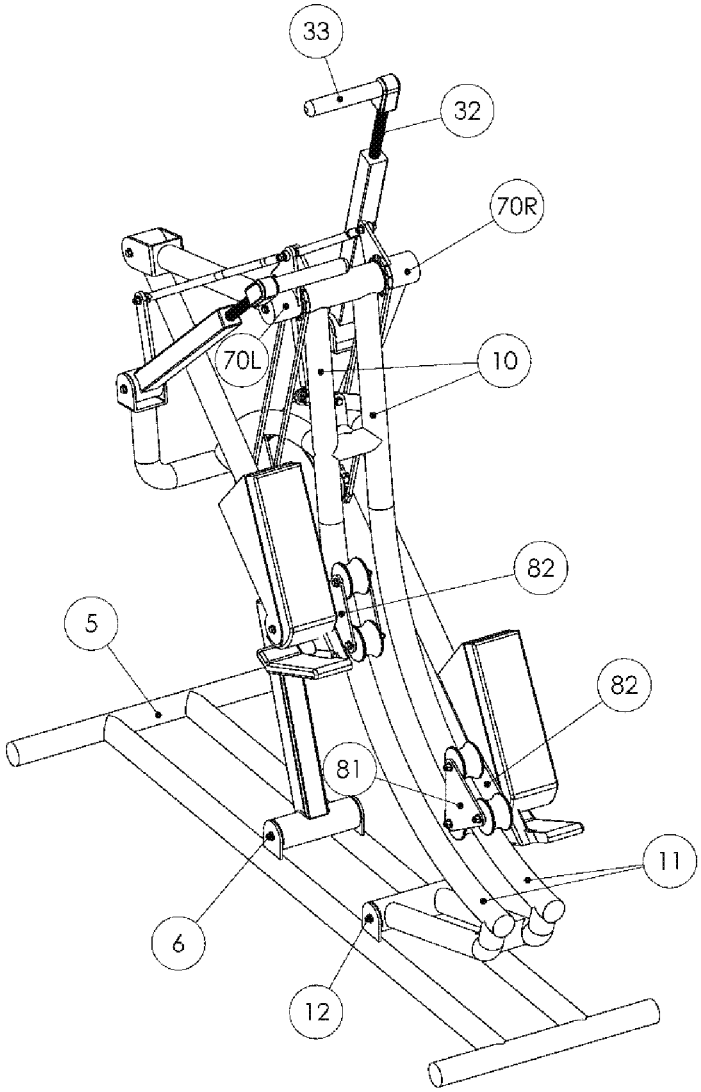
FIG. 7 is a rear perspective view of the invention at a higher angle position.
Figure 8:
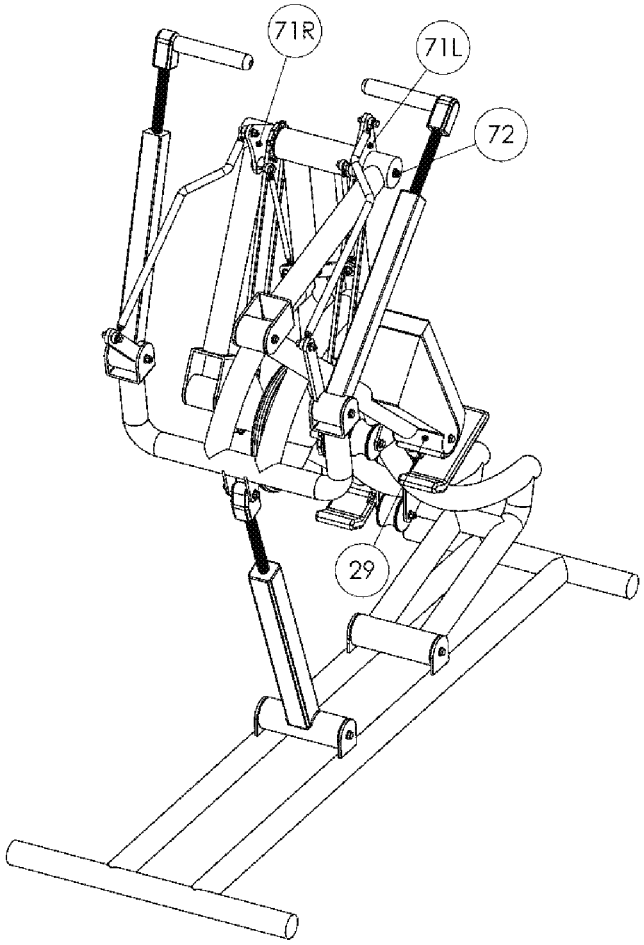
FIG. 8 is a front perspective view of the invention at a higher angle position.
Figure 11:
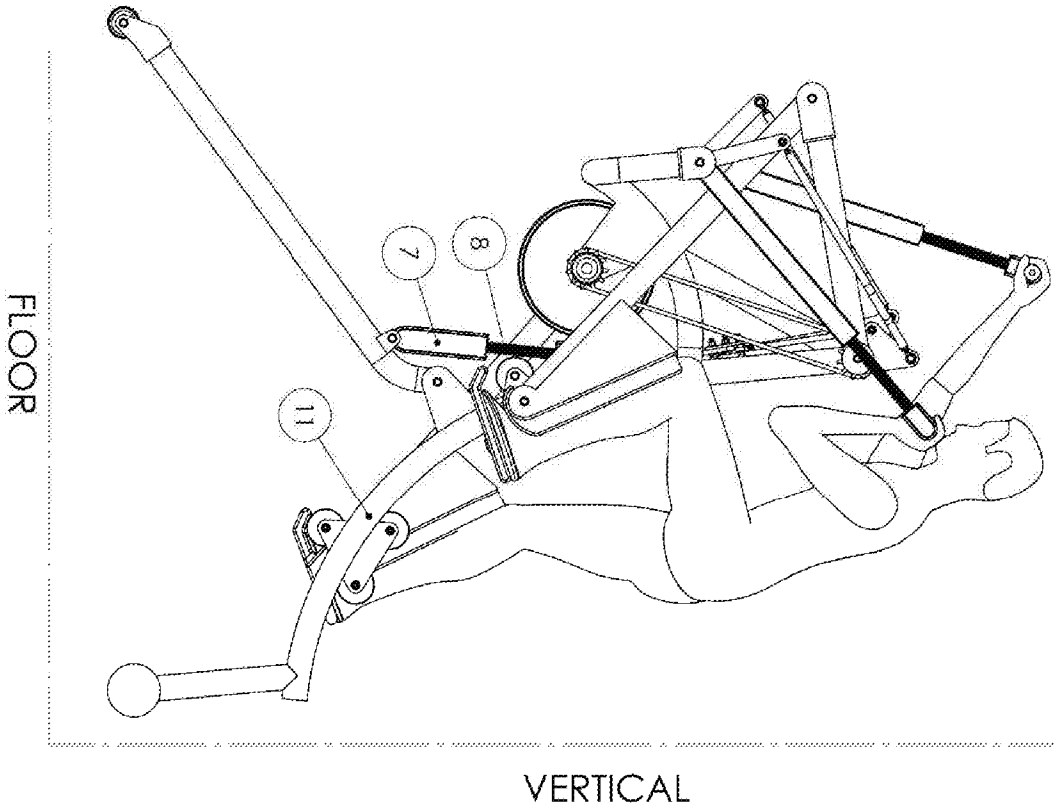
FIG. 11 is a side view of the invention at a higher angle position with a user performing a simulated ladder climbing exercise.

FIGS. 6 and 11 represent a simulated ladder climbing exercise wherein user U is in a more vertical position and substantially all of user U's weight bearing is supported by lower user supports 20, and user U is capable of maximizing his or her leverage and pushing and pulling force by bracing against lower body user support shin pads 23 while gripping upper body user support grip handles 33. The angle of movable frame 10 is proximal to its highest setting and the length of upper body user supports 30 are synchronized proximal their longest length to optimize the biomechanical motion of the exercise.

Figure 12:
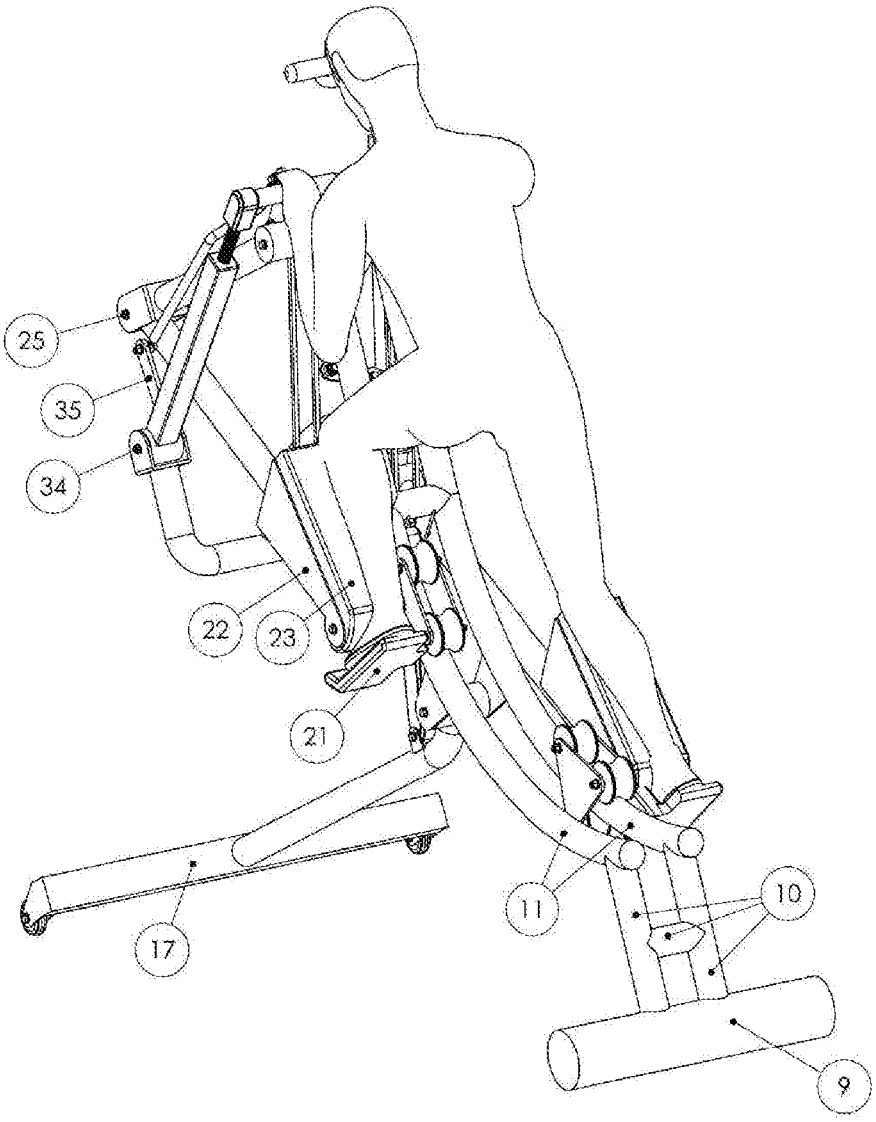
FIG. 12 is a rear perspective view of the invention at a mid-point angle position with a user performing a simulated sprinting exercise.

FIG. 12 represents a simulated forward leaning sprinting motion wherein user U is in a mid-point forward leaning position and more of user U's weight bearing is supported by lower body user supports 20 than upper body user supports 30, and user U is leaning into and bracing against lower body user support shin pads 23 and leaning into and bracing against upper body user support grip handles 33 to obtain maximum leverage and exert maximum force into the user supports. The angle of movable frame 10 and the length of upper body user supports 30 are synchronized at a mid-point location to optimize the biomechanical motion of the exercise.

Figure 9:
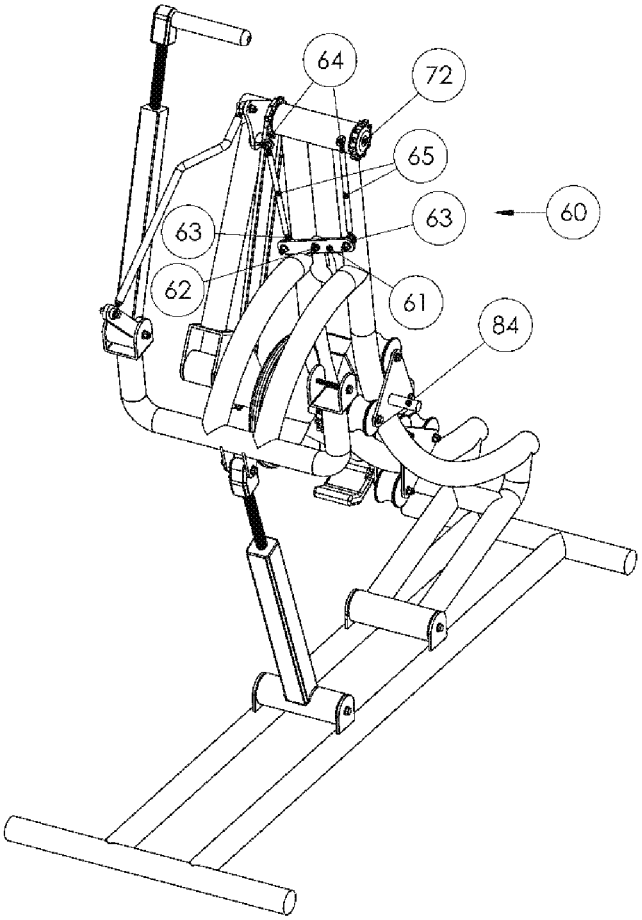
FIG. 9 is a front perspective view of the invention at a higher angle position with a portion of the components removed so as to more clearly illustrate certain components of the machine.

FIG. 9 represents a partially disassembled embodiment of the invention wherein the left lower body user support assembly 20 and the left upper body user support assembly 30 have been removed to better illustrate some of the other features and components that are more central to the machine 1.

The optimal biomechanical motion and function of machine 1 is achieved when the length of upper body user support assemblies 30 is synchronized with the angle of movable frame 10 and the length of upper body user support assemblies 30 adjust in unison with the angle of movable frame 10. However, machine 1 can be operated such that the length of upper body user support assemblies 30 are not synchronized with the angle of movable frame 10 and the adjustment of upper body user support assemblies 30 are independent of the adjustment of the angle of movable frame 10.

To operate the invention in any position, user U steps onto left and right foot platforms 21 and leans forward towards machine 1 such that user U's shins, a portion of user U's ankles, the tops of user U's feet, and, based on the size of user U, possibly a portion of user U's knees, contact and brace against left and right shin pads 23, and user U grasps left and right upper body user support grip handles 33. User U may also set the desired resistance (resistance force) of rotational resistance mechanism 40, the desired angle position of movable frame 10, and the desired length of upper body user support assembly 30 prior to operating machine 1 with an electronic control panel that is not illustrated. Said electronic control panel may also comprise preset computer programs that can be selected by user U such that said electronic control panel can set and adjust the resistance of rotational resistance mechanism 40, the angle position of movable frame 10, and the length upper body user supports 30 prior to and during operation of machine 1 by user U.

To begin exercising on machine 1, user U will push against grip handle 33 and foot platform 21 with one side of user U's body while simultaneously pulling against the opposing grip handle 33 and shin pad 23 with the other side of user U's body. For example, if user U's right hand is gripping right grip handle 33 while user U's right arm is extending, then user U's right foot will be pressing against right foot platform 21 and user U's right lower leg will be bracing against right shin pad 23 while user U's right leg is extending, and user U's left hand will be gripping left grip handle 33 while user U's left arm is contracting and user U's left foot will be contacting left foot platform 21 and the top of user U's left foot, ankle, and shin will be pulling against left shin pad 23 while user U's left leg is contracting. This exercise motion will cause right upper body user support lever arm 31 to pivot forward about right upper body user support pivot 34, causing right upper body user support linkage connection flange 35 to pivot forward about right upper body user support pivot 34, causing right upper body user support linkage bar 37 to move downward and pivot about right upper body user support linkage bar lower pivot 36 and right upper body user support linkage bar upper pivot 38, causing right linkages connection hub flange 71R to pivot forward about linkages connection hub axle 72.

Concurrently with this motion, right traveling member wheels 83 roll rearward on right lower body support rail 11 moving right lower body user support foot platform 21 and right shin pad 23 rearward on right lower body support rail 11 while right lower body user support frame 23 pivots about right travel member axle 84 at right lower body user support pivot 29, causing right first lower body user support linkage bar 24 to move rearward and pivot about right lower body user support linkage pivot 25, causing right second lower body user support linkage bar 26 to move rearward and pivot on right linkages connection hub 70R about linkages connection hub axle 72. This right side motion of machine 1 concurrently causes right upper resistance drive sprocket 51 to rotate forward, causing the forward portion of right flexible drive member 54 to move downward and rotate right lower resistance drive sprocket 52 forward, causing one-way clutch 53 to engage and rotate rotational resistance axle 41 and rotational resistance mechanism 40. This right side motion of machine 1 concurrently engages rocker arm linkage assembly 60 causing right side rocker arm linkage bar 65 to move downward and pivot on right rocker arm linkage upper pivot 64 and right rocker arm linkage lower pivot 63, causing rocker arm 61 to pivot about rocker arm pivot 62 and the right end of rocker arm 61 to move downward, causing the left end of rocker arm 61 to move upward, causing left rocker arm linkage bar 65 to move upward and pivot about left rocker arm linkage lower pivot 63 and left rocker arm linkage upper pivot 64.

This movement of rocker arm linkage assembly 60 concurrently causes left upper body user support lever arm 31 to pivot rearward about left upper body user support pivot 34, causing left upper body user support linkage connection flange 35 to pivot rearward about left upper body user support pivot 34, causing left upper body user support linkage bar 37 to move upward and pivot about left upper body user support linkage bar lower pivot 36 and left upper body user support linkage bar upper pivot 38, causing left linkages connection hub flange 71L to pivot rearward about linkages connection hub axle 72.

Concurrently with this motion, left traveling member wheels 83 roll forward on left lower body support rail 11 moving left lower body user support foot platform 21 and left shin pad 23 forward on left lower body support rail 11 while left lower body user support frame 22 pivots about left travel member axle 84 at left lower body user support pivot 29, causing left first lower body user support linkage bar 24 to move forward and pivot about left lower body user support linkage pivot 25, causing left second lower body user support linkage bar 26 to move forward and pivot on left linkages connection hub 70R about linkages connection hub axle 72.

This left side motion of machine 1 concurrently causes left upper resistance drive sprocket 51 to rotate rearward, causing the forward portion of left flexible drive member 54 to move upward and rotate left lower resistance drive sprocket 52 rearward, causing one-way clutch 53 to disengage from rotational resistance axle 41. The reciprocal and opposite motion of operating the left and right sides of machine 1 reverses the order of the concurrent motion of the components of machine 1.

User U can perform multiple reciprocal repetitions of pushing and pulling motions at a fixed angle or at various angles during an exercise session.

Rocker arm linkage assembly 60 cooperatively links left side upper and lower body user supports to the right side upper and lower body user supports of machine 1 such that user U can combine synchronized pushing and pulling motions with all four limbs to rotate rotational resistance axle 41 and propel rotational resistance mechanism 40.

In various embodiments, the lower body support rails 11 that are mounted on the movable user support frame 10 can have a curved shape. Alternatively, in various other embodiments, the lower body support rails 11 that are mounted on the movable user support frame 10 can have a straight or linear shape.

Now referring to FIGS. 15-40, various views of these embodiments of the machines 100, 200, and 300 are shown to provide a more complete understanding of these embodiments of the invention. The exercise motion of all three of these embodiments is the virtually identical. The three machines differ in how the angle adjustment of the movable user support frame 110, 210, or 310 is achieved. Machine 100 uses an assembly powered by an electrical actuator motor to adjust the angle of the movable user support frame 110. Machine 200 uses a manually driven gearing assembly powered by the exercise motion of the user to adjust the angle of the movable user support frame 210. Machine 300 uses a lockable lever that requires the user to manually adjust the angle of the movable user support frame 310 prior to operating machine 300. The primary advantage of machine 100 is the convenience, speed, and electronic programmability of angle adjustment of the user support. The primary advantage of machine 200 is that it does not require electricity to operate machine 200. The advantages of machine 300 are that it does not require electricity to operate machine 300 and machine 300 is constructed with a smaller number of components than machine 100 or 200 and is therefore less costly to manufacture.

FIGS. 15-40 use common components to create the exercise motion of machines 100, 200, and 300. Machines 100 and 200 respectively use 100 and 200 series numbers to identify their components. Components identification for machine 300 are limited to the angle adjustment components and the stationary and movable frames to avoid excessive repetition. These common components that create the exercise motion of the invention may be configured or connected in multiple variations, and located in various positions on machines 100, 200, or 300 to produce the same or very similar exercise motion. Machine 100, 200, or 300 may also produce the same or very similar exercise motion if one or more of these common components that create the exercise motion of the invention is eliminated from machine 100, 200, or 300.

Referring to FIGS. 15-36, a rearward portion of movable user support frame 110 or 210 is pivotably mounted on a rearward portion of stationary base frame 105 or 205 and left and right lower body user support wheel tracks 185 or 285 are rigidly mounted on a rearward and central portion of movable user support frame 110 or 210.

Left and right lower body user support wheels 183 or 283 are mounted proximal to first ends of left and right first lower body user support linkage bars 124 or 224 and are rollably engaged with lower body user support wheel tracks 185 or 285. Left and right foot platforms 121 or 221 and left and right shin pads 123 or 223 are rigidly mounted proximal to first ends of first lower body user support linkage bars 124 or 224 and second ends of first lower body user support linkage bars 124 or 224 are pivotably connected to first ends of left and right second lower body user support linkage bars 126 or 226 with left and right lower body user support pivots 125. The second ends of second lower body user support linkage bars 126 or 226 are rigidly connected to left and right linkages connection hubs 170 or 270 such that a rolling motion of lower body user support wheels 183 or 283 causes rotational movement of linkages connection hubs 170 or 270.

A first end of upper body user support height adjustment lever 175 or 275 is pivotably connected to a forward and upper portion of movable user support frame 110 or 210 at upper body user support height adjustment lever pivot 176 or 276. Left and right upper body user support grip handles 133 or 233 are rigidly mounted to first ends of left and right upper body user support lever arms 131 or 231 and second ends of upper body user support lever arms 131 or 231 are independently pivotably connected to left and right sides of a second end of upper body user support height adjustment lever 175 or 275 with upper body user support pivots 134 or 234. First ends of left and right upper body user support arm linkage bars 137 or 237 are pivotably connected to left and right upper body user support pivots 134 or 234 and second ends of upper body user support linkage bars 137 or 237 are pivotably connected to left and right linkage connect hub flanges 171 or 271 such that a pivoting arcing motion of user support grip handles 133 or 233 causes rotational movement of linkages connection hub flanges 171 or 271 and linkages connection hubs 170 or 270.

Left linkage connection hubs 170 or 270 and left linkage hub flanges 171 or 271 operatively and dependently connect the exercise motions of the left side upper body user supports and the left side lower body user supports. Right side linkage connection hubs 170 or 270 and right side linkage hub flanges 171 or 271 operatively and dependently connect the exercise motions of the right side upper body user supports and the right side lower body users supports. During operation of machine 100, 200, or 300, left linkage connection hubs 170 or 270 and right linkage connection hubs 170 or 270 oscillate back and forth in partial rotations only such that user U controls the range of oscillating motion of left and right connection linkage hubs 170 or 270 and the left and right upper and lower body user support lever arms 131 or 231.

A central portion or second end of upper body user support height adjustment lever 175 or 275 is operatively connected to angle adjustment assembly 190 or 290 via upper body user support height adjustment lever push rod 177 or 277. A first end of upper body user support height adjustment lever push rod 177 or 277 is pivotably connected to upper body user support height adjustment lever 175 or 275 at upper body user support height adjustment lever push rod upper pivot 178 or 278 and a second end of upper body user support height adjustment lever push rod 177 or 277 is pivotably connected to angle adjustment assembly 190 or 290 at upper body user support height adjustment lever push rod lower pivot 179 or 279 such that anytime the angle of movable user support frame 110 or 210 is adjusted, the angle of upper body user support height adjustment lever 175 or 275 is concurrently adjusted relative to movable user support frame 110 or 210. When angle adjustment assembly 190 or 290 causes the angle of movable user support frame 110 or 210 to move into a more vertical position, angle adjustment assembly 190 or 290 concurrently causes upper body user support height adjustment lever 175 or 275 to pivot about movable user support frame 110 or 210 to lift left and right upper body user support lever arms 131 or 231 and upper body user support grip handles 133 or 233 upward and away from movable user support frame 110 or 210 such that user U will be moving upper body user support lever arms 131 or 231 and upper body user support grip handles 133 or 233 in a higher arcing path during operation of machine 100, 200, or 300 and when angle adjustment assembly 190 or 290 causes the angle of movable user support frame 110 or 210 to move into a more horizontal position, angle adjustment assembly 190 or 290 concurrently causes upper body user support height adjustment lever 175 or 275 to pivot about movable user support frame 110 or 210 to lower left and right upper body user support lever arms 131 or 231 and upper body user support grip handles 133 or 233 downward and closer to movable user support frame 110 or 210 such that user U will be moving upper body user support lever arms 131 or 231 and upper body user support grip handles 133 or 233 in a lower arcing path during operation of machine 100, 200 or 300. This concurrent and synced adjustment of movable user support frame 110 or 210 and upper body user support grip handles 133 or 233 creates a more comfortable and biomechanically correct exercise motion for user U during operation of machine 100, 200 or 300.

A stationary grip handle 139 or 239 is rigidly connected to a forward central portion of movable user support frame 110 or 210 such that user U can steady his or her upper body during operation of machine 100, 200, or 300 while only urging left and right lower body user supports with left and right foot platforms 121 or 221 and left and right shin pads 123 or 223 and not engaging upper body user support lever arms 131 or 231 and upper body user support grip handles 133 or 233. User U may also may use stationary grip handle 139 or 239 to steady himself or herself while entering or exiting machine 100, 200 or 300.

Figure 19:
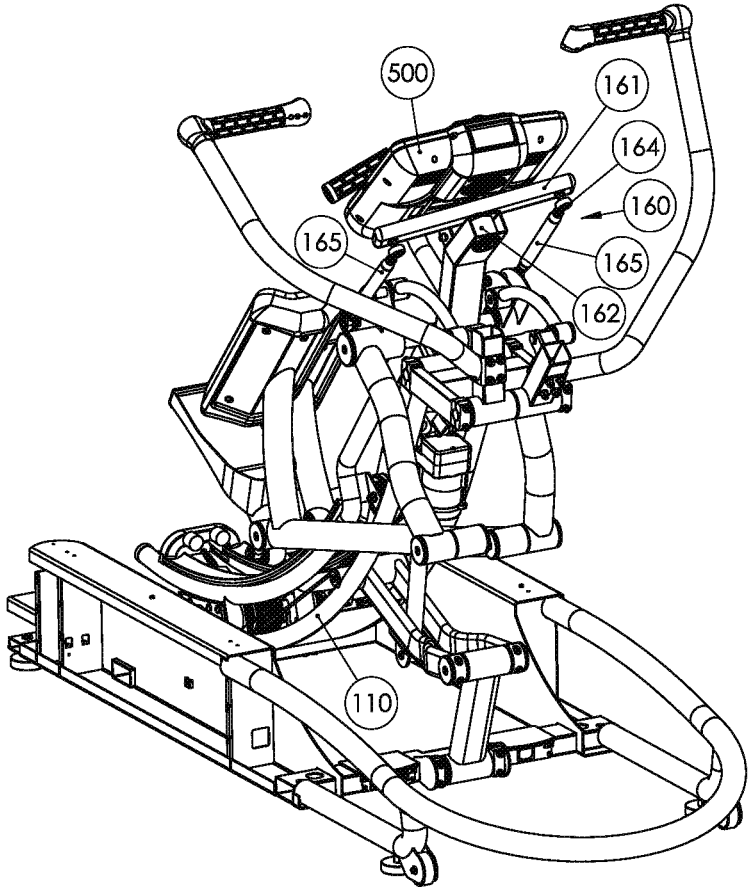
FIG. 19 is a front right side perspective view of the invention at a middle angle position with an electrical angle adjustment mechanism.
Figure 33:
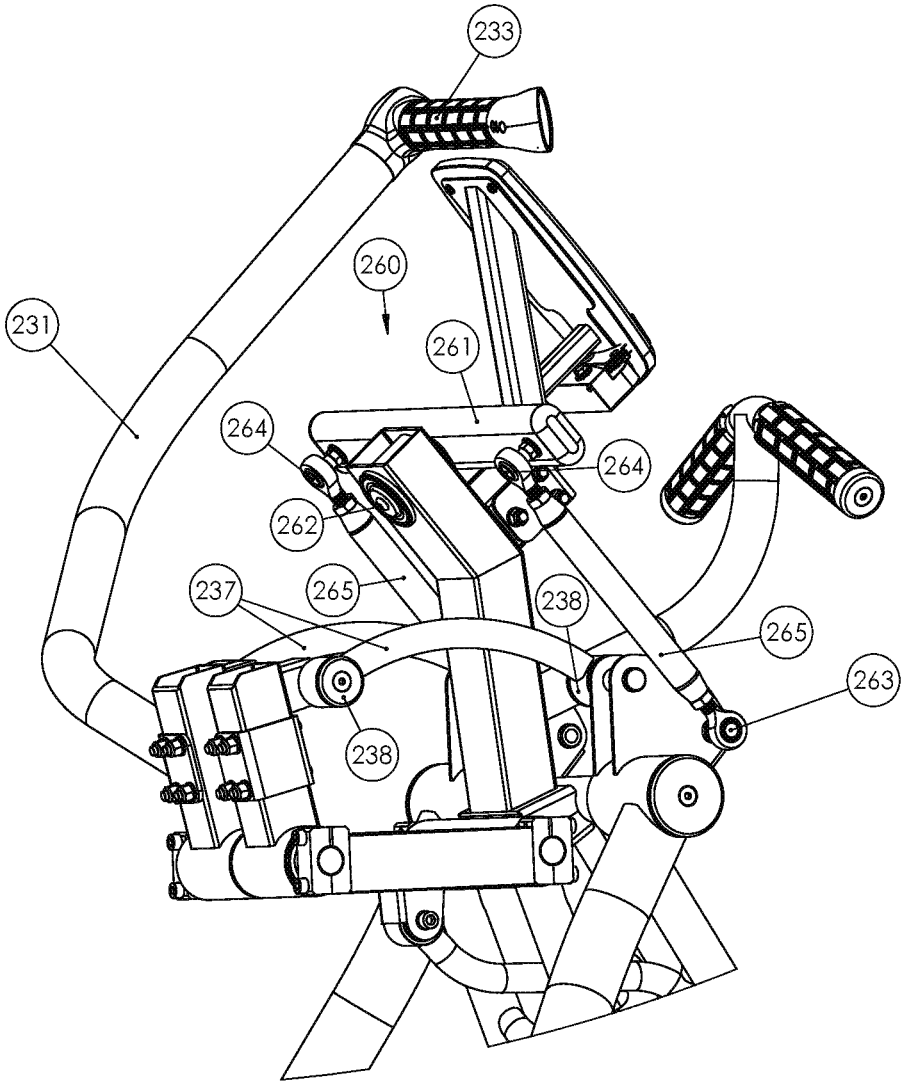
FIG. 33 is a close-up front view of the upper portion of the invention with a manual gear drive adjustment mechanism.
Figure 34:
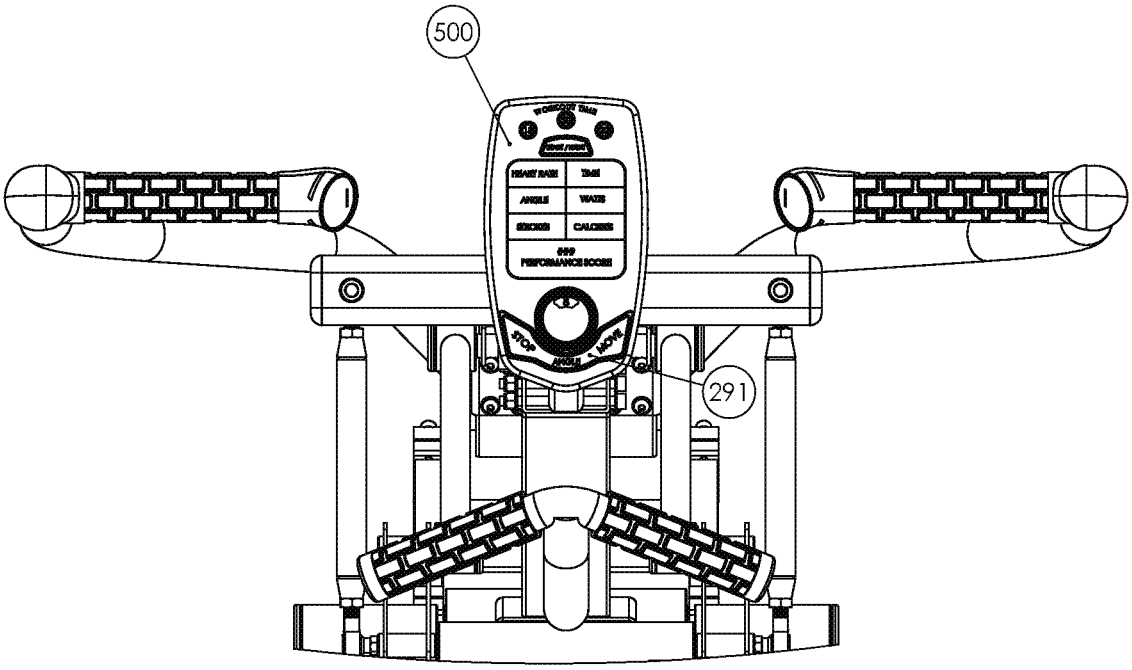
FIG. 34 Is a close up elevated rear view of the upper portion of the invention with a manual gear drive adjustment mechanism.
Figure 35:
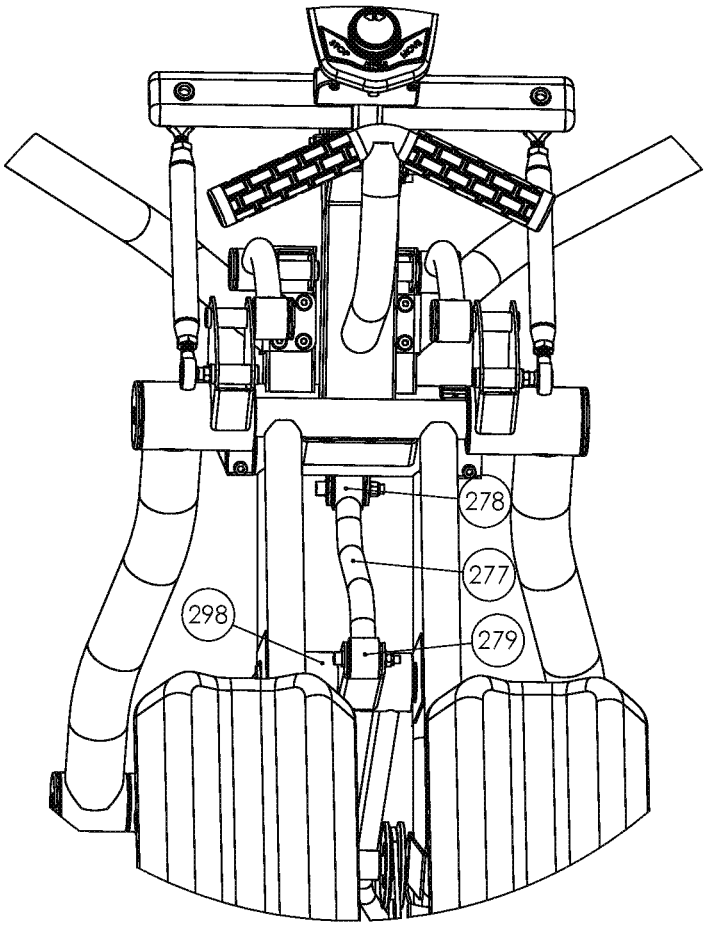
FIG. 35 is a close up elevated rear view of the central portion of the invention with a manual gear drive adjustment mechanism.
Figure 36:
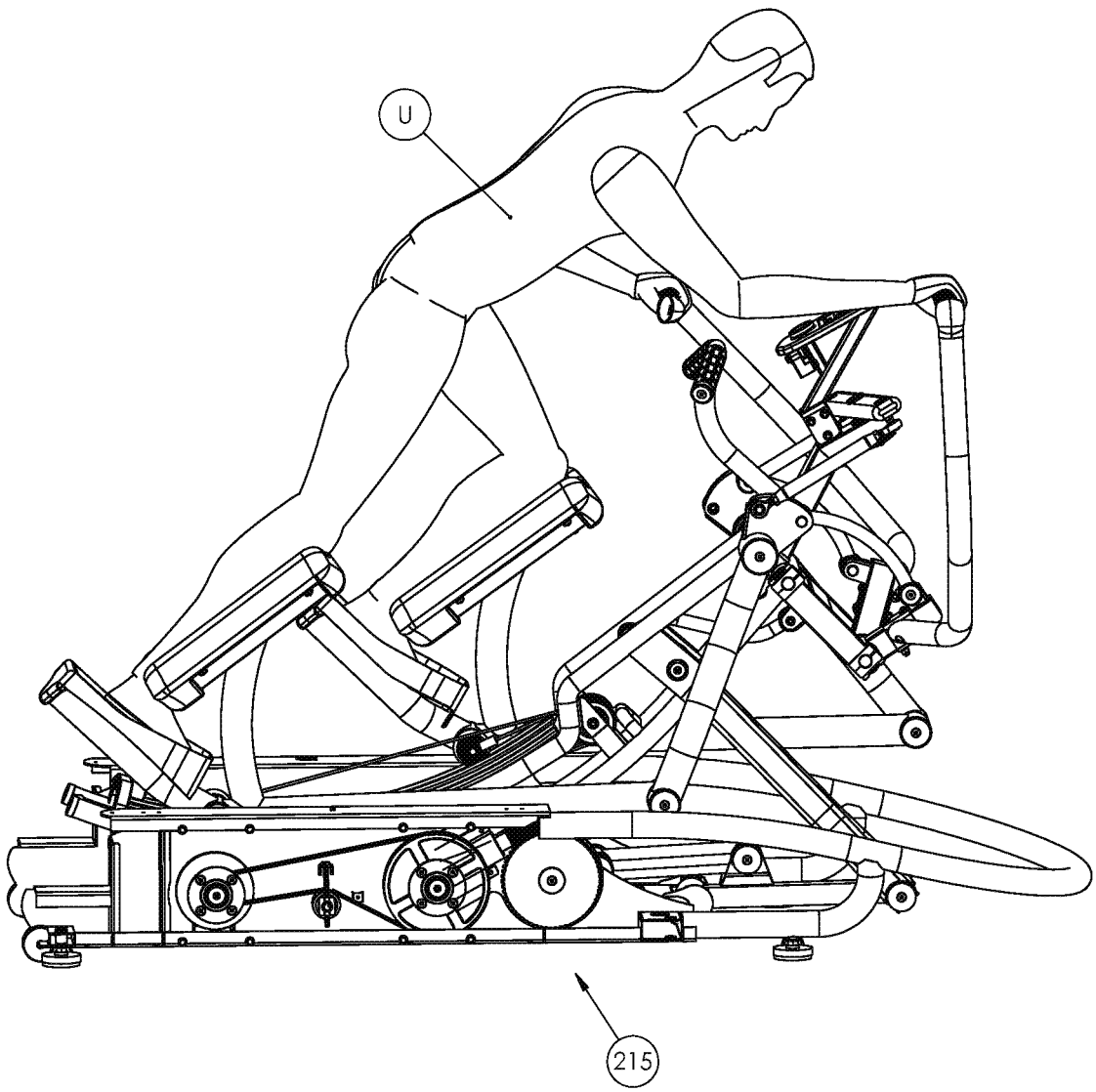
FIG. 36 is a right side view of the invention in a lower angle position with a manual gear drive adjustment mechanism and a user operating the machine.

Rocker arm assembly 160 or 260 is best illustrated in FIGS. 19 and 33 and described in detail as follows:

A central portion of rocker arm 161 or 261 is pivotably connected to a forward and upper portion of movable user support frame 110 or 210. Left and right ends of rocker arm 161 or 261 are pivotably connected to first ends of left and right rocker arm linkage bars 165 or 265 with rocker arm linkage bar upper pivots 164 or 264. Second ends of rocker arm linkage bars 165 or 265 are pivotably connected to linkage connection hub flanges 171 or 271 with rocker arm linkage bars lower pivots 163 or 263 such that the left and right upper and lower body user supports are operatively connected and synchronized such that any rolling motion of either lower body user support or pivoting motion of either upper body user supports causes movement of all 4 user supports. This concurrent motion is such that the left side upper body user support and the left side lower body user support move in simultaneous pulling motions when the right side upper body user support and the right side lower body user support move in simultaneous pushing motions and vice versa.

Figure 20:
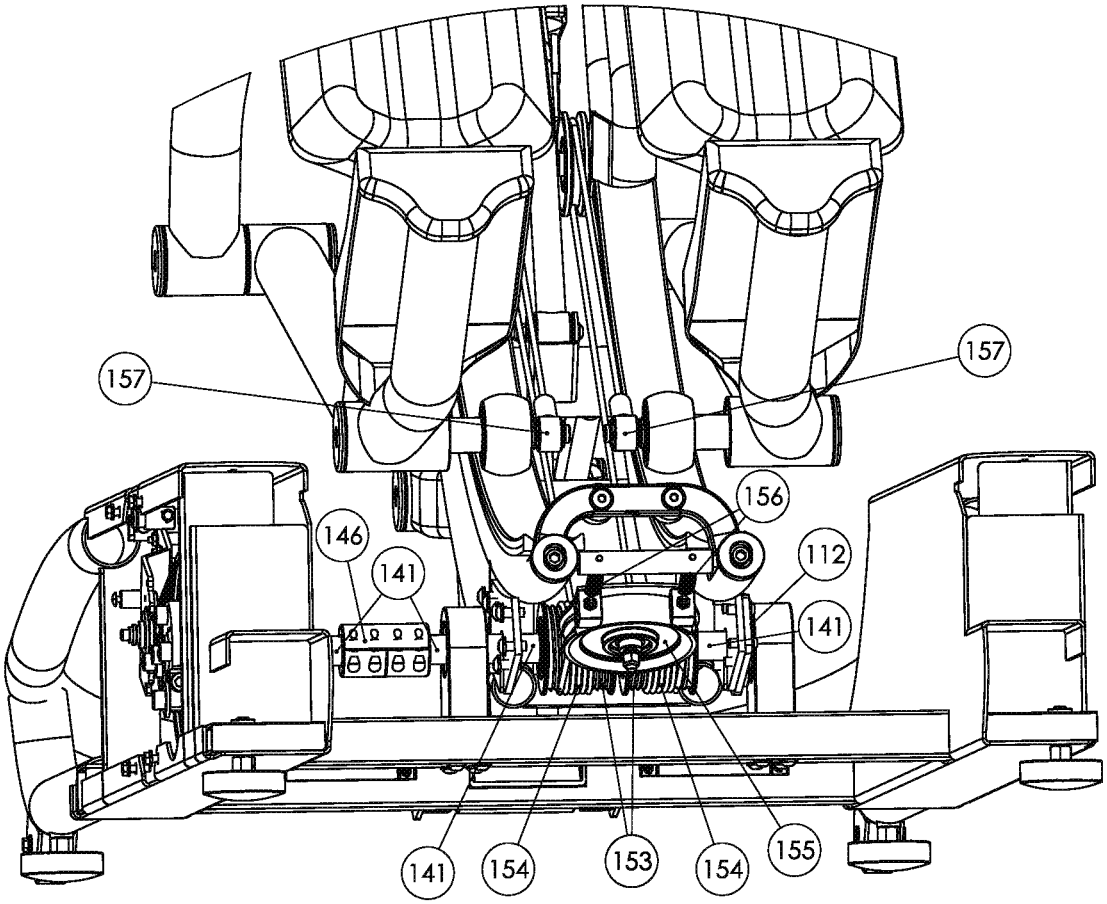
FIG. 20 is a closeup view of the lower rear section of the invention with an electrical angle adjustment mechanism.
Figure 21:
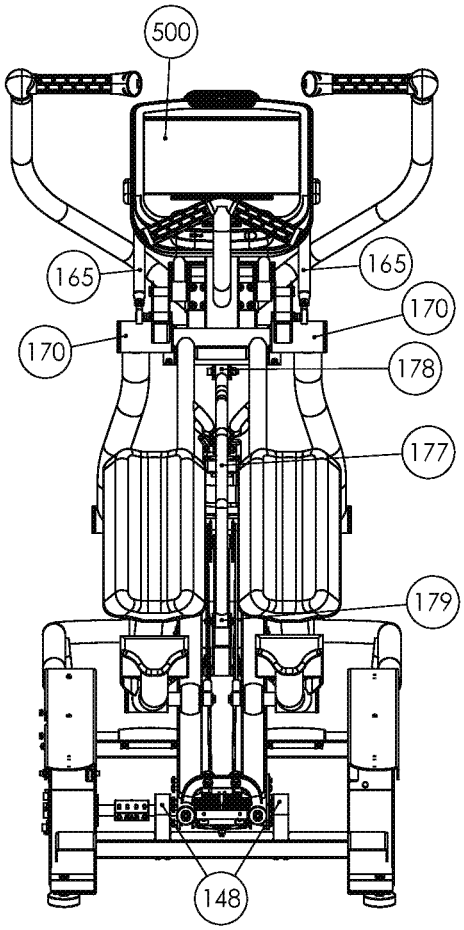
FIG. 21 is a rear view of the invention with an electrical angle adjustment mechanism.
Figure 22:
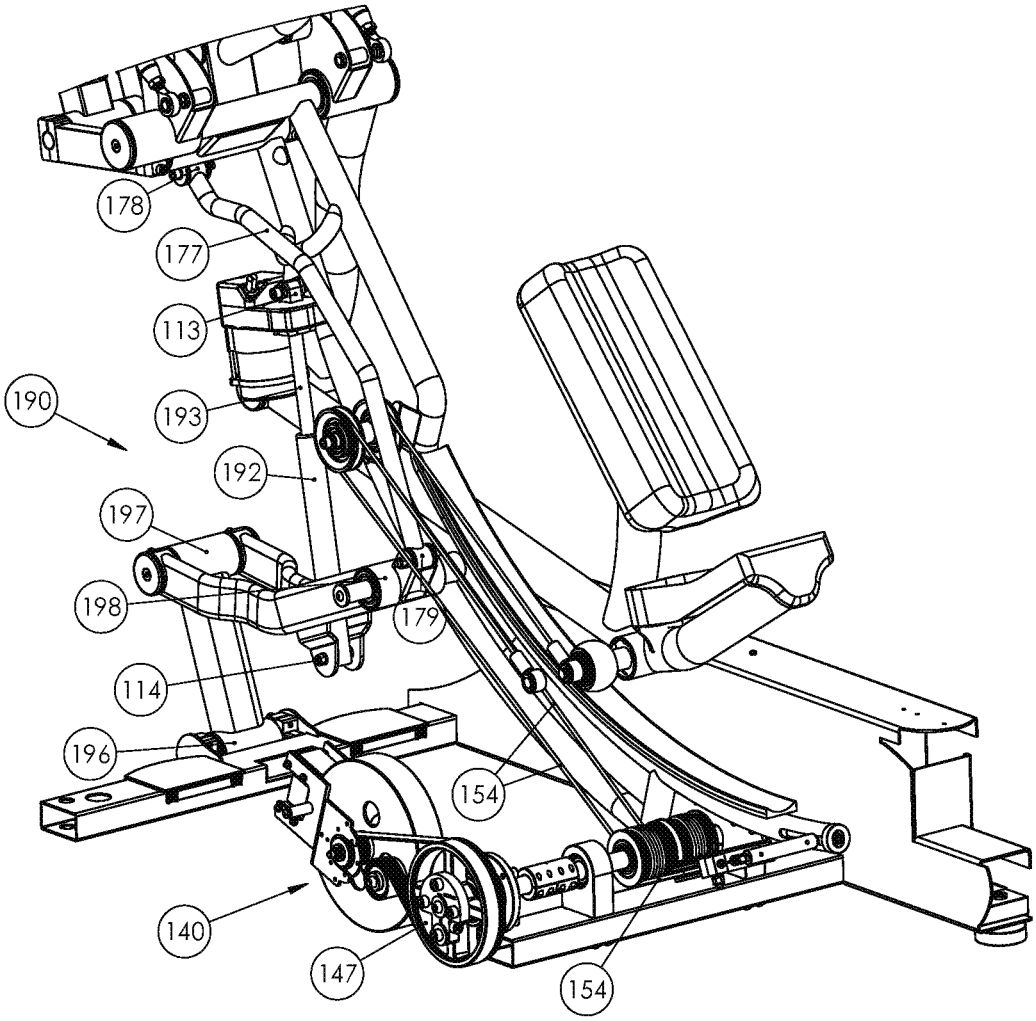
FIG. 22 is a left side perspective view of the invention at a mid-angle position with an electrical angle adjustment mechanism.
Figure 23:
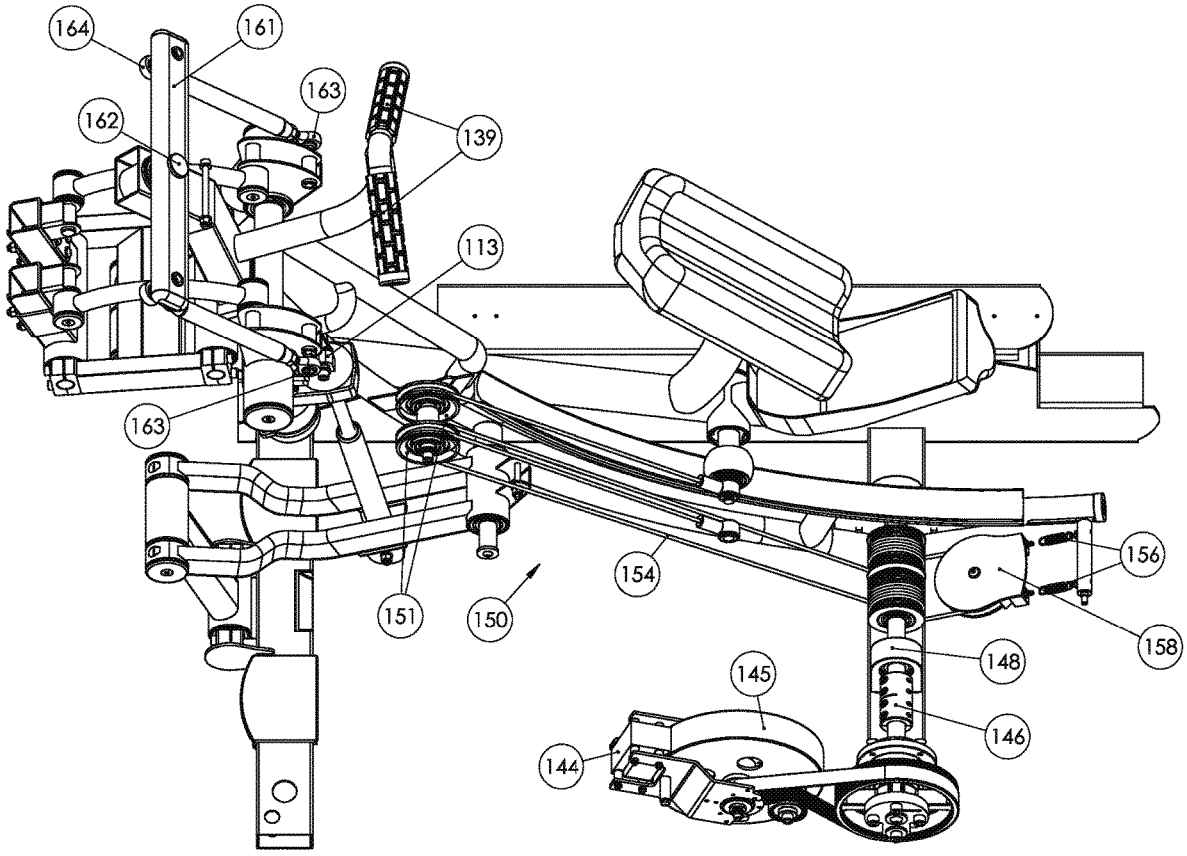
FIG. 23 is an elevated left side perspective view of the invention at a mid-angle position with an electrical angle adjustment mechanism.
Figure 24:
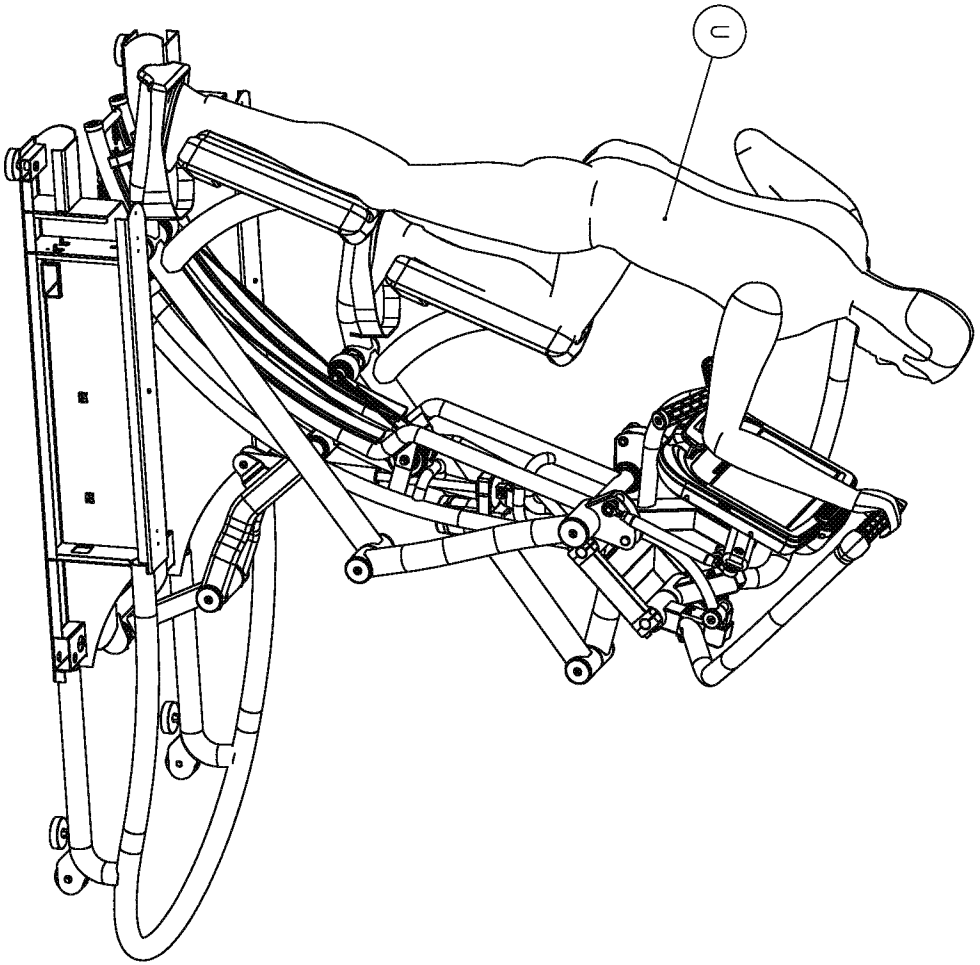
FIG. 24 is a right side view of the invention at a higher angle position with an electric angle adjusting mechanism and a user operating the machine.
Figure 25:
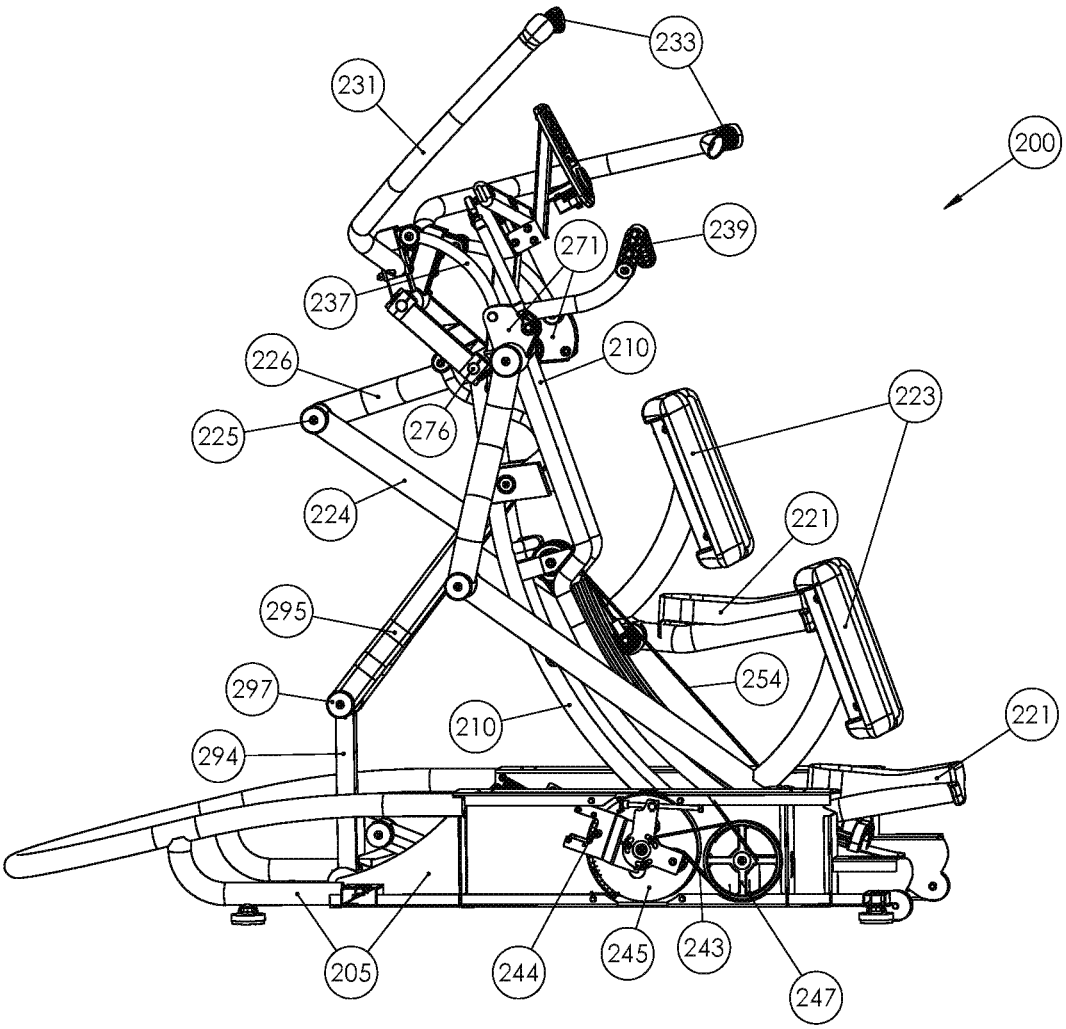
FIG. 25 is a left side view of the invention at a higher angle position with a manual gear drive angle adjustment mechanism.
Figure 26:
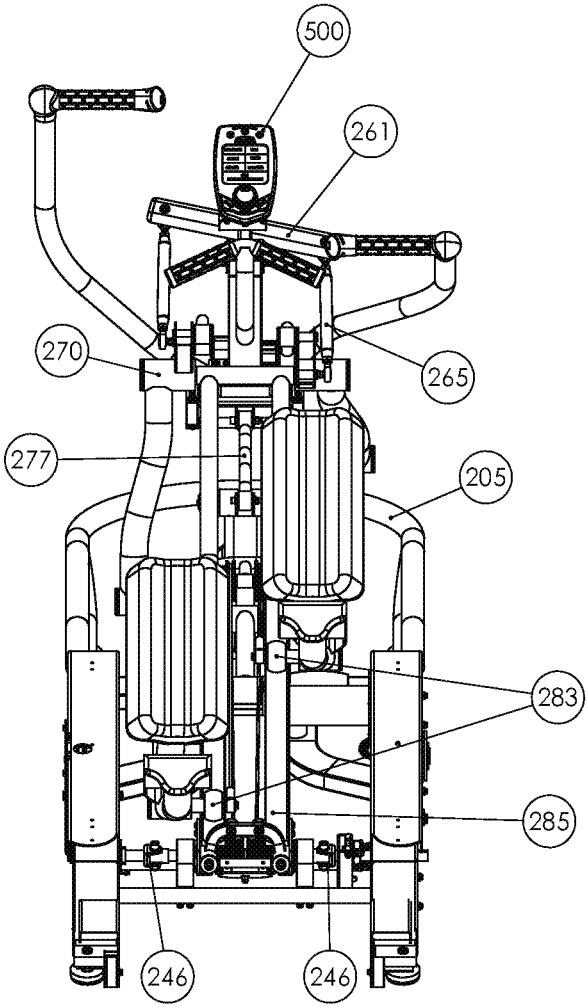
FIG. 26 is a rear view of the invention with a manual gear drive angle adjustment mechanism.

Resistance drive assembly 150 or 250 is best illustrated in FIGS. 20, 22, and 23 and described in detail as follows:

A resistance drive cable 154 or 254 is pivotably connected at a first end to the axle of left side lower body user support wheel 183 or 283 with resistance drive cable connector 157 or 257. Resistance drive cable 154 or 254 then extends forwardly along movable user support frame 110 or 210 at a left side higher elevation and continues over and around a vertically oriented left side resistance drive cable guide pulley 151 or 251 located forward of left side lower body user support wheel track 183 or 283. Resistance drive cable 154 or 254 then returns rearwardly along movable user support frame 110 or 210 at a left side lower elevation and continues under left side one-way clutch resistance drive cable spool 153 or 253 and resistance drive cable 154 or 254 has multiple side by side wraps around left side one-way clutch resistance drive cable spool 153 or 253. Resistance drive cable 154 or 254 then continues rearwardly from under left side one-way clutch resistance drive cable spool 153 or 253. Resistance drive cable 154 or 254 then wraps around a horizontally oriented resistance drive cable tensioner pulley 155 or 255 and returns forwardly and underneath a right side one-way clutch resistance drive cable spool 153 or 253. Resistance drive cable 154 or 254 has multiple side by side wraps around right side one-way clutch resistance drive cable spool 153 or 253 and continues forwardly from under right side one-way clutch resistance drive cable spool 153 or 253 along movable user support frame 110 or 210 at a right side lower elevation. Resistance drive cable 154 or 254 then wraps around a vertically oriented right side resistance drive cable guide pulley 151 or 251 located forward of right side lower body user support wheel track 183 or 283 and returns rearwardly along movable user support frame 110 or 210 at a right side higher elevation. The second end of resistance drive cable 154 or 254 pivotally connects to the axle of right side lower body user support wheel 183 or 283 with resistance drive cable connector 157 or 257 such that resistance drive assembly 150 or 250 transfers the pushing and pulling force exerted by the user from the upper and lower body user supports to the resistance assembly 140.

As lower body user support wheels 183 or 283 roll back and forth on lower body user support tracks 185 or 285 during operation of machine 100, 200, or 300, various sections of resistance drive cable 154 or 254 wrap onto and off of one-way clutch resistance drive cable spools 153 or 253. The multiple wraps of resistance drive cable 154 or 254 on left and right one-way clutch resistance drive cable spools 153 or 253 creates adequate gripping traction of resistance drive cable 154 or 254 on one-way clutch resistance drive cable spools 153 or 253 to prevent resistance drive cable 154 or 254 from slipping on one-way clutch resistance drive cable spools 153 or 253 during operation of machines 100, 200, or 300. Resistance drive cable tensioner pulley 155 or 255 is mounted in resistance drive cable tensioner pulley housing 158 or 258 and suspended between one-way clutch resistance drive cable spools 153 or 253 and the rearward end of movable user support frame 110 or 210 with adequate tension to keep resistance drive cable 154 or 254 taut during operation of machines 100, 200, and 300. Resistance drive cable tensioner pulley 155 or 255 is tensioned by left and right resistance drive cable tensioner pulley springs 156 or 256 wherein the first ends of resistance drive cable tensioner pulley springs 156 or 256 are connected to resistance drive cable tensioner pulley housing 158 or 258 and the second ends of resistance drive cable tensioner pulley springs 156 or 256 are connected to the rearward end of movable user support frame 110 or 210.

During operation of machines 100, 200, and 300, left and right one-way clutch resistance drive cable spools 153 or 253 reciprocally engage and disengage resistance drive axle 141 or 241 such that one of the one-way clutch resistance drive cable spools 153 or 253 is engaged with drive axle 141 or 241 while the other one-way clutch resistance drive cable spools 153 or 253 is disengaged with drive axle 141 or 241. Each time the user changes the direction of motion of the user supports, one of the one-way clutch resistance drive cable spools 153 or 253 instantly engages with drive axle 141 or 241 while the other one-way clutch resistance drive cable spools 153 or 253 instantly disengages from drive axle 141 or 241.

The central portion of resistance drive axle 141 or 241 is mounted on stationary base frame 105 or 205 with left and right resistance drive axle bearings 148 or 248. Movable user support frame 110 or 210 is pivotably mounted on the central portion of resistance drive axle 141 or 241 but pivots independently of resistance drive axle 141 or 241 on left and right movable user support frame base pivots 112 and 212. The left side of resistance drive 141 or 241 and the central portion of resistance drive axle 141 or 241 are operatively and rigidly connected with resistance drive axle coupling 146 to allow for ease of assembly of machines 100, 200, and 300.

Machines 100, 200, and 300 illustrate resistance assembly 140 or 240 being located on the left side of the stationary base frame 105 or 205, however resistance assembly 140 or 240 could be placed on either the left or right side of the stationary base frame 105 or 205 and other features and components located on the right side of stationary base frame 105 or 205 disclosed in the illustrations and descriptions herein can be placed on the opposite side of the stationary base frame 105 or 205.

Figure 16:
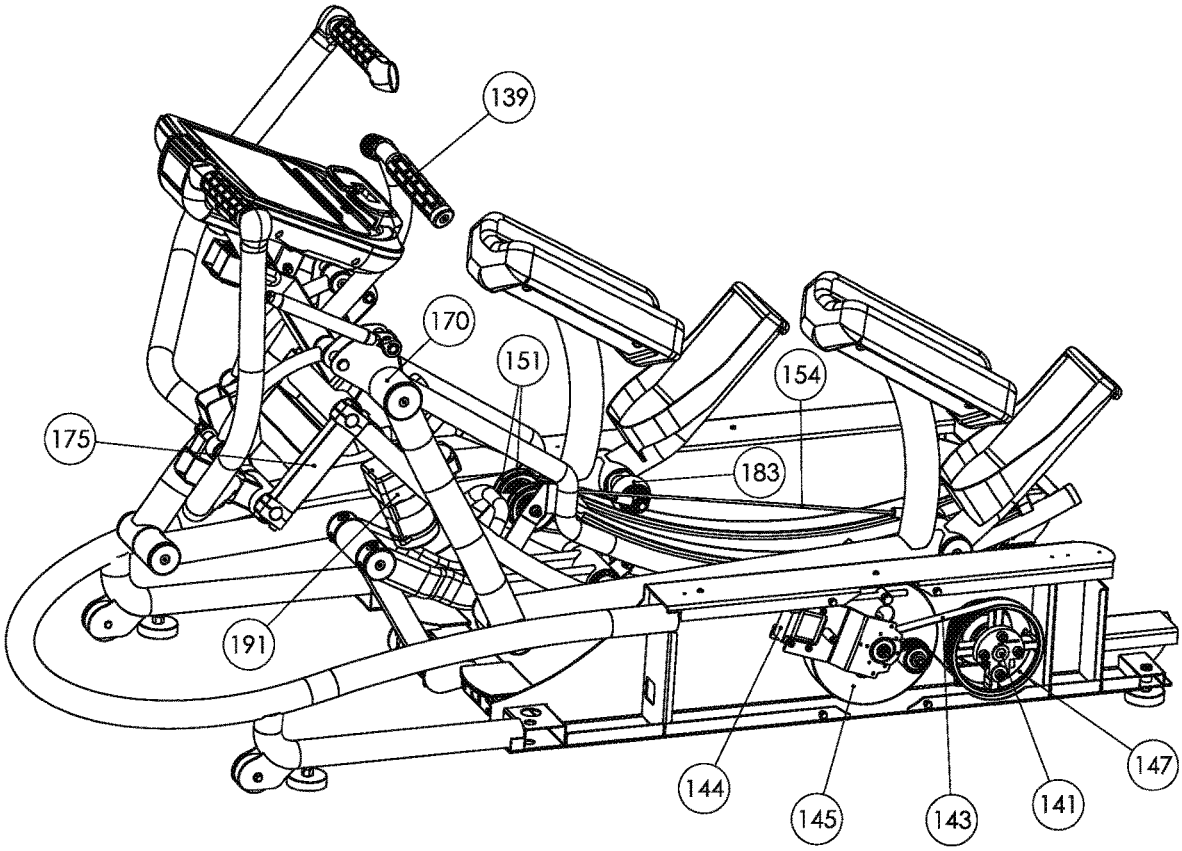
FIG. 16 is a left side perspective view of the invention at a lower angle position with an electrical angle adjustment mechanism.

Resistance assembly 140 or 240 is best illustrated in FIGS. 16, 22, and 23 and described in detail as follows:

Resistance drive pulley 147 or 247 is rigidly mounted on resistance drive axle 141 or 241. Resistance drive pulley 147 or 247 which transfers the rotational force from resistance drive axle 141 or 241 with resistance flywheel belt 143 or 243 to resistance flywheel 145 or 245. Resistance flywheel resistance magnet 144 or 244 creates an adjustable braking resistance to the rotation of resistance flywheel 145 or 245 to increase or decrease the amount of force required by user U to rotate resistance flywheel 145 or 245. However, other components or devices or combination of component or devices can also be utilized with the invention to create an adjustable braking resistance to resistance flywheel 145 or 245 including but not limited to fan blades, friction brakes, electric brake motors, and liquid resistance such as a paddle wheel rotating in liquid. Resistance flywheel 145 or 245 is illustrated as rotating on its own separate axle from resistance axle 141 or 241 which is configured to reduce the effort required by the user U to generate higher revolutions per minute of flywheel 145 or 245 in order to create a lower starting resistance to the exercise motion and a greater range of achievable resistance to the exercise motion, however resistance flywheel 145 or 245 could be mounted rigidly to resistance axle 141 or 241 and achieve a braking resistance to exercise motion of machines 100, 200, or 300.

As illustrated in FIGS. 15-40 and described herein when user U mounts machine 100, 200, or 300 and begins urging any or all of the user supports into their respective reciprocating motions, left and right foot platforms 121 or 221 and left and right shin pads 123 or 223 transfer the force generated by user U's legs into left and right first lower body user support linkage bars 124 or 224 and left and right second lower body user support linkage bars 126 or 226 which transfer the force into left and right linkages connections hubs 170 and 270. Concurrently with this motion, left and right upper body user support grips handles 133 or 233 transfer the force generated by user U's hands and arms into left and right upper body user support lever arms 131 or 231, which transfer the force into left and right upper body user support linkage bars 137 or 237, which transfer the force into left and right linkages connection hub flanges 171 or 271 such that the urging force generated by user U into the left side upper and lower body user supports is operatively and dependently connected and the urging force generated by user U into the right side upper and lower body user supports is operatively and dependently connected.

The urging force generate by user U into the dependently connected left side upper and lower body user supports is operatively connected from left side linkages connection hub 170 or 270 to the left side of rocker arm 161 or 261 with a rocker arm linkage bar 165 or 265 and the urging force generate by user U into the dependently connected right side upper and lower body user supports is operatively connected from left side linkages connection hub 170 or 270 to the right side of rocker arm 161 or 261 with a rocker arm linkage bar 165 or 265 such that the urging force generated by user U into any of the upper or lower body user supports is synchronized and transferred between all four user supports such that all four user supports are operatively and dependently connected to transfer a single force into the resistance system of machine 100, 200, or 300.

The collective force urged into the user supports of the invention by user U can be transferred to the one directional resistance system with various resistance drive assemblies operatively connected to any or all of the upper or lower body user supports. In the embodiments illustrated in FIGS. 15-40, when user U urges any of the dependently connected user supports as described herein, a singular resistance drive cable 154 or 254 pivotably connected at each end to the axles of left and right lower body user support wheels 183 or 283 reciprocally rotates left and right one-way clutch resistance drive cable spools 153 or 253 transferring the force to resistance drive axle 141 or 241 causing it to rotate in one direction, which transfers the force by causing rotation of resistance flywheel drive pulley 147 or 247, which transfers the force by causing movement of resistance flywheel drive belt 143 or 243, which transfers the force by rotating resistance flywheel 145 or 245. A resistance to the urging force required by user U to rotate resistance flywheel 145 or 245 is generated by a resistance flywheel resistance magnet 144 or 244. The resistance force generated by resistance flywheel resistance magnet 144 or 244 is adjustable by user U.

Referring to FIGS. 15-24, machine 100 is an embodiment of the invention with an electrical angle adjustment wherein user U can activate angle adjustment assembly 190 to adjust the angle of movable user support frame 110 with controls located on the exercise information console 500 or other locations on the movable user support frame 110 that are conveniently accessible by user U.

Figure 17:
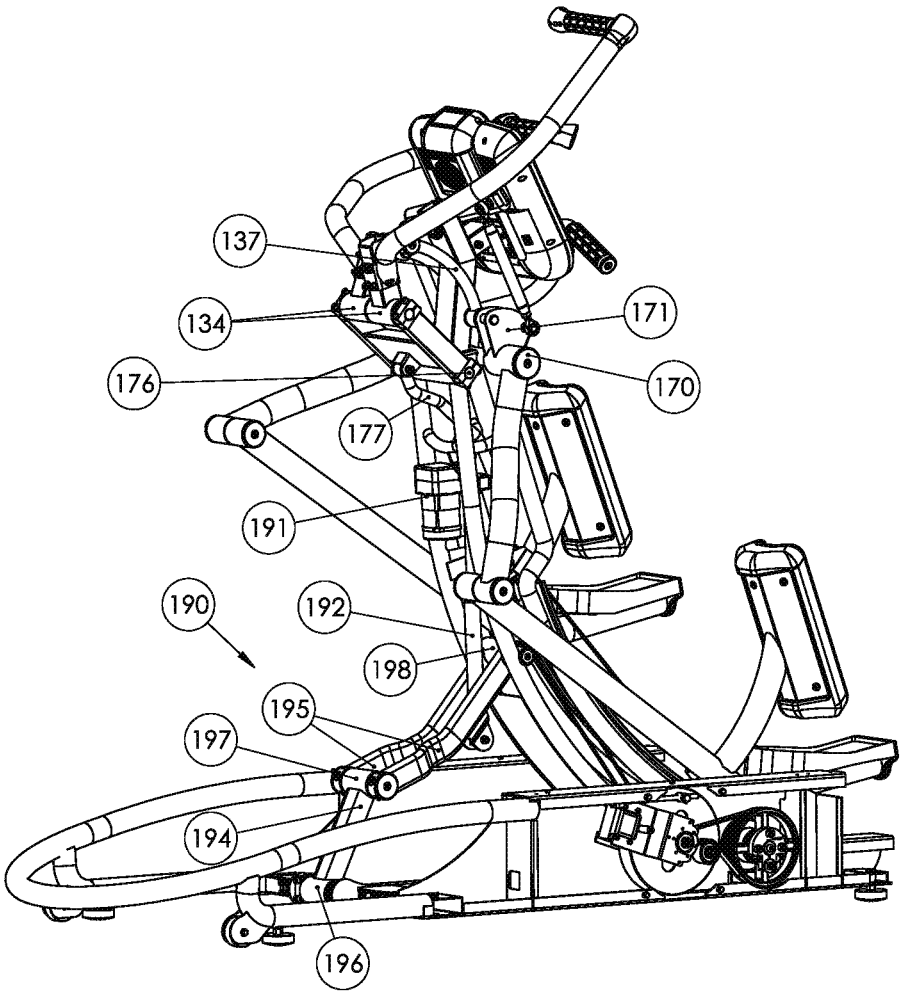
FIG. 17 is a left side perspective view of the invention at a higher angle position with an electrical angle adjustment mechanism.
Figure 18:
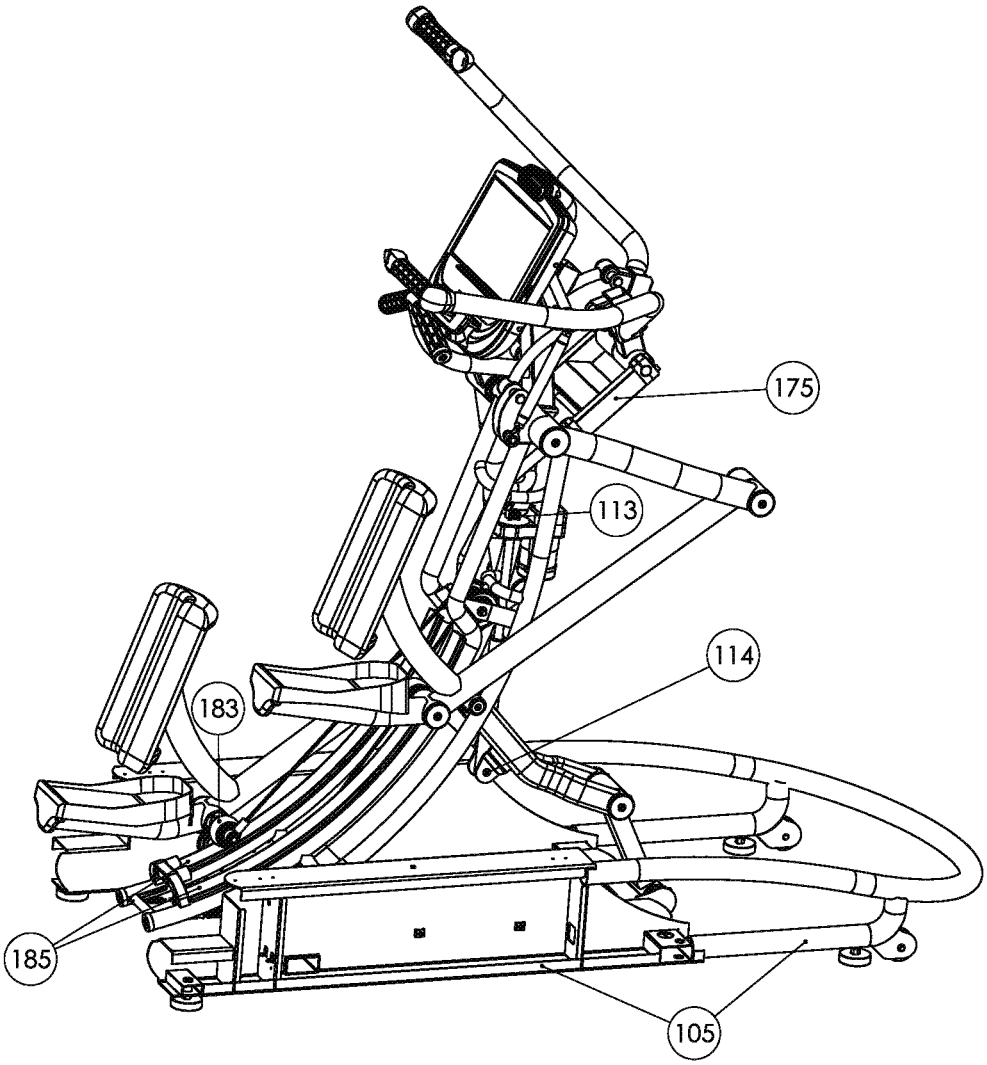
FIG. 18 is a right side perspective view of the invention at a higher angle position with an electrical angle adjustment mechanism.

Angle adjustment assembly 190 is best illustrated in FIGS. 17 and 22 and described in detail as follows:

Angle adjustment actuator 191 which rotates angle adjustment actuator inner shaft 193 in a first direction to rotate it down into angle adjustment actuator outer tube 192 and rotates angle adjustment actuator inner shaft 193 in a second direction to rotate it out of angle adjustment actuator outer tube 192. First angle adjustment linkage bar 194 is pivotably connected at a first end to a central or forward portion of stationary base frame 105 with angle adjustment linkage lower pivot 196 and pivotably connected at a second end to a first end of second angle adjustment linkage bar 195 with angle adjustment linkage mid pivot 197 and a second end of second angle adjustment linkage bar 195 is pivotably connected to a central portion of movable user support frame 110 with angle adjustment linkage upper pivot 198. Angle adjustment actuator 191 is connected to an upper and forward portion of movable user support frame 110 with angle adjustment actuator upper pivot 113 and angle adjustment actuator outer tube 192 is connected to a central portion of second angle adjustment link bars 195 with angle adjustment actuator lower pivot 114.

When angle adjustment assembly 190 is activated to move movable user support frame 110 from a higher angle position to a lower angle position, angle adjustment actuator 191 rotates angle adjustment actuator inner shaft 193 in a first direction, which rotates angle adjustment actuator inner shaft 193 into angle adjustment actuator outer tube 192, which reduces the distance between angle adjustment actuator upper pivot 133 and angle adjustment actuator lower pivot 114. This causes first angle adjustment linkage bar 194 to pivot about angle adjustment linkage lower pivot 196 and second angle adjustment linkage bars 195 to pivot about angle adjustment linkage upper pivot 198 such that angle adjustment linkage mid pivot 197 moves towards the front of stationary base frame 105 and angle adjustment linkage upper pivot moves downward. When angle adjustment assembly 190 is activated to move movable user support frame 110 from a lower angle position to a higher angle position, angle adjustment actuator 191 rotates angle adjustment actuator inner shaft 193 in an opposite second direction, which rotates angle adjustment actuator inner shaft 193 out of angle adjustment actuator outer tube 192, which increases the distance between angle adjustment actuator upper pivot 133 and angle adjustment actuator lower pivot 114. This causes first angle adjustment linkage bar 194 to pivot about angle adjustment linkage lower pivot 196 and second angle adjustment linkage bars 195 to pivot about angle adjustment linkage upper pivot 198 such that angle adjustment linkage mid pivot 197 moves towards the rear of stationary base frame 105 and angle adjustment linkage upper pivot 198 moves upward.

Referring to FIGS. 25-36, machine 200 is an embodiment of the invention with a manual gear drive angle adjustment wherein user U's exercise motion on machine 200 activates manual gear drive angle adjusting assembly 215, which activates angle adjustment drive assembly 201, which activates angle adjustment assembly 290 to adjust the angle of movable user support frame 210. Machine 200 also comprises a clutch assembly 280 that can engage with or disengage from manual gear drive angle adjusting assembly 215. During operation of machine 200 angle manual gear drive angle adjusting assembly 215, angle adjustment drive assembly 201, and angle adjustment assembly 290 are constantly activated when clutch 289 is engaged, and during operation of machine 200 manual gear drive angle adjusting assembly 215, angle adjustment drive assembly 201 and angle adjustment assembly 290 are not activated when clutch 289 is disengaged.

Figure 27:
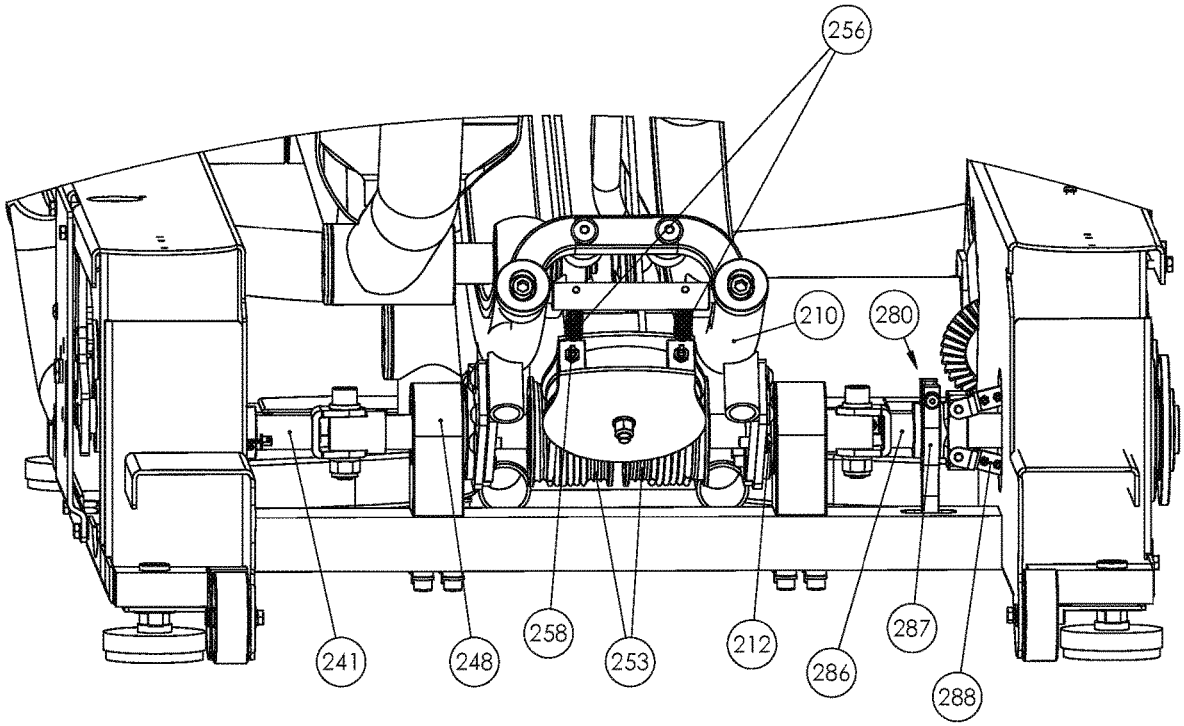
FIG. 27 is a close up view of the lower rear section of the invention with a manual gear drive angle adjustment mechanism.
Figure 28:
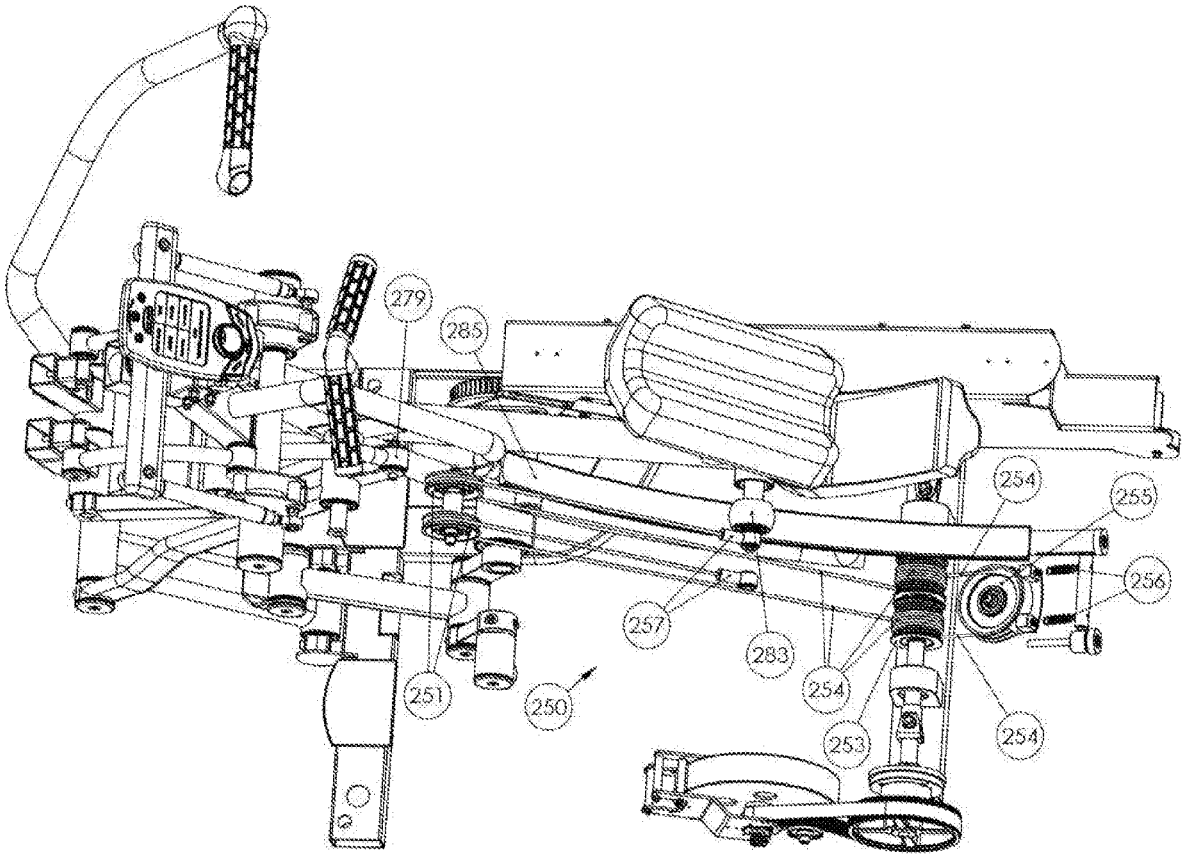
FIG. 28 is a left side overhead view of the invention with a manual gear drive angle adjustment mechanism.
Figure 29:
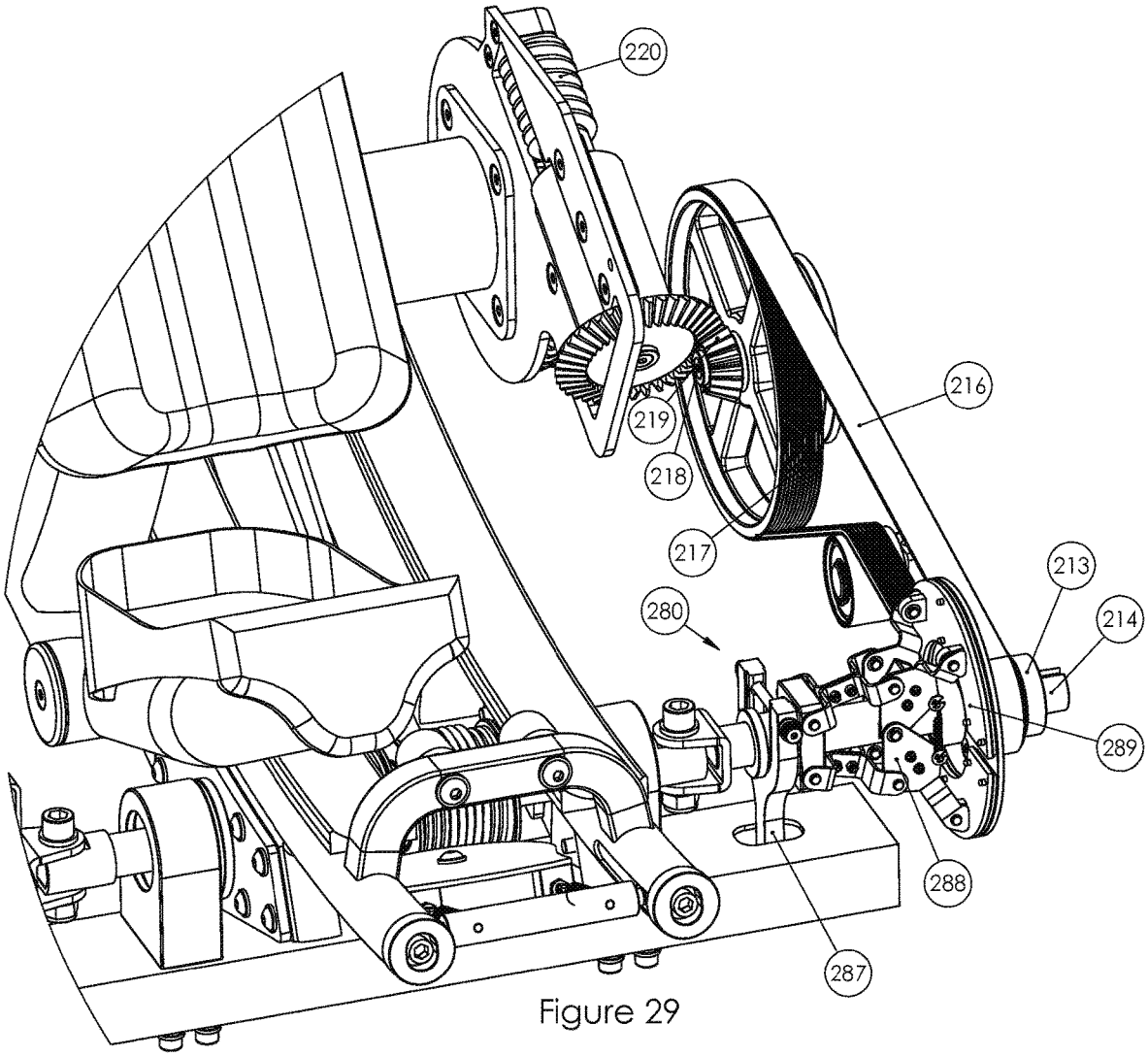
FIG. 29 is a close up view of the lower center and right side sections of the invention with a manual gear drive angle adjustment mechanism.

Clutch assembly 280 is best illustrated in FIGS. 27 and 29 and described in detail as follows:

A first end of a clutch drive axle 286 is operatively coupled to resistance drive axle 241 with a right side resistance drive axle coupling 246 and operatively aligned at a second end with first gear drive axle 214. A first portion of clutch engagement linkage assembly 288 is pivotably mounted to a central portion of clutch drive axle 286 and a second portion of clutch engagement linkage assembly 288 is operatively engaged with clutch engagement fork 287 to slide on clutch drive axle 286 such that clutch engagement fork 287 can pivot the first portion of clutch engagement linkage assembly 288 to engage or disengage a clutch 289. Clutch engagement fork 289 is controlled by clutch engagement switch 291. Clutch 289 can be operatively engaged with or disengaged from manual gear drive assembly 215 with first gear drive pulley 213 and first gear drive axle 214.

Figure 30:
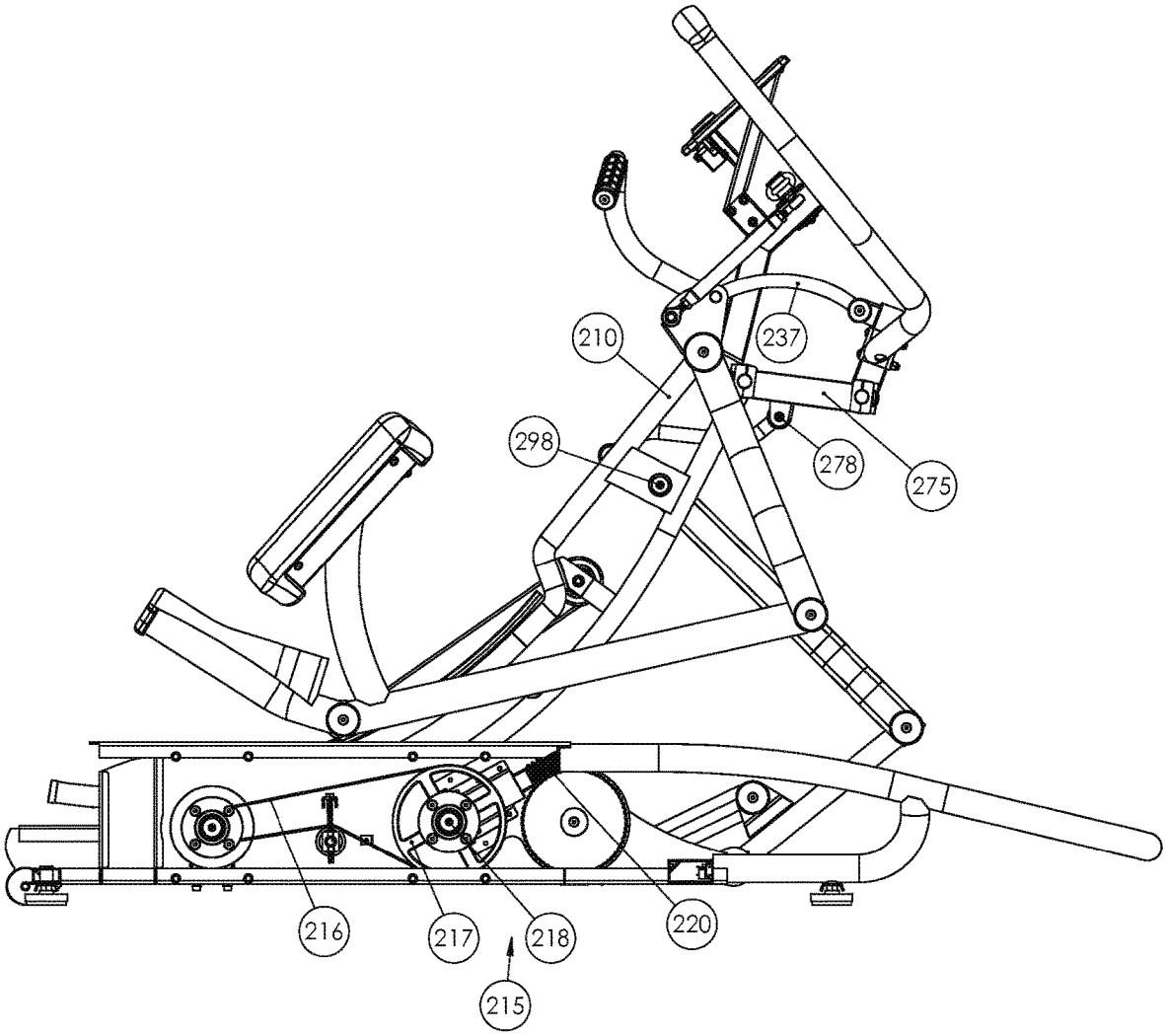
FIG. 30 is a right side view of the invention at a mid-angle position with a manual gear drive angle adjustment mechanism.
Figure 32:
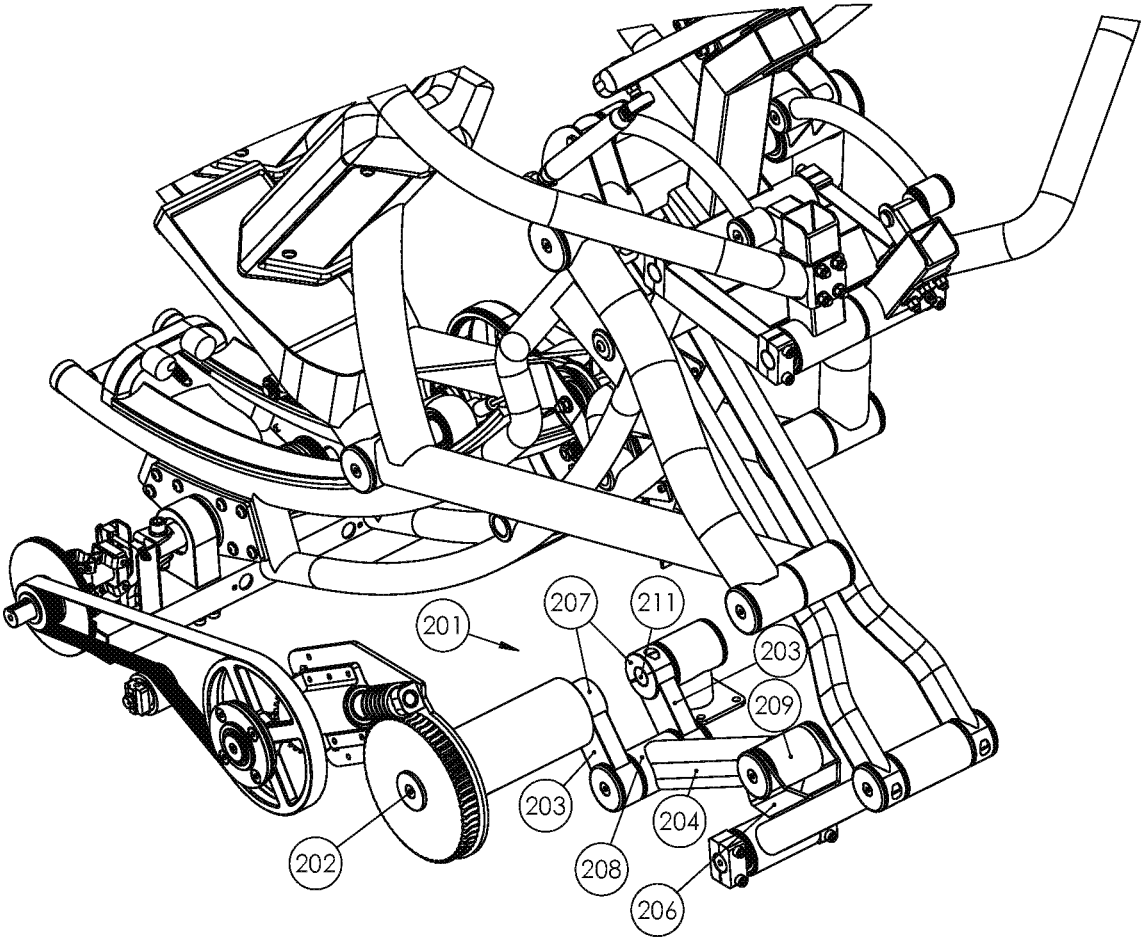
FIG. 32 is a close-up front view of the central and right side of the invention with a manual gear drive adjustment mechanism.

Manual gear drive assembly 215 is best illustrated in FIGS. 29, 30, and 32 and described in detail as follows:

A first gear drive axle 214 is operatively aligned with clutch drive axle 286 but rotates independently of clutch drive axle 286. A first gear pulley 213 is rigidly mounted on first gear drive axle 214 such that first gear pulley 213 and first gear drive axle 214 rotate together. Gear drive pulley belt 216 operatively connects first gear pulley 213 to a second gear pulley 217. Second gear pulley 217 is rigidly connected to second gear drive axle 218, second gear drive axle 218 is operatively engaged with first drive gears 219, first drive gears 219 are operatively engaged with second drive gears 220, and second drive gears 220 are operatively engaged with angle adjusting drive axle 202. In this embodiment of the invention, first drive gears 219 are represented as a bevel gearing assembly and second drive gears 220 are represented as a worm gear assembly, however various gearing assemblies including pulleys with flexible drive components gearing assemblies could be used to drive the angle adjusting system of machine 200 and achieve the same or very similar operation of machine 200.

Angle adjusting drive assembly 201 is best illustrated in FIG. 32 and described in detail as follows:

Angle adjusting drive axle 202 is rigidly connected to a right side angle adjusting drive assembly first pivot 207 and a left side angle adjusting drive first pivot 207 is rigidly connected to angle adjusting drive guide axle 211. Left and right first angle adjusting drive link bars 203 rotate at a first end on angle adjusting drive first pivots 207. A second end of left and right angle adjusting drive linkage bars 203 are rotatably connected to a first end of second angle adjusting drive linkage bar 204 with angle adjusting drive second pivot 208. A second end of second angle adjusting drive linkage bar 204 is pivotably connected to second angle adjusting drive linkage bar connection flange 206 with angle adjusting drive third pivot 209. A second angle adjusting drive linkage bar connection flange 206 is rigidly connected to a lower central portion of first angle adjustment linkage bar 294.

Figure 31:
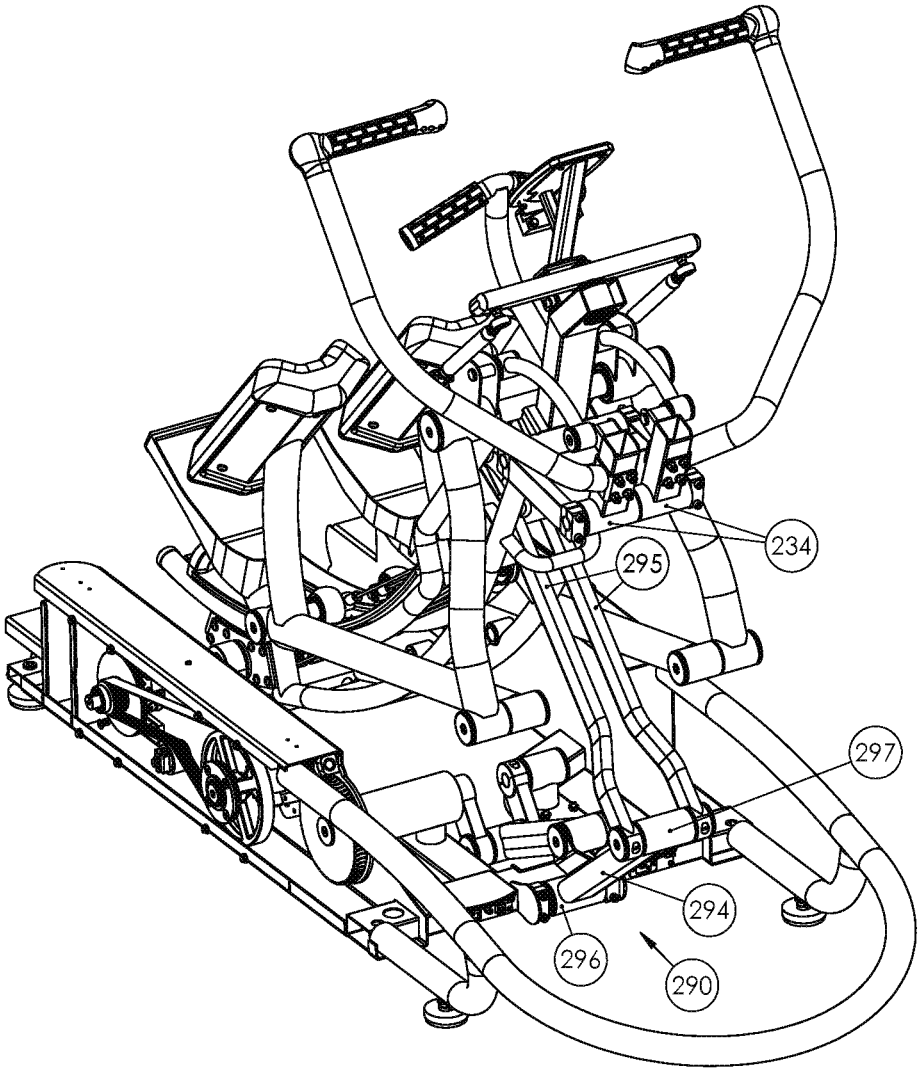
FIG. 31 is a front perspective view of the right side of the invention in a mid-angle position with a manual gear drive adjustment mechanism.

Angle adjustment assembly 290 is best illustrated in FIG. 31 and described in detail as follows:

A first end of first angle adjustment linkage bar 294 is pivotably connected to stationary base frame 205 with angle adjustment linkage lower pivot 296. A second end of first angle adjustment linkage bar 294 is pivotably connected to first ends of left and right second angle adjustment linkage bars 295 with angle adjustment linkage mid pivot 297, and second ends of left and right second linkage bars 295 are pivotably connected to movable user support frame 210 at angle adjustment linkage upper pivot 298.

When user U urges upper body user support grip handles 233 and or foot platforms 221 to activate machine 200, the resistance drive assembly 250 engages and rotates resistance axle 241 as previously described herein. This causes the left side of resistance drive axle 241 to operatively engage resistance assembly 240 as previously described herein and concurrently the right side of resistance drive axle 241 is operatively connected to and rotates clutch drive axle 286. If clutch engagement switch 291 has clutch engagement fork 287 located in the disengaged position such that clutch linkage assembly 288 and clutch 289 are not operatively engaged with manual gear drive assembly 215 then manual gear drive assembly 215, angle adjustment drive assembly 201, angle adjustment assembly 290, and movable user support frame 210 will remain stationary when machine 200 is being activated by user U.

If clutch engagement switch 291 has clutch engagement fork 287 located in the engaged position when user U is operating machine 200 this causes clutch linkage assembly 288 to move clutch 289 into a position of being operatively engaged with first drive gear pulley 213 and first drive gear axle 214, this causes rotational movement of first gear drive pulley 213 and first drive gear axle 214, which causes movement of gear drive pulley belt 216, which causes rotation of second gear drive pulley 217 and second gear drive axle 218, which causes second gear drive axle 218 to rotate first drive gears 219 and first drive gears 219 cause second drive gears 220 to rotate which causes rotation of angle adjusting drive axle 202. Rotation of angle adjusting drive axle 202 causes rotation of angle adjusting drive first pivots 207, which causes first angle adjusting drive link bars 203 and angle adjusting drive second pivot 208 to orbit around angle adjusting drive axle 202 and angle adjusting drive guide axle 211. This orbital rotation of angle adjusting drive second pivot 208 causes second angle adjusting drive linkage bar 204 to move in a first direction when angle adjusting drive second pivot 208 is moving below a horizontal center line that intersects the center of angle adjusting drive axle 202 and angle adjusting drive guide axle 211 and this orbital rotation of angle adjusting drive second pivot 208 causes second angle adjusting drive linkage bar 204 to move in an opposite second direction when angle adjusting drive second pivot 208 is moving above a horizontal center line that intersects the center of angle adjusting drive axle 202 and angle adjusting drive guide axle 211 such that when angle adjusting drive second pivot 208 is moving in a first direction on one side of a horizontal center line that intersects the center of angle adjusting drive axle 202 and angle adjusting drive guide axle 211, angle adjusting drive second pivot 208 pushes second angle adjusting drive linkage bar 204 forward and when angle adjusting drive second pivot 208 is moving in an opposite second direction on the other side of a horizontal center line that intersects the center of angle adjusting drive axle 202 and angle adjusting drive guide axle 211, angle adjusting drive second pivot 208 pulls second angle adjusting drive linkage bar 204 rearward. The forward movement of second angle adjusting drive linkage bar 204 causes first angle adjustment linkage bar 294 to pivot about angle adjustment linkage lower pivot 296 and second angle adjustment linkage bars 295 to pivot about angle adjustment linkage upper pivot 298 such that angle adjustment linkage mid pivot 297 move towards the front of stationary base frame 105 and angle adjustment linkage upper pivot 298 moves downward such that the angle of movable user support frame 210 moves to a lower angle position. The rearward movement of second angle adjusting drive linkage bar 204 causes first angle adjustment linkage bar 294 to pivot about angle adjustment linkage lower pivot 296 and second angle adjustment linkage bars 295 to pivot about angle adjustment linkage upper pivot 298 such that angle adjustment linkage mid pivot 297 move towards the rear of stationary base frame 205 and angle adjustment linkage upper pivot 298 moves upward such that the angle of movable user support frame 210 moves to a higher angle position.

During operation of machine 200, when clutch assembly 280 is engaged such that manual gear drive assembly 215, angle adjustment drive assembly 201, and angle adjustment assembly 290 are activated, movable user support frame 210 will continually pivot about stationary base frame 205 to move up or down to the limit of the full range of motion in a first direction and then almost immediately move in an opposite second direction to the limit of the full range of motion in the opposite second direction, and continue this reciprocating cycle until either clutch assembly 280 is disengaged from manual gear drive assembly 215 or user U ceases operating machine 200. The total up or down range of motion is limited to less than 90 degrees on one side of a vertical line and above a horizontal line. This perpetual reciprocal pattern of motion of angle change of movable user support frame 210 is achieved with the orbital motion of angle adjustment drive assembly 201.

Referring to FIGS. 37-40, machine 300 is an embodiment of the invention with a manual lever arm angle adjustment assembly 390 for locating and locking the angle of movable user support frame 310, wherein user U manually moves the angle of movable user support 310 to a preferred angle and locks it into position prior to entering and operating machine 300. The exercise motion and resistance drive operation of machine 300 are identical or very similar to those of machines 100 and 200 as previously described herein.

Figure 37:
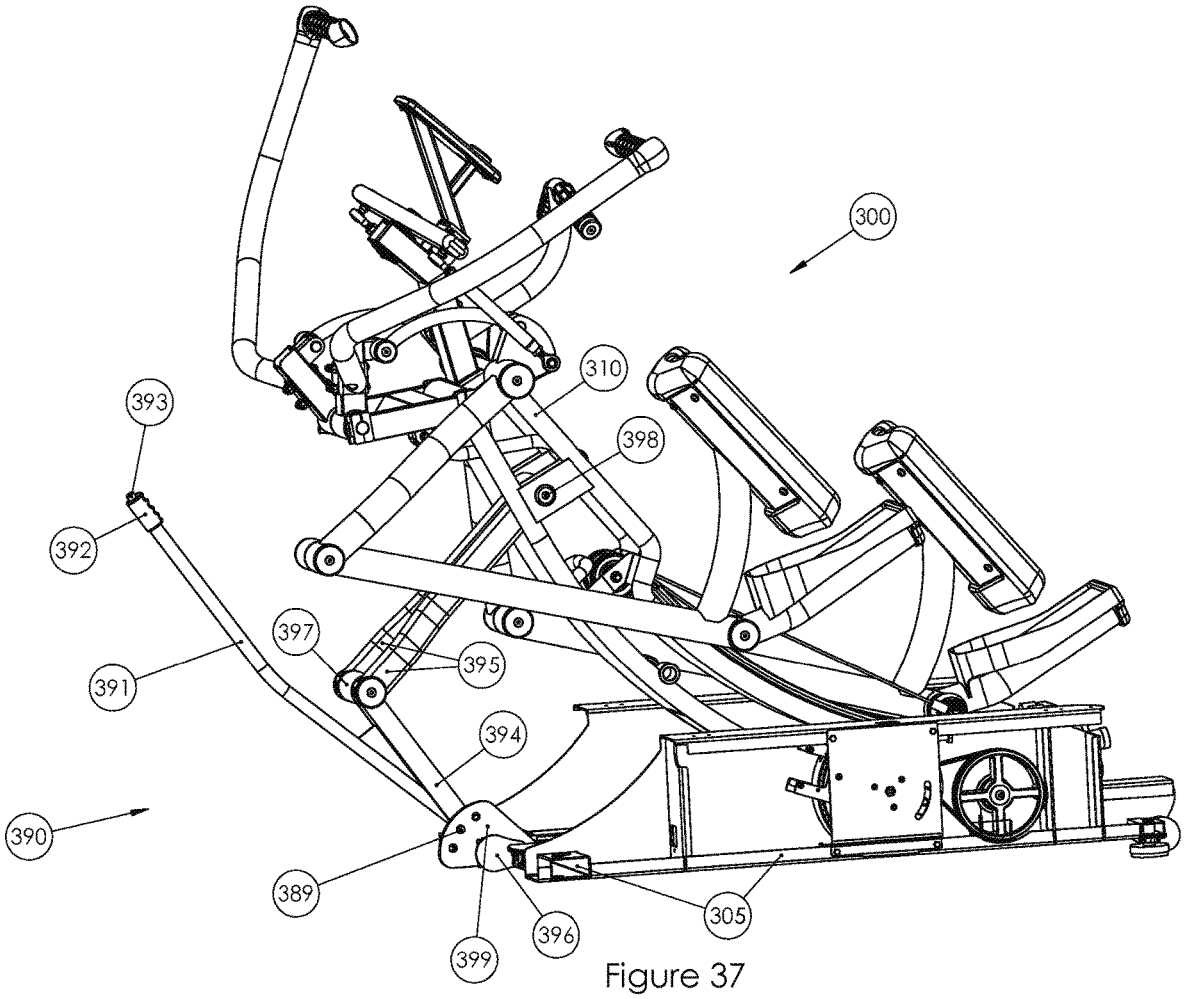
FIG. 37 is a left side view of the invention in a mid-angle position with a manual lever arm angle adjustment mechanism.
Figure 38:
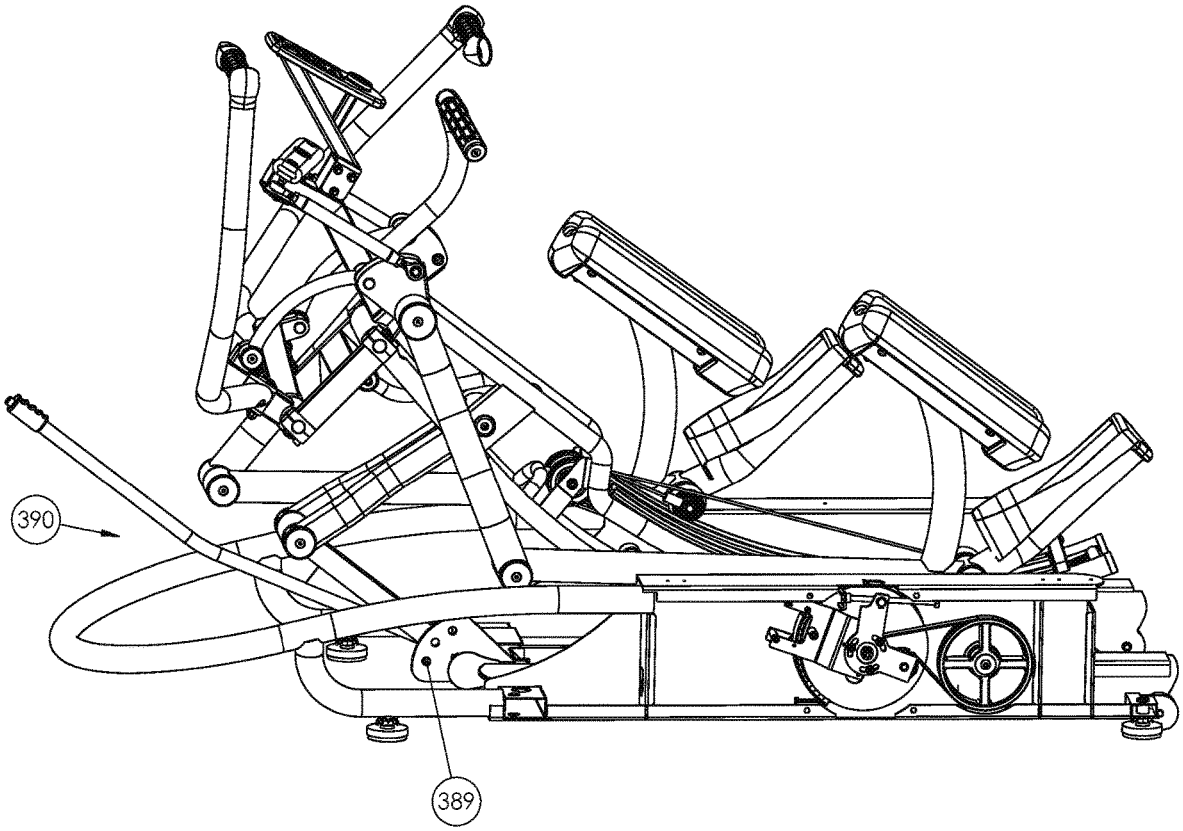
FIG. 38 is a left side view of the invention in a mid-angle position with a manual lever arm angle adjustment mechanism.
Figure 39:
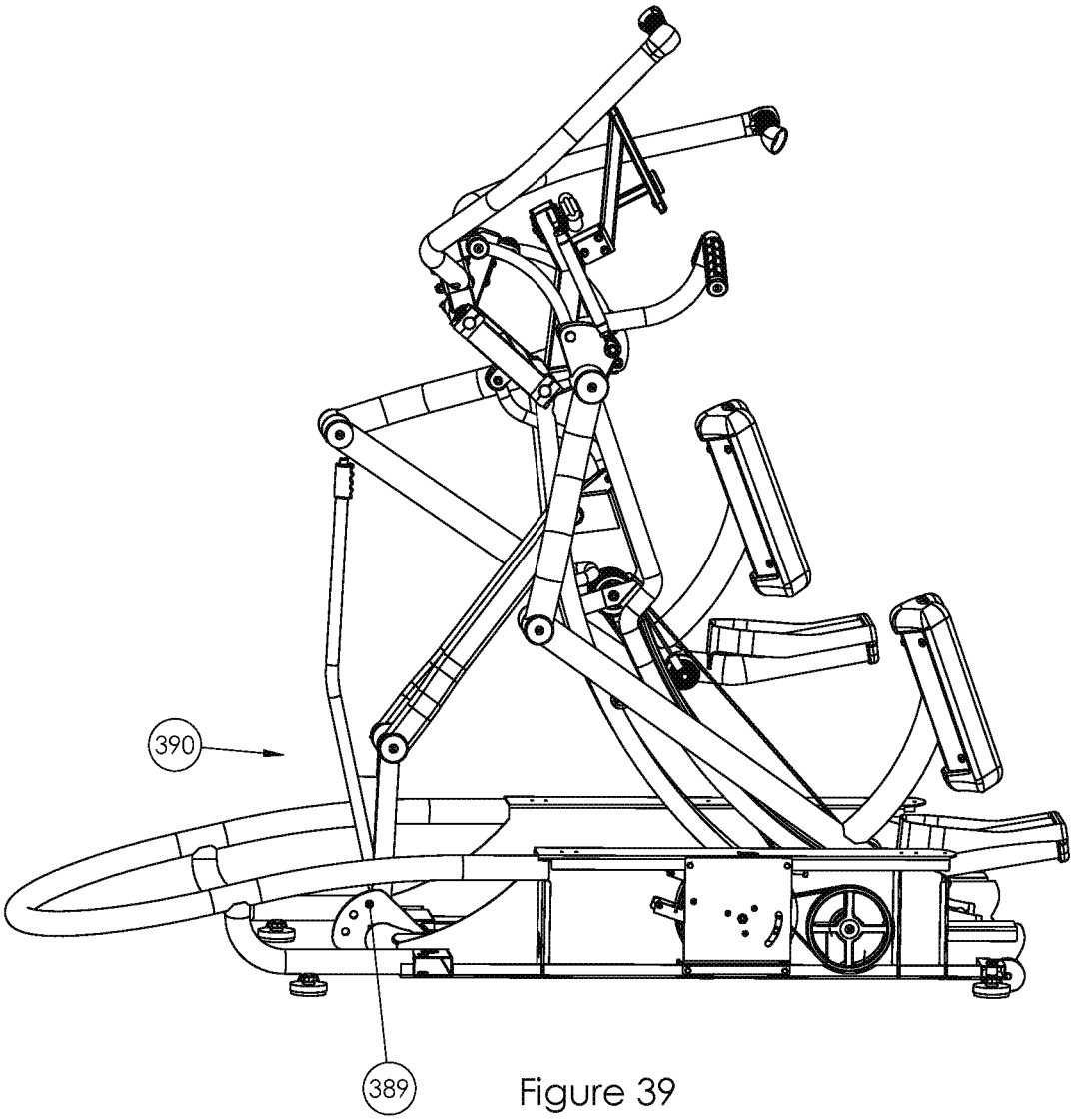
FIG. 39 is a left side view of the invention in a higher angle position with a manual lever arm angle adjustment mechanism.
Figure 40:
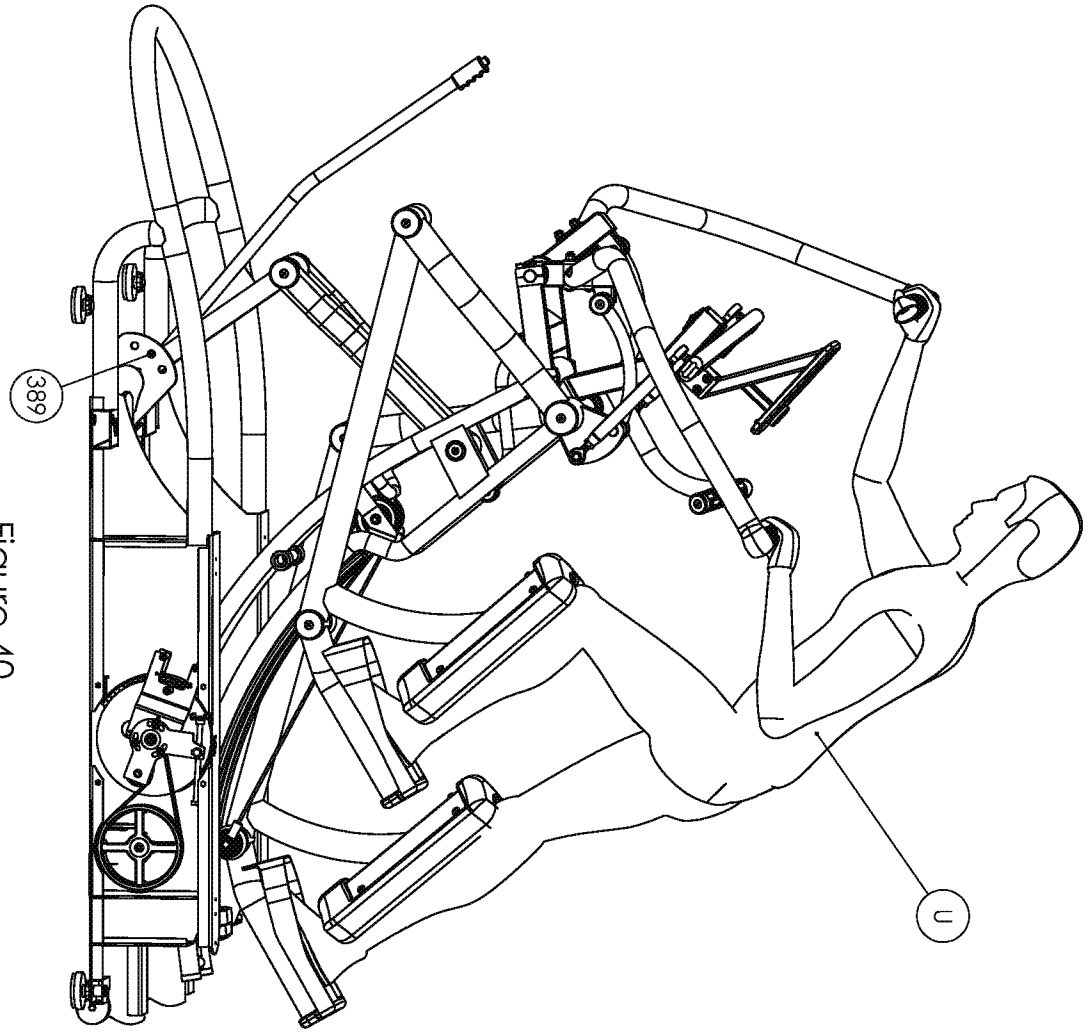
FIG. 40 is a left side view of the invention in a mid-angle position with a manual lever arm angle adjustment mechanism and a user operating the machine.

Manual lever arm angle adjustment assembly 390 is best illustrated in FIG. 37 described in detail as follows:

A first end of first angle adjustment linkage bar 394 is pivotably connected to stationary base frame 305 with angle adjustment linkage lower pivot 396. A second end of first angle adjustment linkage bar 394 is pivotably connected to first ends of left and right second angle adjustment linkage bars 395 with angle adjustment linkage mid pivot 397, and second ends of left and right second linkage bars 395 are pivotably connected to movable user support frame 310 at angle adjustment linkage upper pivot 398. A first end of an elongated angle adjustment lever arm 391 is rigidly connected to first angle adjustment linkage bar 394 such that they move as one. An angle adjustment lever arm hand grip 392 is mounted proximal to a second end of angle adjustment lever arm 391, and an angle adjustment lever arm lock release switch 393 is located in operable proximity to angle adjustment lever arm hand grip 392. An angle adjustment lever arm locking plate 399 with multiple locking holes that are configured in an arcing pattern is rigidly connected to stationary base frame 305 proximal to the first end of angle adjustment linkage bar 394 and an angle adjustment lever arm locking pin assembly 395 is operatively mounted on a first end of first angle adjustment linkage bar 394 such that angle adjustment lever arm locking pin 395 is in operative alignment with the locking holes in angle adjustment lever arm locking plate 399. As illustrated, angle adjustment lever arm locking pin 395 is connected to and moves with first angle adjustment linkage bar 394 and angle adjustment arm locking pin 395 is operatively engaged with angle adjustment lever arm lock release switch 393. An example of this operative locking assembly would be a spring-loaded detent pin that is contracted and extended with a release switch. However, various components and configurations could be used to lock angle adjustment lever arm 391 and first angle adjustment linkage bar 394 into position on angle adjustment lever arm locking plate 399 and achieve the same results of locking manual lever arm angle adjustment assembly 390 and movable user support frame 310 into the preferred exercise position.

To adjust manual angle adjustment assembly 390 to a higher angle position, user U would stand in front of machine 300 and grasp angle adjusting lever arm hand grip 392 and activate angle adjustment lever arm lock release switch 393 to withdraw angle adjustment lever arm locking pin 395 from angle adjustment lever arm locking plate 399 to unlock angle adjustment lever arm 391. User U would next push angle adjusting lever arm 391 rearward, which causes first angle adjustment linkage bar 394 to pivot about angle adjustment linkage lower pivot 396 and second angle adjustment linkage bars 395 to pivot about angle adjustment linkage upper pivot 398 such that angle adjustment linkage mid pivot 397 move towards the rear of stationary base frame 105 and angle adjustment linkage upper pivot 298 moves upward until movable user support frame 310 is at the desired angle position. User U would next release angle adjustment lever arm lock release switch 393 to insert angle adjustment lever arm locking pin 395 into angle adjustment lever arm locking plate 399 to lock angle adjustment lever arm 391 into position.

To adjust manual angle adjustment assembly 390 to a lower angle position, user U would stand in front of machine 300 and grasp angle adjusting lever arm hand grip 392 and activate angle adjustment lever arm lock release switch 393 to withdraw angle adjustment lever arm locking pin 395 from angle adjustment lever arm locking plate 399 to unlock angle adjustment lever arm 391. User U would next pull angle adjusting lever arm 391 forward, which causes first angle adjustment linkage bar 394 to pivot about angle adjustment linkage lower pivot 396 and second angle adjustment linkage bars 395 to pivot about angle adjustment linkage upper pivot 398 such that angle adjustment linkage mid pivot 397 move towards the front of stationary base frame 105 and angle adjustment linkage upper pivot 398 moves downward until movable user support frame 310 is at the desired angle position. User U would next release angle adjustment lever arm lock release switch 393 to insert angle adjustment lever arm locking pin 395 into angle adjustment lever arm locking plate 399 to lock angle adjustment lever arm 391 into position.

User U can operate machines 100, 200, or 300 at multiple forward leaning angles to achieve a variety of concurrent pushing and pulling upper and lower body exercises including simulated ladder climbs, hiking, stair climbing, jogging, sprinting, and bear crawls. Machine 100 allows user U to change the angle of movable user support frame 110 with an electric actuator or other electrical device using controls located on the exercise information console 500 or other locations on machine 100 convenient to user U. Machine 200 does not require electricity to operate and the mechanical features of machine 200 can constantly pivot movable user support frame 210 about stationary base frame 205 to move movable support frame 210 through its full range of reciprocal up and down motion or machine 200 can be operated such that movable user support frame 210 remains at a fixed angle position by disengaging clutch assembly 280 which disengages the mechanical features of machine 200 that cause movable user support frame 210 to move and change angle position. Clutch assembly 280 can be engaged at any time during operation of machine 200 to resume movement and angle change of movable user support frame 210. Machine 300 does not require electricity and has a smaller number of components than machine 100 or 200. Machine 300 requires user U to manually adjust the angle of movable user support 310 and lock it into position with angle adjustment assembly 390 prior to entering and operating machine 300. To change the angle of movable user support 310 after user U has begun exercising, user U must stop exercising and exit machine 300 to manually adjust the angle of movable user support 310 to the new angle of exercise position and then reenter machine 300 to resume exercising.

Now referring to FIGS. 41-68, various views of the embodiments illustrated as machines 400, 600, and 700 are shown to provide a more complete understanding of these embodiments of the invention. The exercise motion of the embodiments of machines 400, 600, and 700 is virtually identical. The three embodiments differ in that machine 400 comprises a stationary base frame 405 but does not comprise a resistance mechanism. Machine 600 comprises a stationary base frame 605 and comprises a reciprocating arcing resistance assembly 640. Machine 700 illustrated in FIG. 66 does not comprise a stationary base frame and does not comprise a resistance mechanism. In FIGS. 67 and 68, machine 700 does not comprise a stationary base frame but does comprise a reciprocating arcing resistance assembly 740. The structural components of machines 400, 600, and 700 may be described as tubes, rods, bars, links, plates, brackets, and other shapes and descriptions. However, similar components can be substituted and achieve the same function of each machine. Various materials can be used to construct the structural components of machines 400, 600, and 700 with metal being the most common.

Machine 400 and one embodiment of machine 700 do not require a resistance mechanism and are used primarily for stretching exercises, physical therapy, and light cardiovascular training. Eliminating the resistance mechanism simplifies the operation of the machine and reduces the number of components, thereby reducing manufacturing cost.

Machine 600 and an embodiment of machine 700 utilize a reciprocating arcing resistance assembly. The reciprocating arcing resistance assembly can create resistance utilizing magnetic components or friction components. The reciprocating arcing motion resistance assembly comprises substantially fewer parts than a traditional rotational resistance mechanism and the reciprocating arcing resistance assembly can directly engage one or more of the exercise motion components of the machine. This eliminates the transmission components required to link the exercise motion components to the resistance mechanism as is required with traditional rotational resistance mechanisms. The components of the reciprocating arcing magnetic resistance and the reciprocating arcing friction resistance components perform well and are highly durable, however the components of the reciprocating arcing friction resistance assembly cost less than the components of the reciprocating arcing magnetic resistance. The reciprocating arcing resistance assemblies have many advantages verses a traditional rotational resistance mechanism including fewer components, lower manufacturing cost, superior durability, and requires less space so the exercise machine can be more compact.

The embodiments illustrated in FIGS. 41-56 use common components to create the exercise motion of machines 400 and 600 and to create the angle adjustment feature of these embodiments. Each common component is identified at least once with either a 400 series component number or 600 series component number or both a 400 series component number and a 600 series component number. However, to prevent excessive redundancy these common components and their functions will be described once with either the 400 series component number, the 600 series component number, or both the 400 series component number and the 600 series component number. It is to be expressly understood that said 400 and 600 series common components are of the same structure and function.

Referring now to FIGS. 41-51, which illustrate a machine 400 comprising a manual angle adjustment assembly 489 and without a resistance mechanism, and also referring to FIGS. 52-65 which illustrate a machine 600 comprising the identical components and function of machine 400 with the addition of a reciprocating arcing resistance assembly 640. Both machines comprise a rectangular shaped stationary base frame 405 configured with a set of opposing left and right side elongated horizontal tubes that are vertically spaced to form left and right side structures that each support a left and right side step 428. Steps 428 provide a transition point for a user U to enter and exit the machine. A cross bar 404 connects a rearward portion of the left and right sides of stationary base frame 405 and a cross bar 406 connects a central portion of the left and right sides of stationary base frame 405.

A movable user support frame 410, 610 is comprised of elongated tubes that house the exercise motion components of machines 400 and 600 and in certain embodiments, movable user support frame 610 also houses the reciprocating arcing resistance assembly components. The rearward end of movable user support frame 410, 610 is rigidly connected to flange 409 which is rigidly connected to axle 412, 612 and axle 412, 612 is connected to cross bar 404 with two bearings 408 such that movable user support frame 410 can pivot about axle 412, 612 on a rearward portion of stationary base frame 405. A first end of a support tube 466 is rigidly connected to the forward upper end of movable user support frame 410, 610 and a first end of a support tube 467 is rigidly connected proximal to a second end of support tube 466 and an electronic exercise information console 500 is rigidly connected to the second end of support tube 467.

Figure 41:
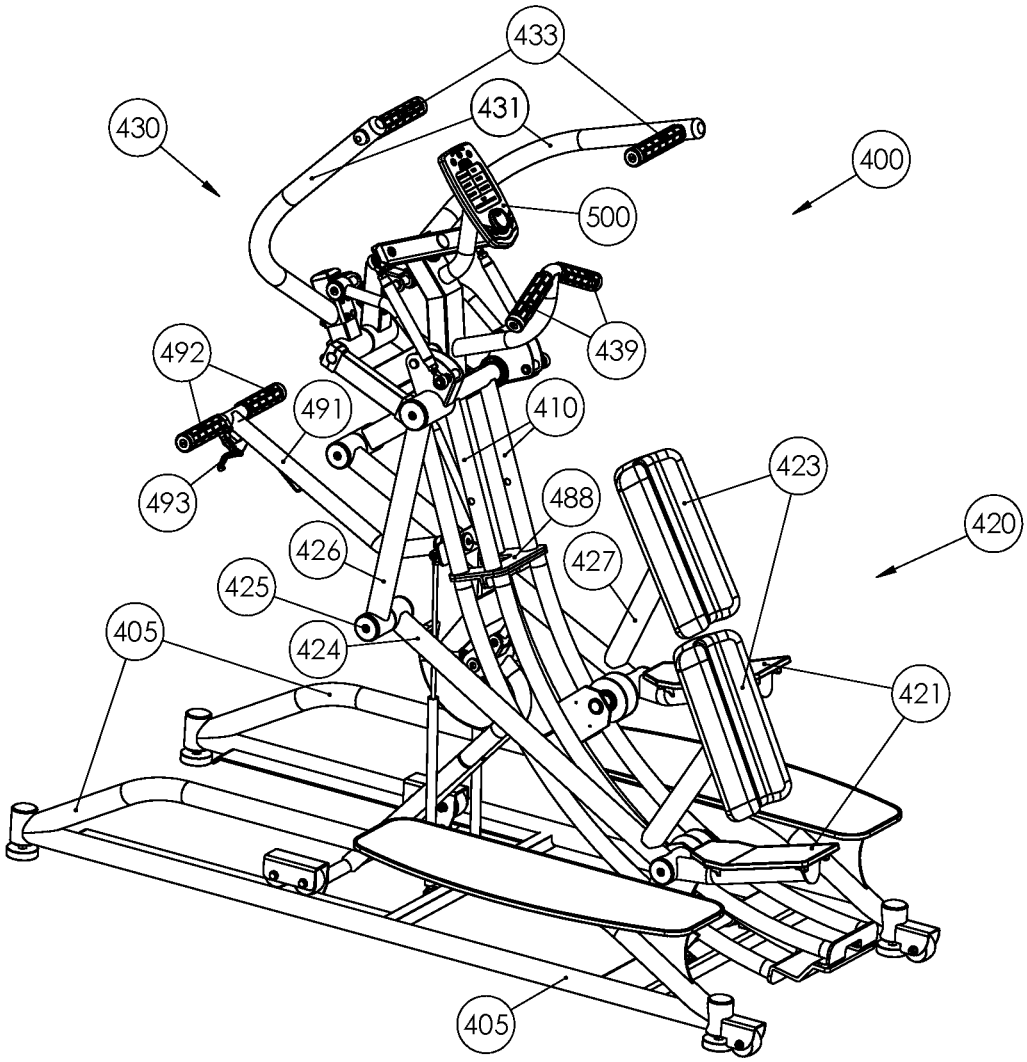
FIG. 41 is a rear perspective view of the invention in a higher angle position with a stationary base frame, a manual angle adjustment assembly, and without a resistance mechanism.
Figure 42:
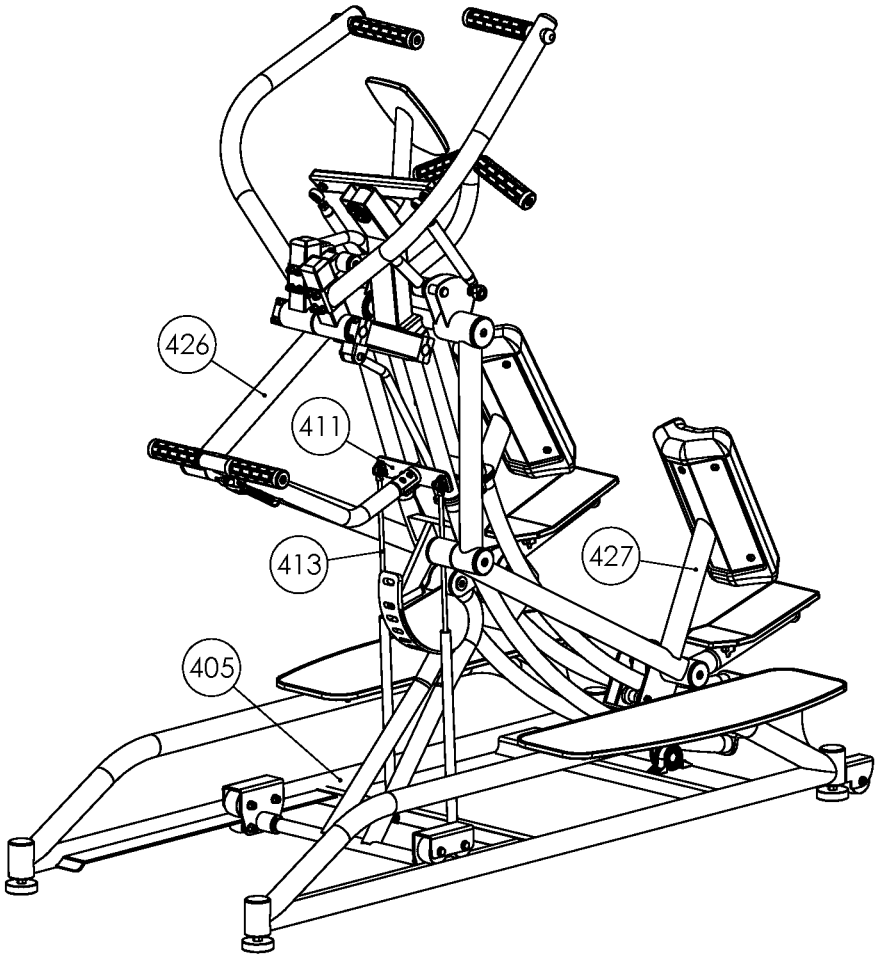
FIG. 42 is a front perspective view of the invention in a higher angle position with a stationary base frame, a manual angle adjustment assembly, and without a resistance mechanism.
Figure 43:
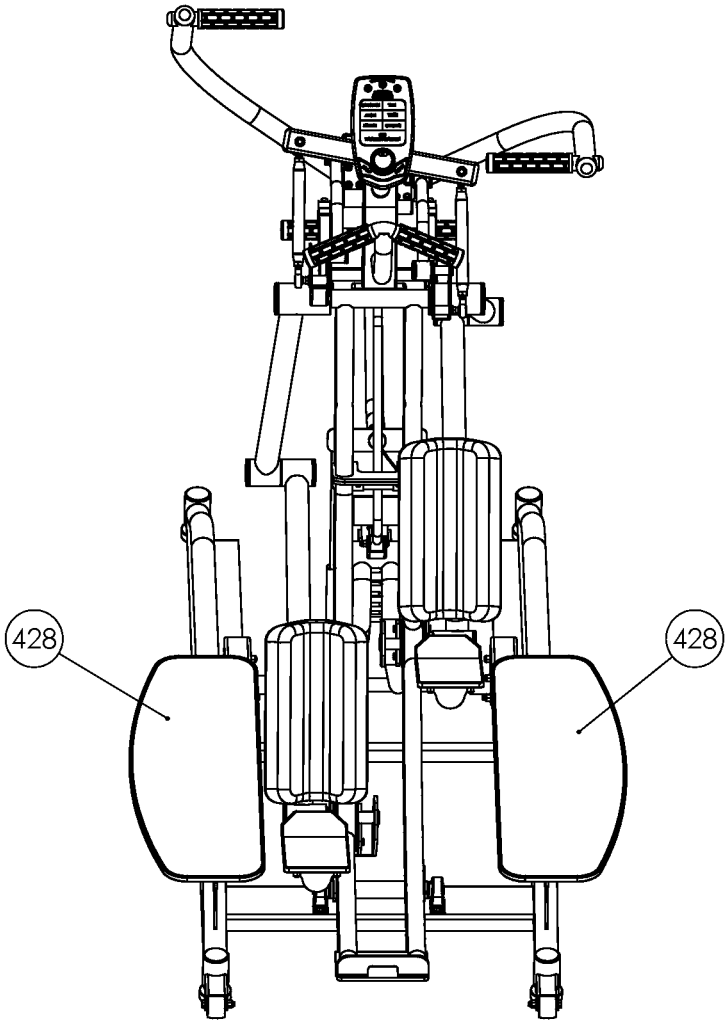
FIG. 43 is a rear elevated view of the invention is a higher angle position with a stationary base frame, a manual angle adjustment assembly, and without a resistance mechanism.
Figure 44:
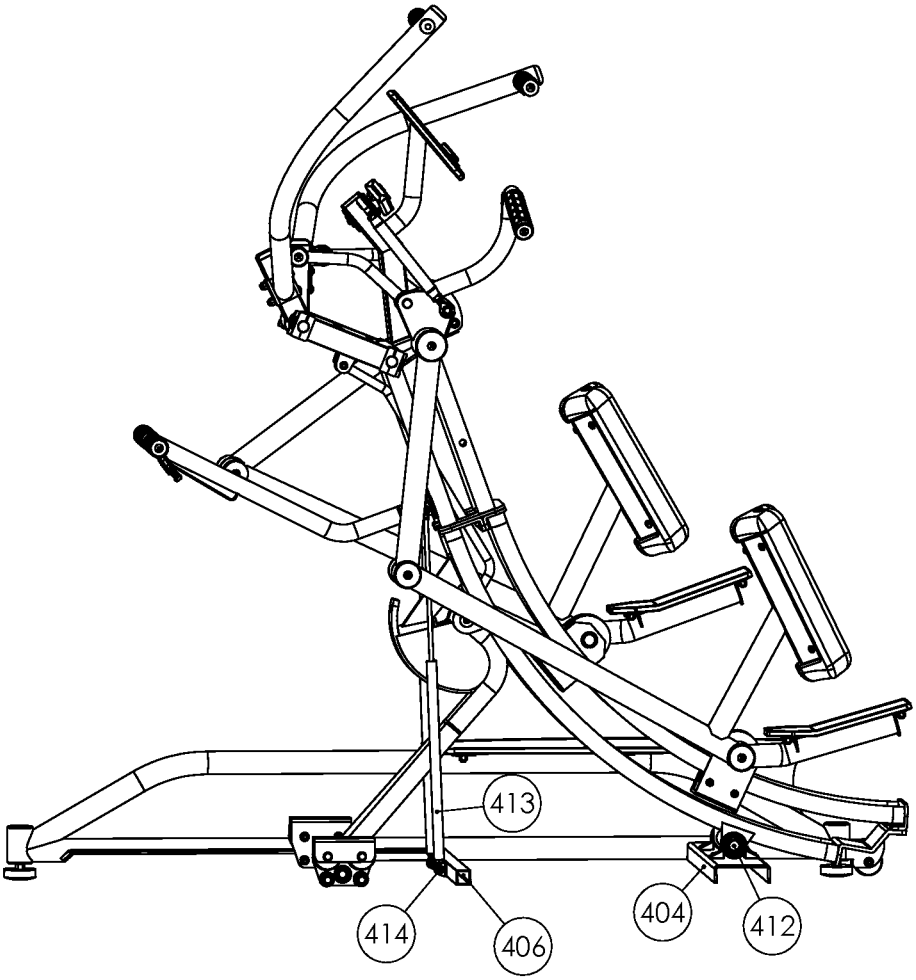
FIG. 44 is left side view of the invention in a higher angle position with a stationary base frame, manual angle adjustment assembly, and without a resistance mechanism.

As best illustrated in FIGS. 41-43, a movable lower body user support assembly 420 is comprised of identical opposing left and right side components wherein a foot platform 421 is rigidly connected to a first end of a first linkage bar 424 and the second end of first linkage bar 424 is connected to a first end of second linkage bar 426 with pivot 425 and a second end of second linkage bar 426 is connected to movable user support frame 410 with linkage connection hub pivot 470 such that an upper portion of movable lower body user support assembly 420 pivots about an upper portion of movable user support frame 410, 610. A first end of a mounting tube 427 is rigidly connected proximal to a rearward portion of first linkage bar 426 and forward of foot platform 421 and a shin support pad 423 is rigidly mounted to a second end of mounting tube 427 such that shin support pad 423 is suspended above a central portion of foot platform 421 at a mostly perpendicular angle. Shin support pad 423 is an elongated rectangular pad with a concave shaped on the long tangent for accepting and securing a user's lower legs. Shin support pad 423 is spaced from platform 421 sufficiently that when a user's foot is mounted on foot platform 421, the lower end of shin support pad 423 contacts the front of the user's ankle.

Figure 51:
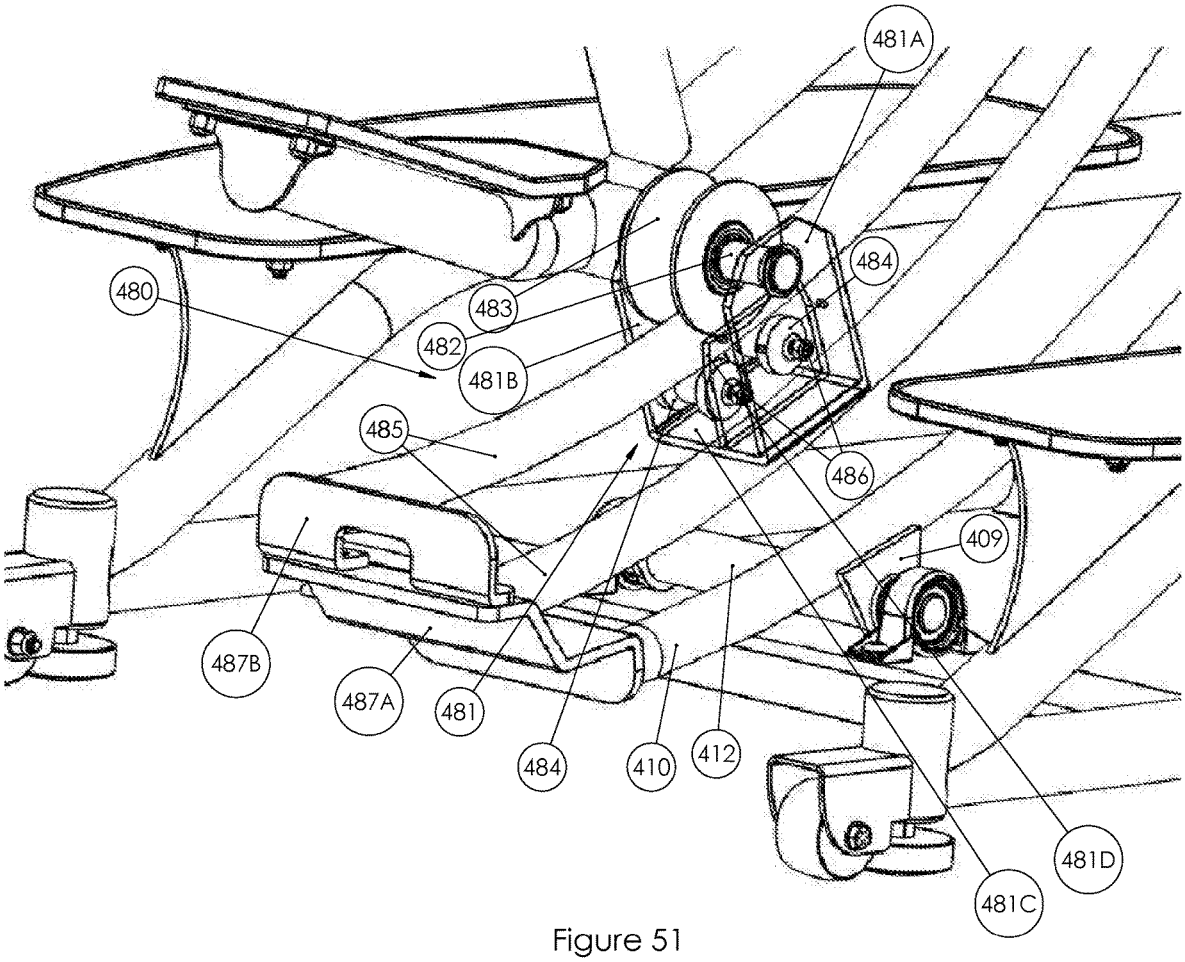
FIG. 51 is a close up view of the lower body user support wheels assembly of the embodiment of the invention without a resistance mechanism.
Figure 52:
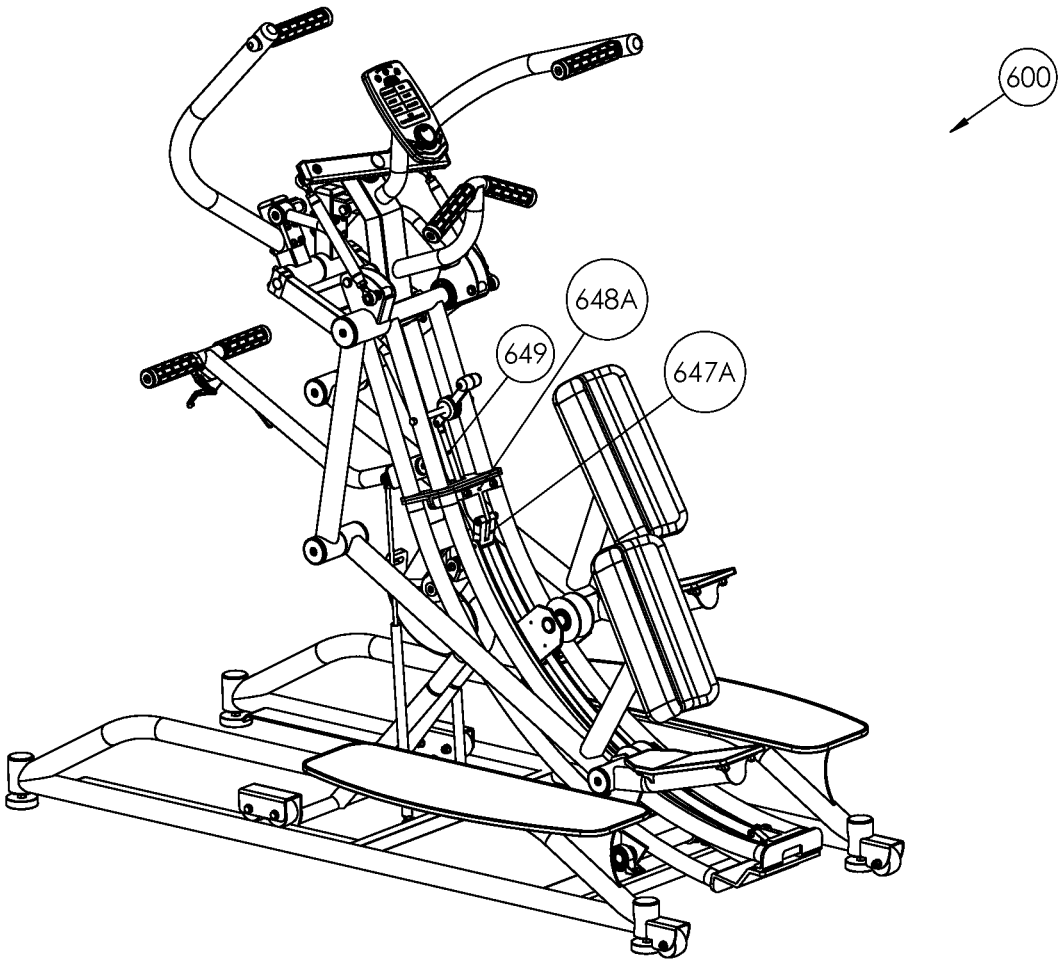
FIG. 52 is a rear perspective view of the invention in a higher angle position with a stationary base frame, a manual angle adjustment assembly, and a reciprocating arcing resistance assembly.
Figure 53:
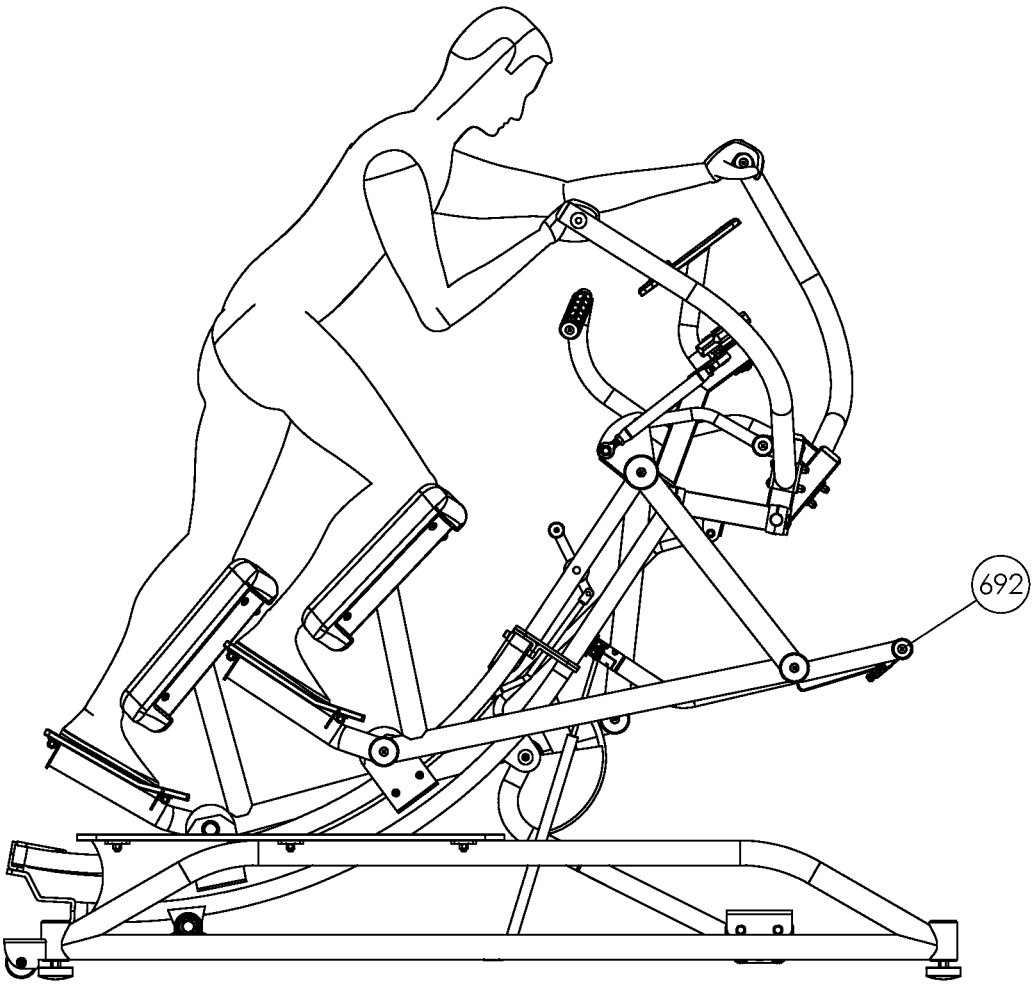
FIG. 53 is a right side view of the invention with a user mounted on the machine in a mid-angle position with a stationary base frame, a manual angle adjustment assembly, and a reciprocating arcing resistance assembly.
Figure 54:
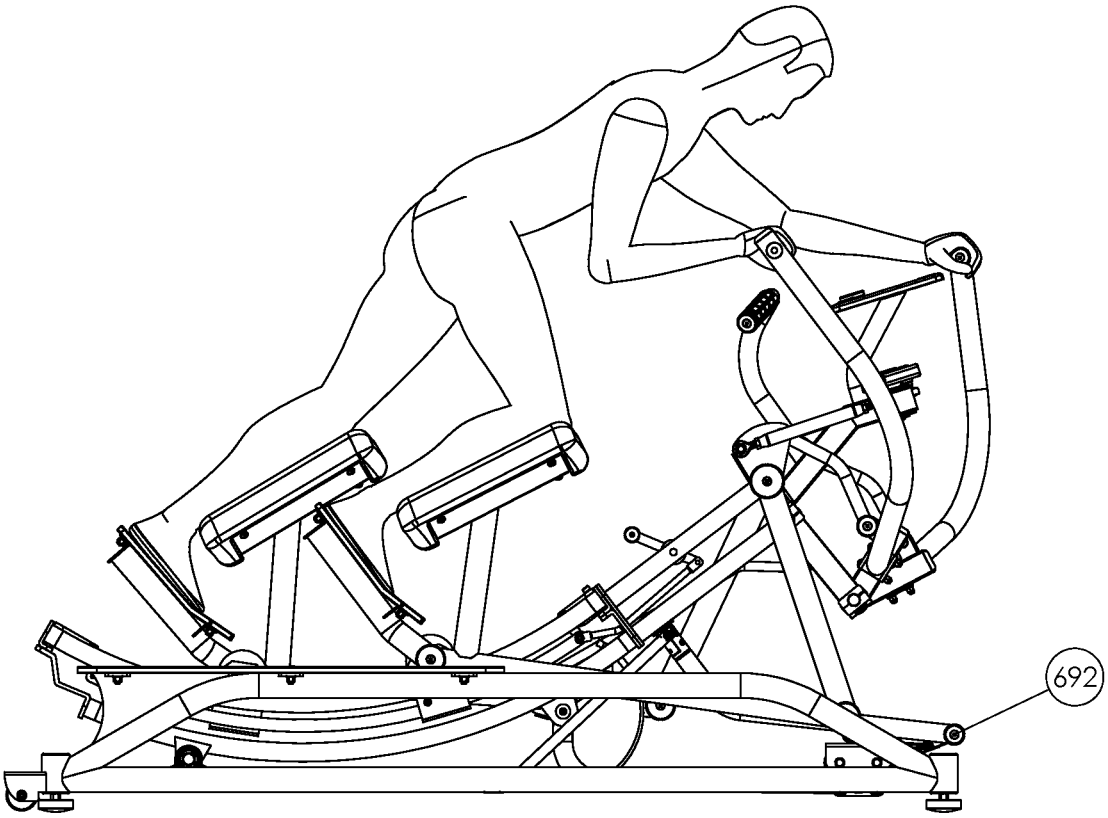
FIG. 54 is a right side view of the invention with a user mounted on the machine in a lower angle position with a stationary base frame, a manual angle adjustment assembly, and a reciprocating arcing resistance assembly.
Figure 55:
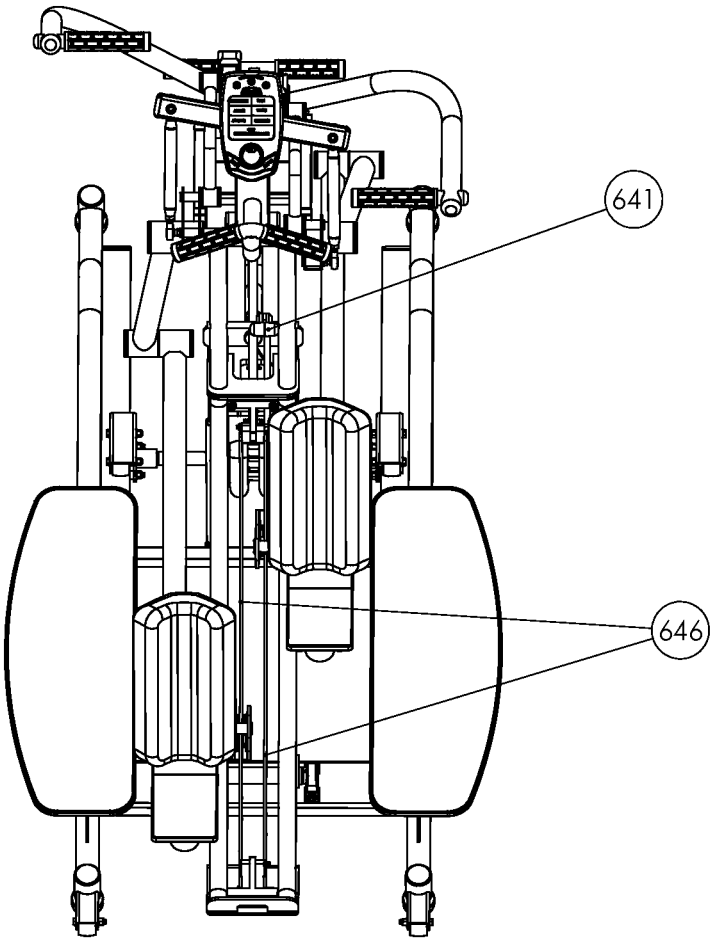
FIG. 55 is a rear elevated view of the invention with a manual angle adjustment assembly and a reciprocating arcing resistance assembly.

As best illustrated in FIG. 51, a lower body user support wheels assembly 480 is rigidly connected to first linkage bar 424 with an axle 482 at a location between foot platform 421 and mounting tube 427. Axle 482 extends from first linkage bar 424 in a horizontal perpendicular direction towards the central portion of movable user support frame 410, 610. In this view, multiple components are mounted on a housing 481 and housing 481 is illustrated as outlined and transparent so that the components can be more clearly illustrated and identified. Lower body user support wheels assembly 480 is comprised of an axle 482 connected to an upper portion of a U-shaped housing 481 such that axle 482 intersects a first side wall 481A and a second side wall 481B, proximal to the open end of housing 481. A first end of axle 482 is nearly flush with a first side wall 481A and the second end of axle 482 extends through and away from second side wall 481B. A first diameter wheel 483 is mounted on axle 482 within housing 481 more proximal to second side wall 481B. An interior wall 481D is rigidly connected to the base wall 481C of housing 481 and interior wall 481D is parallel to the first side wall 481A and second side wall 481B. Interior wall 481D is shorter than first side wall 481A and second side wall 481B such that interior wall 481D does not interfere with axle 482. A set of two axles 486 that are parallel to axle 482 intersect the lower portion of second side wall housing 481B and intersect the lower portion of interior wall 481D. A second diameter wheel 484 that is smaller in diameter than wheel 483 is mounted on each axle 486 within housing 481 such that the single wheel 483 and the pair of wheels 484 form a triangular mounting pattern within housing 481. An arc shaped wheel track 485 intersects housing 481 perpendicular to axle 482 and axles 486 and engages the lower central part of wheel 483 and the upper central part of wheels 484 such that wheel track 485 is captured by wheels 483 and 484 wherein lower body user support wheels assembly 480 can roll along wheel track 485.

Figure 56:
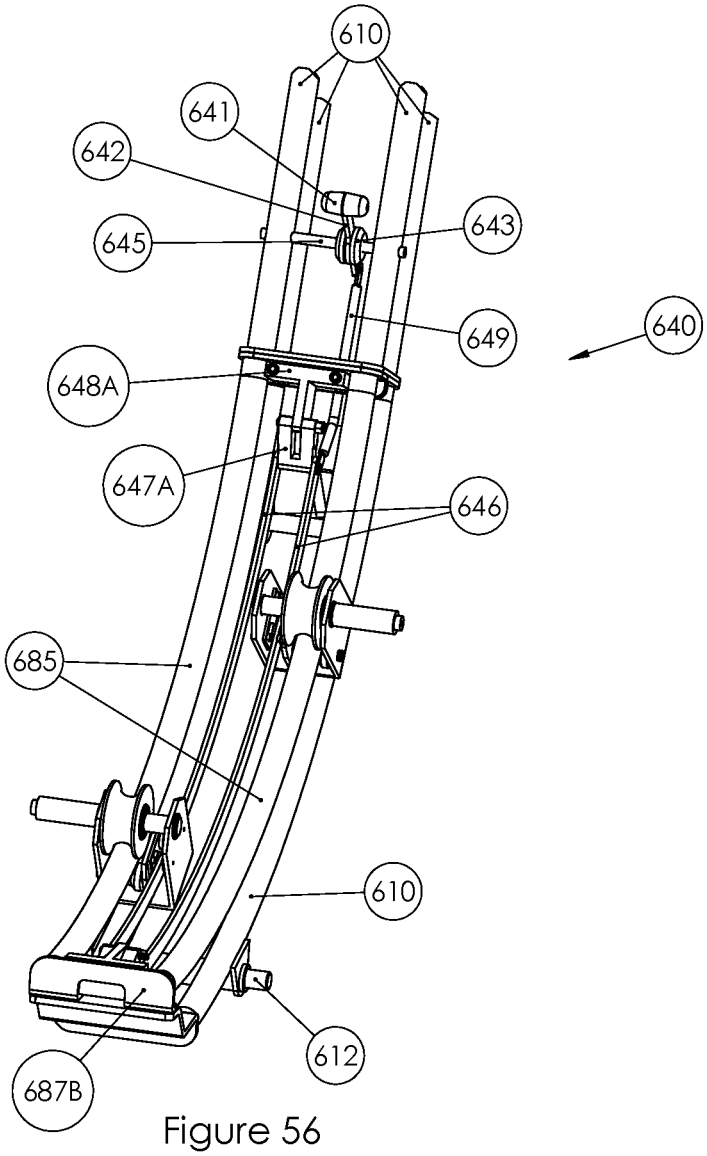
FIG. 56 is an isolated perspective view of the reciprocating arcing resistance assembly of the invention.
Figure 57:
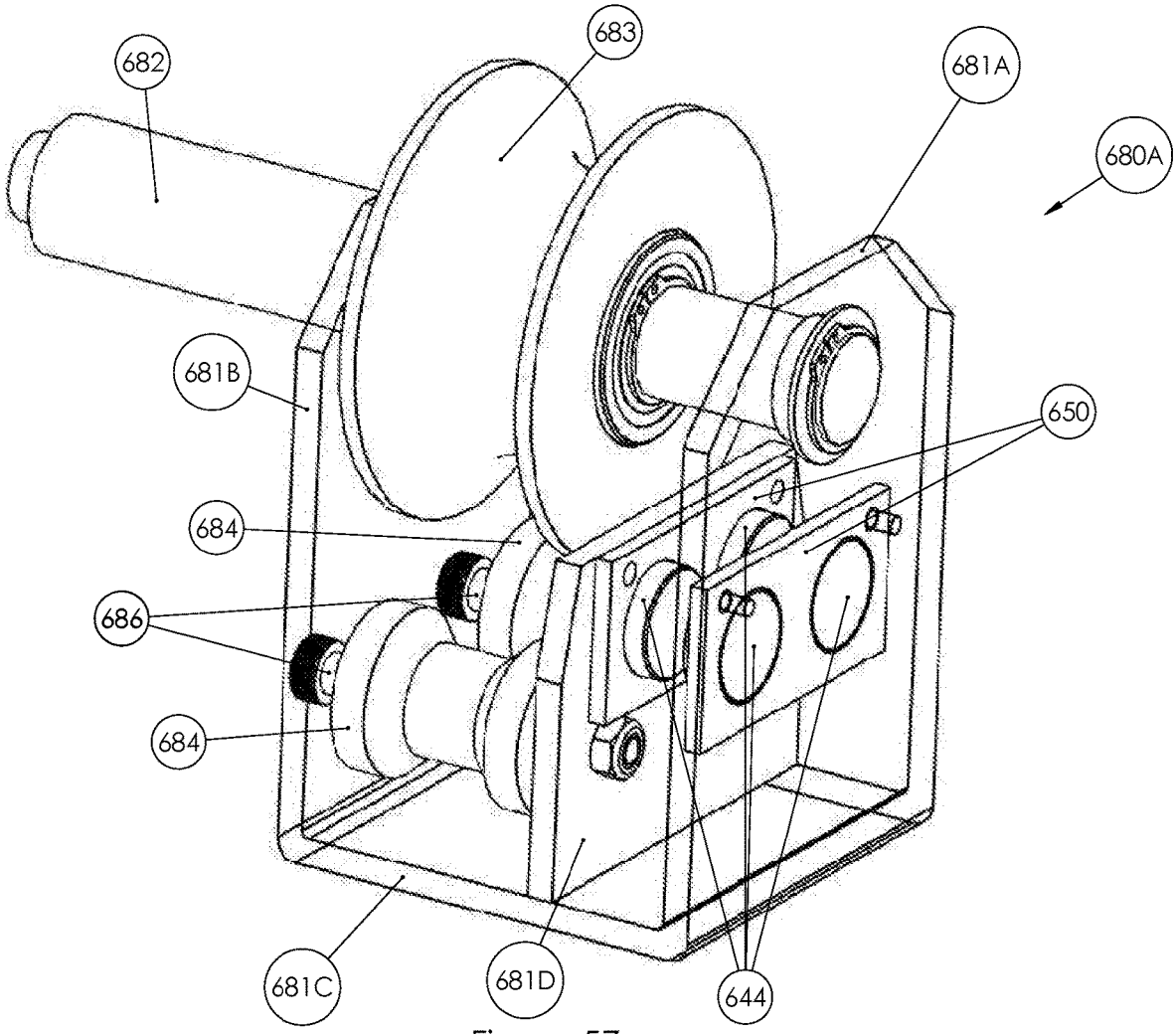
FIG. 57 is an isolated perspective view of the lower body user support wheels and magnetic resistance assembly of the invention.

As best illustrated in FIGS. 41, 51, and 56 the lower end of left side and right side wheel tracks 485, 685 are rigidly connected to the lower end of movable user support frame 410, 610 with lower connection brackets 487A, 487B, 687A, 687B and the upper end of left and right wheel tracks 485, 685 is rigidly connected to the upper end of movable user support frame 410, 610 with upper connection bracket 488.

Figure 50:
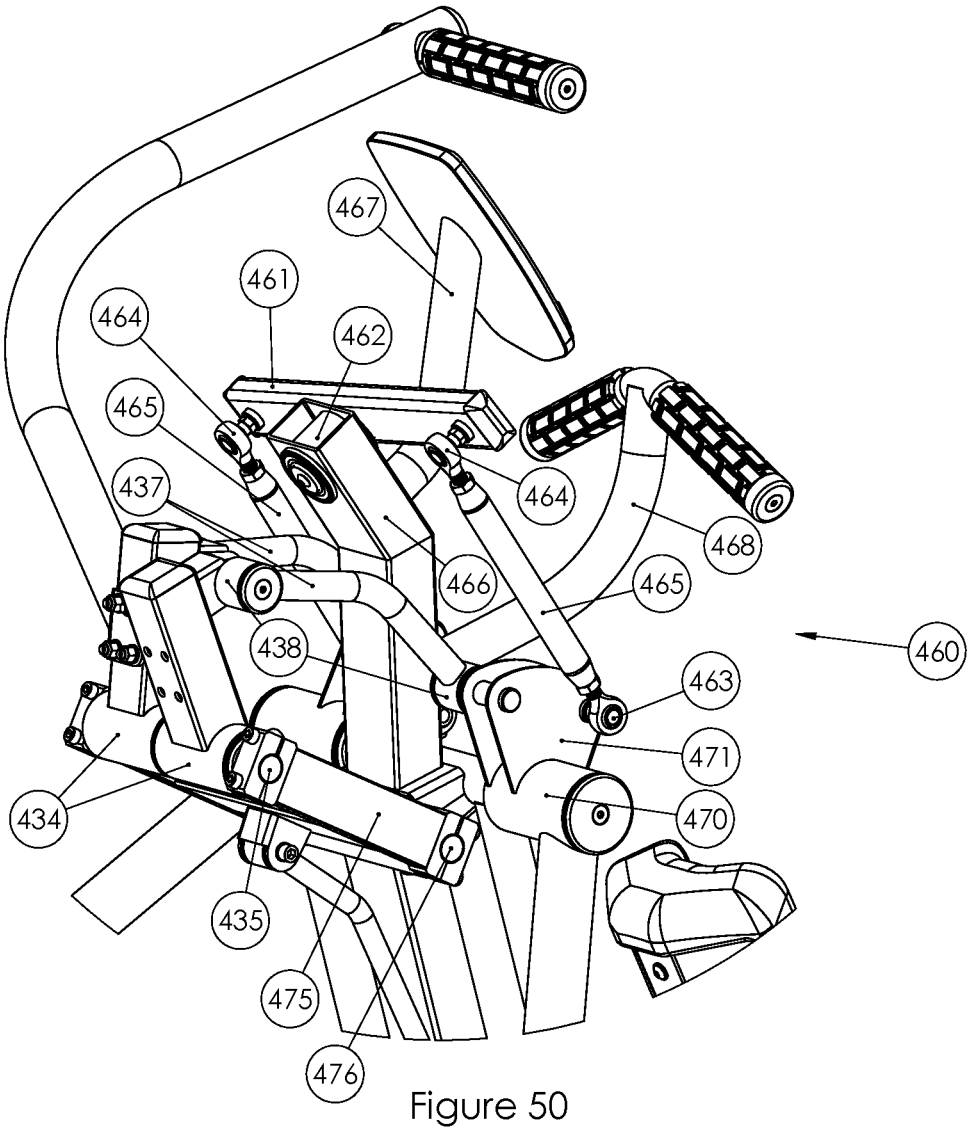
FIG. 50 is a close up view of the upper body user support linkage assembly of the invention.

As best illustrated in FIGS. 41, and 50, an upper body user support assembly 430 is comprised of identical left side and right side grip handles 433 mounted on first ends of left side and right side lever arms 431 and the second end of left side and right side lever arms 431 are connected to a height adjustment lever 475 with pivots 434 that independently pivot about pivot axle 435. Height adjustment lever 475 pivots on movable user support frame 410, 610 about axle 476. For better clarity, the method and details of adjusting height adjustment lever 475 will be described after the functions of other components of machines 400 and 600 are disclosed herein. A set of left and right stationary grip handles 439 are rigidly connected to the first end of a support tube 468 and the second end of support tube 468 is rigidly connected proximal to the first end of support tube 466. Stationary grip handles 439 can be used to steady a user U when entering and exiting the machine or for steadying a user U when operating the lower body user support assemblies 420 only and not exercising with user U's upper body.

As best illustrated in FIG. 50, a linkage assembly 460 connects and synchronizes the motions of the left side and right side lower body user supports 420 with the motions of the left side and right side upper body user supports 430 respectively. Linkage assembly 460 is comprised of left side and right side flanges 471 mounted on left side and right side linkage connection hub pivots 470 and a forward portion of left side and right side flanges 471 are connected to a first end of left side and right side linkage bars 437 with pivots 438 and the second end of left side and right side linkage bars 437 are pivotally connected to the second end of left side and right side lever arms 431 with pivots 438. A first end of support tube 466 is rigidly connected to the upper end of movable user support frame 410, 610 between left side linkage 437 and right side linkage 437 such that support tube 466 extends above linkages 437 and flanges 471. A central portion of a rocker arm 461 is mounted to the second end of support tube 466 with pivot 462. The left end of rocker arm 461 is connected to a first end of left side linkage bar 465 with a pivot 464 and the second end of the left side linkage bar 465 is connected to a rearward portion of left side flange 471 with a pivot 463. The right end of rocker arm 461 is connected to a first end of right side linkage bar 465 with a pivot 464 and the second end of right side linkage bar 465 is connected to right side flange 471 with a pivot 463.

As best illustrated in FIGS. 44-49, an angle adjustment assembly 489 connects the central portion of the movable user support frame 410, 610 to the forward and central portion of the stationary base frame 405 and locates and secures the angle of the movable user support frame 410, 610 at a unique angle selected and set by the user. Angle adjustment assembly 489 is comprised of left and right lifting bars 490 wherein a first end of lifting bars 490 are connected to movable user support frame 410, 610 with pivot 494 and the second end of lifting bars 490 are rigidly connected to axle 495 and the ends of axle 495 are connected to left and right pivots 496. Pivots 496 are rigidly connected to wheels housing 497. Upper wheels 498A and lower wheels 498B are housed in wheels housing 497. Wheels tracks 499 are rigidly connected to the inside front portion of the lower left and right side tubes of stationary base frame 405. Wheels tracks 499 intersect a central portion of wheels housing 497 such that they concurrently engage the lower portion of upper wheels 498A and the upper portion of lower wheels 498B such that angle adjustment assembly 489 can roll along wheels tracks 499 as lifting bars 490 lift or lower movable user support frame 410, 610. Angle adjustment assembly 489 is capable of adjusting movable user support frame 410, 610 to any angle on one side of a vertical line between said vertical line and horizontal.

As best illustrated in FIGS. 41, 42, 47, 48, and 49, the components of the angle adjustment assembly 489 that set and secure the angle of the movable user support frame 410, 610 include a pair of grip handles 492 mounted on a first end of adjustment lever 491. A cable activation lever 493 is operatively connected proximal to the first end of adjustment lever 491 adjacent to gripping handles 492. The second end of adjustment lever 491 is rigidly connected to a central portion of attachment plate 411, which is rigidly attached to a central portion of movable user support frame 410, 610. First ends of left and right lifting assist springs 413 are connected to cross bar 460 and second ends of lifting assist springs 413 are connected to left and right ends of attachment plate 411 with mounting brackets 414. Left and right side curved shaped flat connection plates 422 are rigidly connected to the upper portion of lifting bars 490 and pivot 494 such that the rearward edges of connection plates 422 are rigidly connected to lifting bars 490 and pivot 494 as the forward edges of connection plates 422 extend away from lifting bars 490 and pivot 494 and towards the front of stationary base frame 405.

Figure 45:
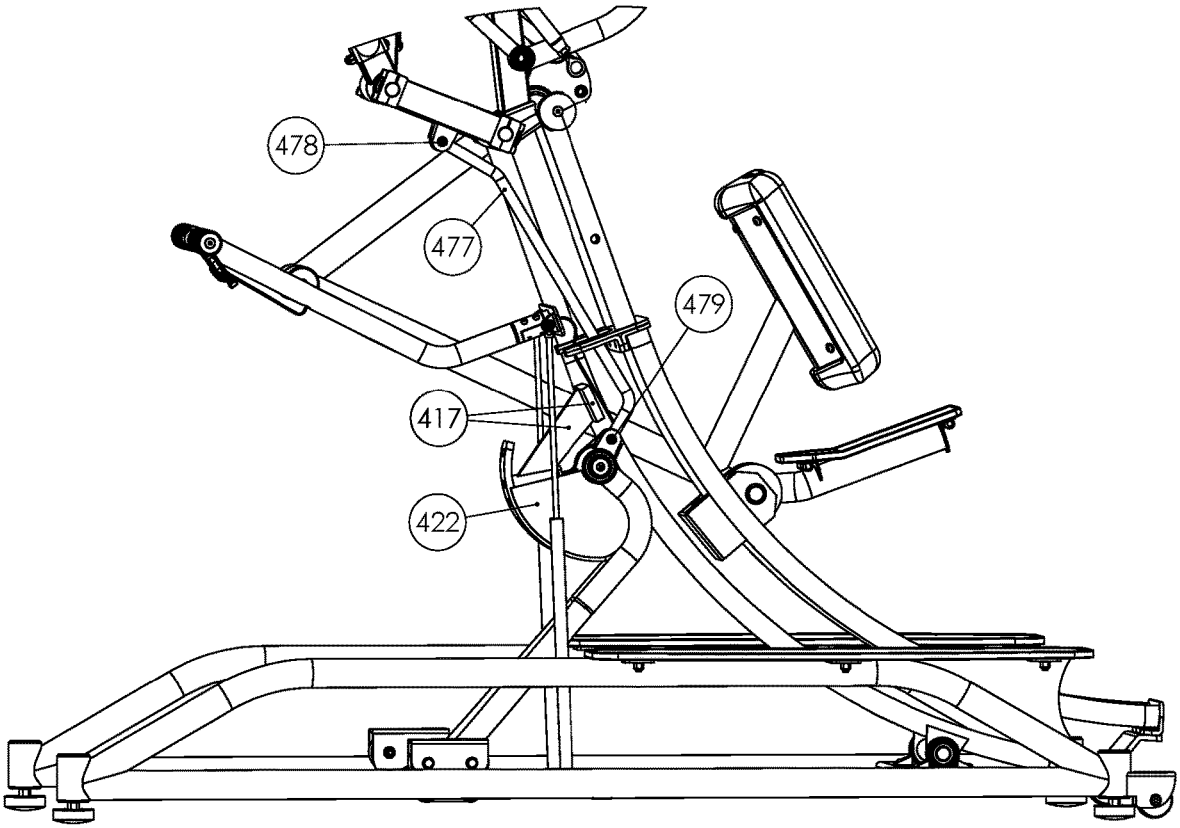
FIG. 45 is left side perspective view of the intention in a higher angle position with a stationary base frame, a manual angle adjustment assembly, and without a resistance mechanism.
Figure 46:
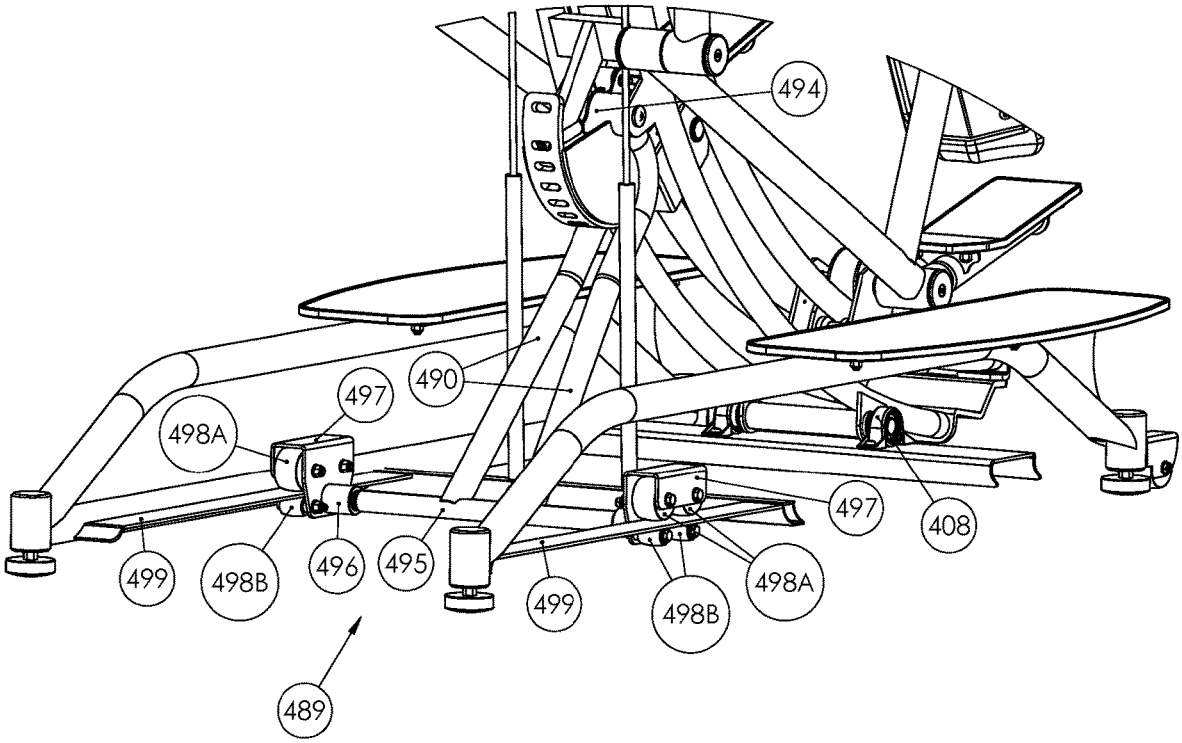
FIG. 46 is a view of the manual angle adjusting assembly of the invention.
Figure 47:
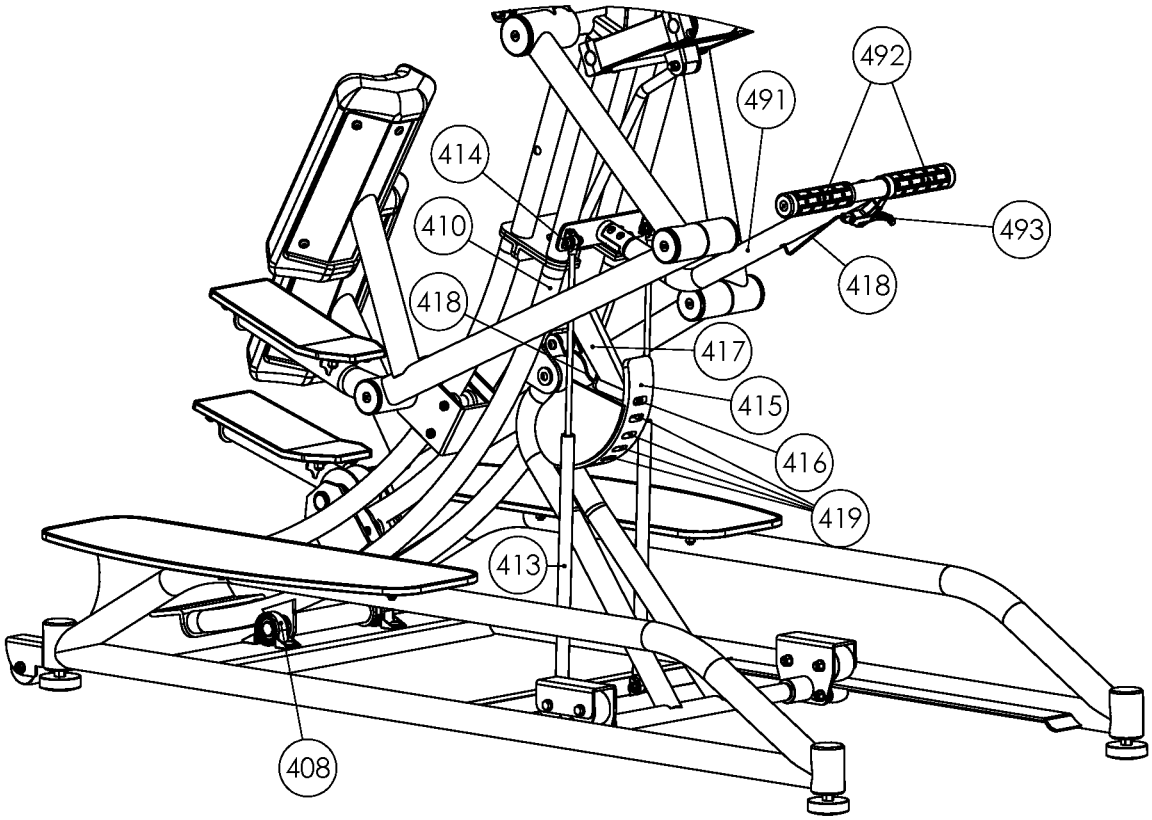
FIG. 47 is a view of the angle locking mechanism of the invention with the user support assembly locked in a higher angle position.
Figure 48:
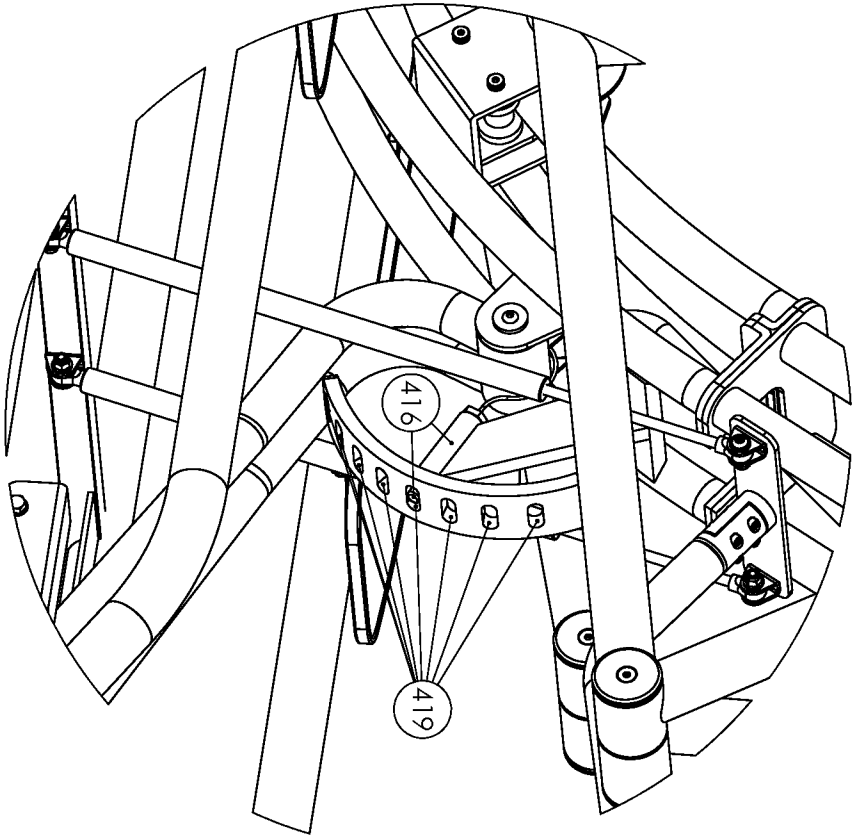
FIG. 48 is a close up view of the angle locking assembly of the invention with the user support assembly locked in a mid-angle position.
Figure 49:
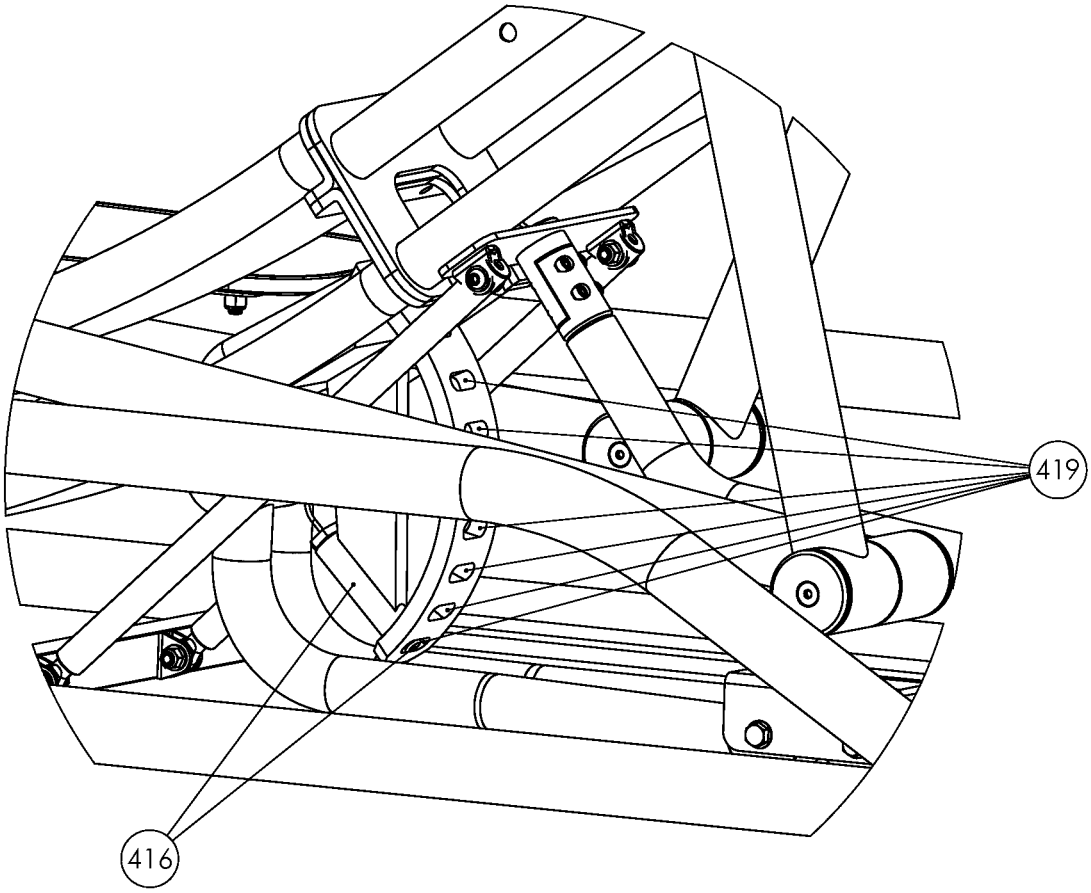
FIG. 49 is a close up view of the angle locking assembly of the invention with the user support assembly locked in a lower angle position

An arc shaped locking plate 415 with a shape that matches the shaped edges of the connection plates 422 is rigidly connected at the left and right side edges of locking plate 415 to the forward edges of the connection plates 422 to form an open top structure at the top of the lifting bars 490. The short tangent of an angled "T" shaped connection bar 417 best illustrated in FIG. 45 is rigidly connected to movable user support frame 410, 610 above and adjacent to pivot 494. The long tangent of connection bar 417 extends forward and downward so as to be forward of and adjacent to pivot 494 and within the perimeter formed by the open top structure created by locking plate 415 and connection plates 422. A spring-loaded locking pin 416 is rigidly connected to the long tangent end of connection bar 417 such that the rearward portion of locking pin 416 is closer to pivot 494 and the forward end of locking pin 416 is closer to the rearward surface of locking plate that forms one inside wall of the open top structure created by locking plate 415 and connection plates 422. Locking plate 415 is configured with a plurality of receiving holes 419 for engagement with locking pin 416 to set and secure the angle of movable user support frame 410, 610. The first end of an activation cable 418 is operatively connected to activation lever 493 and the second of the activation cable 418 is operatively connected to the rearward end of locking pin 416 for releasing locking pin 416 from receiver holes 419 and engaging locking pin 416 with receiver holes 419. FIG. 47 illustrates the angle adjustment assembly 489 set to a higher angle setting with locking pin 416 engaged with an upper receiver hole 419. FIG. 48 illustrates the angle adjustment assembly 489 set to a central or median angle setting with locking pin 416 engaged with a central or median receiver hole 419. FIG. 49 illustrates the angle adjustment assembly 489 set to a lower angle setting with locking pin 416 engaged with a lower receiver hole 419.

As best illustrated in FIG. 45, a first end of push rod 477 is operatively connected to height adjustment lever 475 with pivot 478 and the second end of push rod 477 is operatively connected to pivot 494 and lift bars 490 with pivot 479, such that the angle of height adjustment lever 475 relative to movable user support frame 410, 610 is adjusted concurrently when angle adjustment assembly 489 adjusts the angle of movable user support frame 410, 610. When angle adjustment assembly 489 adjusts the angle of movable user support frame 410, 610 to a higher angle, height adjustment lever 475 pivots upward causing the trajectory path of grip handles 433 to move upward relative to the floor surface. When angle adjustment assembly 489 adjusts the angle of movable user support frame 410, 610 to a lower angle, height adjustment lever 475 pivots downward causing the trajectory path of grip handles 433 to move downward relative to the floor surface. This concurrent adjustment of upper body user support assembly 430 and movable user support frame 410, 610 optimizes the biomechanics of the combined exercise motion of the upper and lower body user supports at every angle of movable user support frame 410, 610.

Prior to operating machine 400 or machine 600, user U would first select and set the angle of movable user support frame 410, 610 by grasping grip handles 492, 692 and squeezing activation lever 493 towards handle 492, 692 so as to activate locking pin cable 418 in a first direction that draws locking pin 416 out of a receiving hole 419 and away from locking plate 415 to unlock angle adjustment assembly 489. This action activates lifting assist springs 413 to neutralize the gravitational force of movable user support frame 410, 610 from pivoting forward and downward. The function of lifting assist springs 413 is to minimize the force required by a user U to lift or lower adjustment lever 491 to change the angle of movable user support frame 410, 610. User U then urges grip handles 492, 692 and adjustment lever 491 upward or downward, causing movable user support frame 410, 610 to pivot about axle 412, 612 on stationary base frame 405, causing lifting bars 490 to move to a higher or lower angle, causing axle 495 to pivot on pivot 496 as upper wheels 498A and lower wheels 498B roll forward or rearward on wheel tracks 499 to pivot movable user support frame 410, 610 to the desired angle of exercise position. User U then releases activation lever 493 such that activation lever 493 moves away from grip handle 492, 692 which activates locking pin cable 418 in a second direction which plunges locking pin 416 towards locking plate 415 and into a receiving hold 419 so as to lock angle adjustment assembly 489 into the desired angle of exercise position of movable user support frame 410, 610.

When the angle adjustment assembly 489 is activated, it concurrently adjusts the angle of height adjustment lever 475 relative to movable user support frame 410, 610, which concurrently adjust the height of upper body user support 430 relative to the floor surface, which concurrently adjust the pivot trajectory of grip handles 433 relative to the movable user support frame 410, 610 and the floor surface. When angle adjustment assembly 489 moves to a higher angle position, pivot 479 moves upward as pivot 494 rotates in a first direction causing the first end of push rod 477 to rotate on pivot 479 and move upward, causing the second end of push rod 477 to rotate on pivot 478 and lift height adjustment lever 475 upward as height adjustment lever 475 pivots about axle 476. This causes lever arms 431 and grip handles 433 to move upward. When angle adjustment assembly 489 moves to a lower angle position, pivot 479 moves downward as pivot 494 rotates in a second direction causing the first end of push rod 477 to rotate on pivot 479 and move downward, causing the second end of push rod 477 to rotate on pivot 478 and lower height adjustment lever 475 downward as height adjustment lever 475 pivots about axle 476. This causes lever arms 431 and grip handles 433 to move downward. This concurrent adjustment of angle adjustment assembly 489 and upper body user support assembly 430 optimizes the bio-mechanical exercise motion of grip handles 433 at each angle of exercise motion of machine 400 or machine 600.

To operate machine 400 or machine 600, user U would enter the machine by placing user U's feet on foot platforms 421 and user U's shins against shin support pads 423. User U would then grasp grip handles 433 and concurrently urge the left side lower body user support assembly 420 and left side upper body user support assembly 430 in a pushing or pulling direction while concurrently urging right side lower body user support assembly 420 and right side upper body user support assembly 430 in the opposite direction. This motion would cause the first end of left side linkage bar 424 to move in a first direction as left side lower body user support wheels assembly 480 rolls along left side wheel track 485 in a first direction as the second end of left side linkage bar 424 and the first end of left side linkage bar 426 pivot about pivot 425 as left side linkage bar 426 swings in a first direction and the second end of left side linkage bar 426 pivots about left side linkages connection hub pivot 470. This causes left side flange 471 to rotate in a first direction on left side linkages connection hub pivot 470 and urge left side linkage bar 465 and left side linkage bar 437 in first direction wherein the first end of left side linkage bar 465 pivots on a rearward portion of left side flange 471 with pivot 463 and the second end of left side linkage bar 465 pivots on the left end of rocker arm 461 causing rocker arm 461 to pivot about pivot 462 in a first direction. When urged by left side flange 471 in a first direction, the first end of left side linkage bar 437 pivots on the forward end of left side flange 471 with a first pivot 438 and the second end of left side linkage bar 437 pivots on a second pivot 438 located proximal to the second end of left side lever arm 431. The movement of left side linkage bar 437 in a first direction causes the second end of left side lever arm 431 to pivot on pivot 434 about axle 435 causing left side grip handle 433 to move in a first direction. This first directional urging of left side lower body user support assembly 420 and left side upper body user support assembly 430 by user U increases the distance between left side foot platform 421 and left side grip handles 433.

Rocker arm 461 connects and synchronizes the motion of the left side lower and upper body user supports with motion of the right side lower and upper body user supports such that the motion of the left side lower and upper body user supports in a first direction as previously described would cause the first end of right side linkage bar 424 to move in a second direction as right side lower body user support wheels assembly 480 rolls along right side wheel track 485 in a second direction as the second end of right side linkage bar 424 and the first end of right side linkage bar 426 pivot about pivot 425 as right side linkage bar 426 swings in a second direction and the second end of right side linkage bar 426 pivots about right side linkages connection hub pivot 470. This causes right side flange 471 to rotate in a second direction on right side linkages connection hub pivot 470 and urge right side linkage bar 465 and right side linkage bar 437 in second direction wherein the first end of right side linkage bar 465 pivots on rearward portion of right side flange 471 with pivot 463 and the second end of right side linkage bar 465 pivots on the right end of rocker arm 461 causing rocker arm 461 to pivot about pivot 462 in a second direction. When urged by right side flange 471 in a second direction, the first end of right side linkage bar 437 pivots on a forward portion of right side flange 471 with a first pivot 438 and the second end of right side linkage bar 437 pivots on a second pivot 438 located proximal to the second end of right side lever arm 431. The movement of right side linkage bar 437 in a second direction causes the second end of right side lever arm 431 to pivot on pivot 434 about axle 435 causing right side grip handle 433 to move in a second direction. This second directional urging of right side lower body user support assembly 420 and right side upper body user support assembly 430 by user U decreases the distance between right side foot platform 421 and right side grip handle 433.

When user U switches the direction of urging the left side lower body user support assembly 420 and the left side upper body user support assembly 430 from a first direction to a second direction, this causes the direction of the right side lower body user support assembly 420 and the right side upper body user support assembly 430 to switch from a second direction to a first direction and vice versa as previously described herein.

At any time while operating machine 400 or 600, user U can disengage from hand grips 433 and grasp stationary grip handles 439 to operate the lower body user support assemblies 420 only for a lower body only exercise motion.

While machine 400 or 600 is being operated, the reciprocating arcing pattern of exercise motion is defined by the configuration of the left side and right side movable upper body user support assemblies 430, the left side and right side movable lower body user support assemblies 420, the left side and right side linkage assemblies 460, and the rocker arm 461. However, while machine 400 or 600 is being operated, the range of movement of the reciprocating arcing pattern of exercise motion is controlled by the range of movement of the exercise motion of the user U. This allows users U of all sizes and physical flexibility to exercise comfortably within their own unique capabilities.

Now referring to FIGS. 52-65, 67, and 68, these figures illustrate embodiments of machine 600 and machine 700 that comprise many common components that create a reciprocating arcing resistance assembly. Each common component is identified at least once with either a 600 series component number or 700 series component number or both a 600 series component number and a 700 series component number. However, to prevent excessive redundancy these common components and their functions will be described once using either the 600 series component number, the 700 series component number, or both the 600 series component number and the 700 series component number. It is to be expressly understood that said 600 and 700 series common components are of the same structure and function.

Reciprocating arcing resistance assembly 640 illustrated in FIG. 56 can be configured with magnetic resistance components or a friction resistance components. The amount of resistance created by the reciprocating arcing magnetic resistance and the reciprocating arcing friction resistance is adjustable. The adjustment components, mounting configuration and function of the components that adjust the level of resistance of the reciprocating arcing magnetic resistance and the reciprocating arcing friction resistance on machines 600 and 700 are identical.

The reciprocating arcing magnetic resistance assembly as best illustrated in FIGS. 56-61 and 67 is comprised of a grip handle 641, 741 mounted on a first end of adjustment lever 642 and the central portion of adjustment lever 642 pivots on pivot 643 about axle 645. Axle 645 is rigidly connected to the forward and upper portion of movable user support frame 610, 710. The second end of adjustment lever 642 is pivotally connected to the first end of adjustment linkage bar 649 and the second end of adjustment linkage bar 649 is pivotally connected to the first end of first pivot bar 647A. Pivot bar 647A is a rectangular shaped bar located on a forward portion of movable user support frame 610, 710. The second end of pivot bar 647A is pivotally connected to first connection bracket 648A and first connection bracket 648A is rigidly connection to movable user support frame 610, 710. The first end of first pivot bar 647A is also pivotally connected to the first ends of horizontally spaced left and right conductive rails 646 and the second end of conductive rails 646 are pivotally connected to the first end of second pivot bar 647B and horizontally spaced. Second pivot bar 647B is a rectangular shaped bar identical to first pivot bar 647A and located on a rearward portion of movable user support frame 610, 710. The second end of second pivot bar 647B is pivotally connected to second connection bracket 648B and second connection bracket 648B is rigidly connected to wheels tracks connection bracket 687B. In this configuration, left and right conductive rails 646 are pivotally suspended between first pivot bar 647A and second pivot bar 647B to create a four-bar linkage such that the swinging movement of first pivot bar 647A and second pivot bar 647B causes left and right conductive rails 646 to move two-dimensionally.

Conductive rails 646 are elongated arc shaped rails with the same arc shape as wheels tracks 685. Conductive rails 646 can be constructed of various metals with aluminum and copper being the most common. The profile of conductive rails 646 is generally rectangular. Conductive rails 646 are horizontally spaced on either side of pivots bars 647A and 647B and pivot bars 647A and 647B are located between wheels tracks 685 such that left conductive rail 646 is horizontally spaced from and adjacent to left wheels track 685 and right conductive rail 646 is horizontally spaced from and adjacent to right wheels track 685.

FIGS. 57-61 best illustrate lower body user support wheels and magnetic resistance assembly 680A and how conductive rail 646 cooperates with lower body user support wheels and magnetic resistance assembly 680A. In these views, multiple components are mounted on a housing 681 and housing 681 is illustrated as outlined and transparent so that the components mounted on housing 681 can be more clearly illustrated and identified. Lower body user support wheels and magnetic resistance assembly 680A is comprised of an axle 682 connected to an upper portion of a U-shaped housing 681 such that axle 682 intersects a first side wall 681A and a second side wall 681B, proximal to the open end of housing 681. A first end of axle 682 is nearly flush with a first side wall 681A and the second end of axle 682 extends through and away from second side wall 681B. A first diameter wheel 683 is mounted on axle 682 within housing 681 more proximal to second side wall 681B. An interior wall 681D is rigidly connected to the base wall 681C of housing 681 and interior wall 681D is parallel to the first side wall 681A and second side wall 681B. Interior wall 681D is shorter than first side wall 681A and second side wall 681B such that interior wall 681D does not interfere with axle 682. A set of two axles 686 that are parallel to axle 682 intersect the lower portion of second side wall housing 681B and intersect the lower portion of interior wall 681D. A second diameter wheel 684 that is smaller in diameter than wheel 683 is mounted on each axle 686 within housing 681 such that the single wheel 683 and the pair of wheels 684 form a triangular mounting pattern within housing 681. An arc shaped wheel track 685 intersects housing 681 perpendicular to axle 682 and axles 686 and engages the lower central part of wheel 683 and the upper central part of wheels 684 such that wheel track 685 is captured by wheels 683 and 684 wherein lower body user support wheels assembly 680 can roll along wheel track 685.

Figure 58:
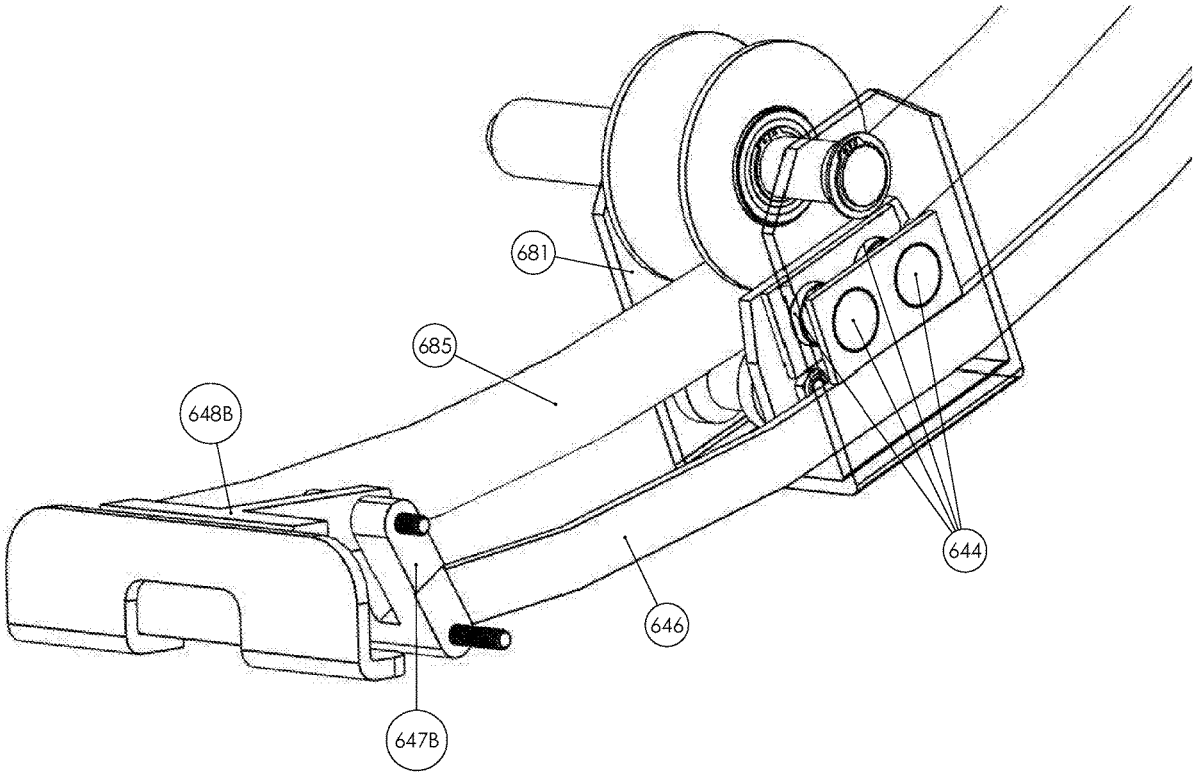
FIG. 58 is an isolated perspective view of the reciprocating arcing magnetic resistance assembly of the invention set to a lower resistance setting.
Figure 59:
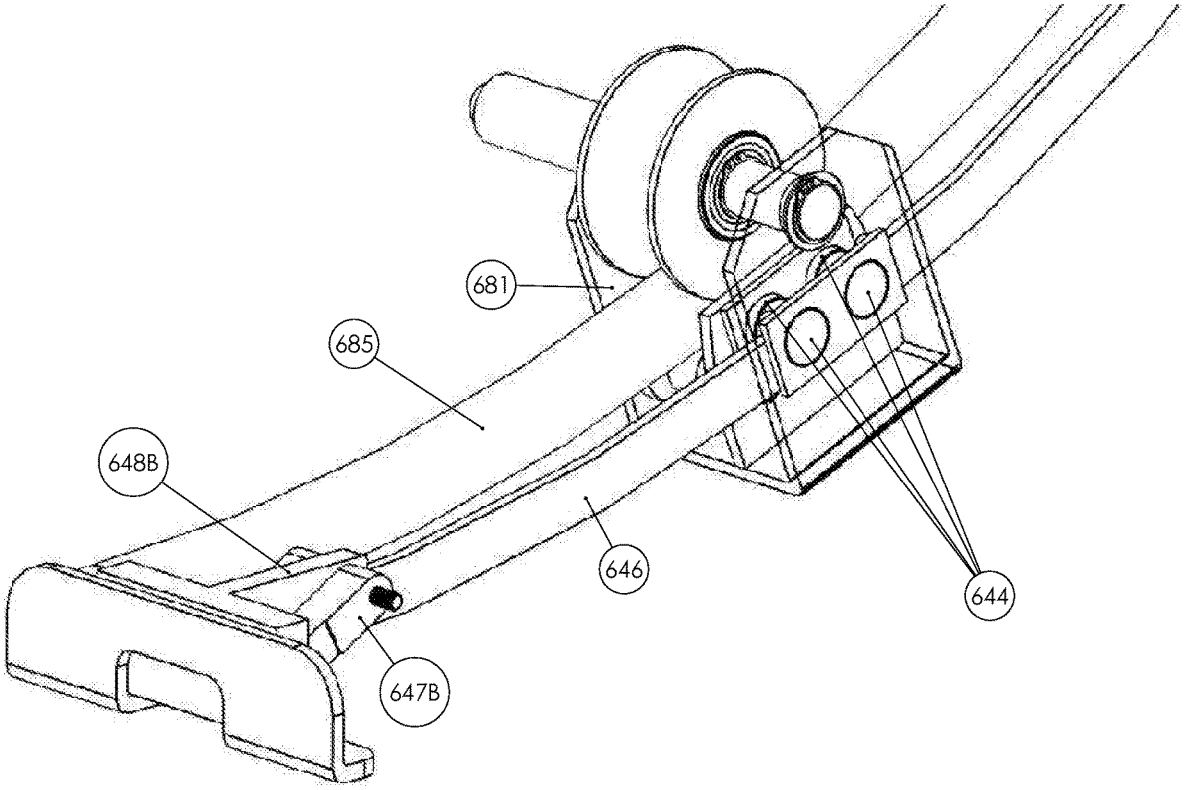
FIG. 59 is an isolated perspective view of the reciprocating arcing magnetic resistance assembly of the invention set to a higher resistance setting.
Figure 60:
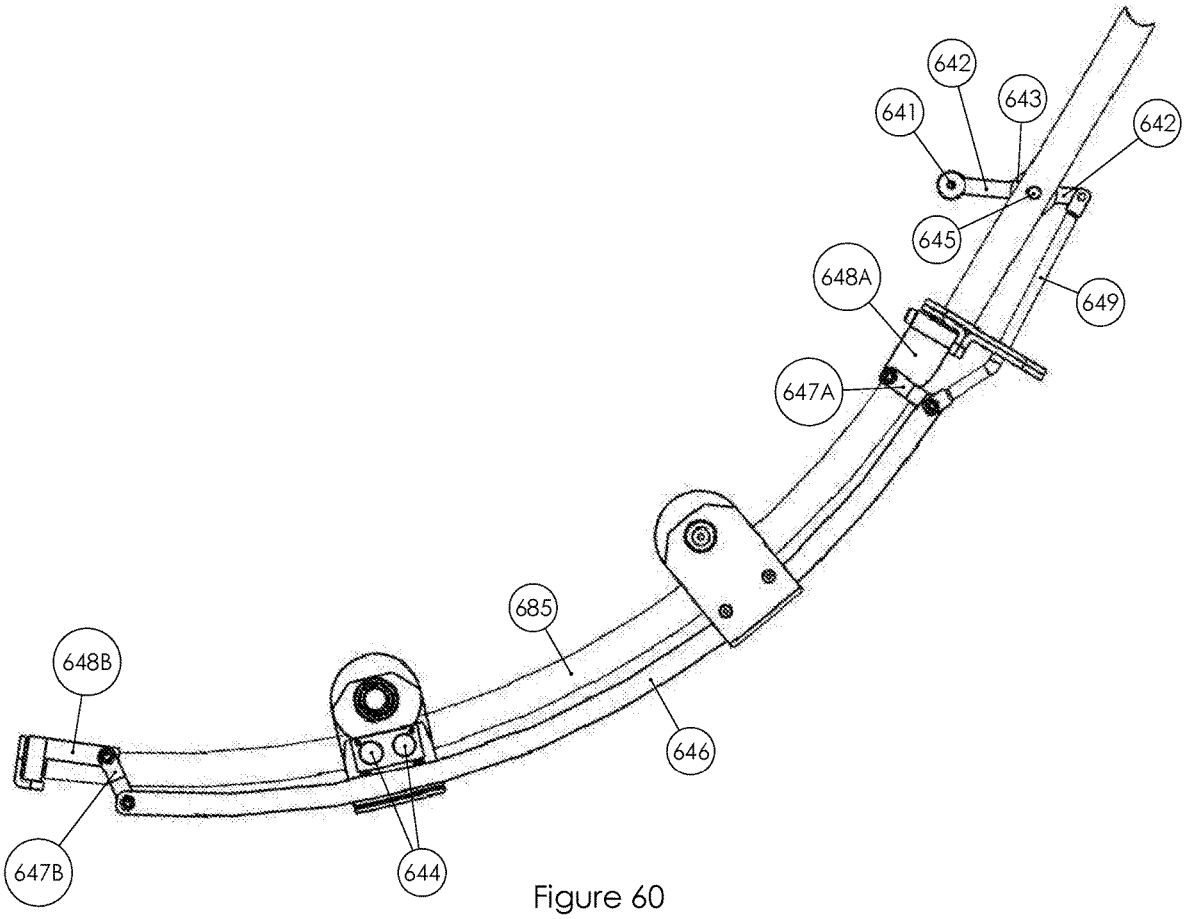
FIG. 60 is an isolated right side view of the reciprocating arcing magnetic resistance assembly of the invention set to a lower resistance setting.
Figure 61:
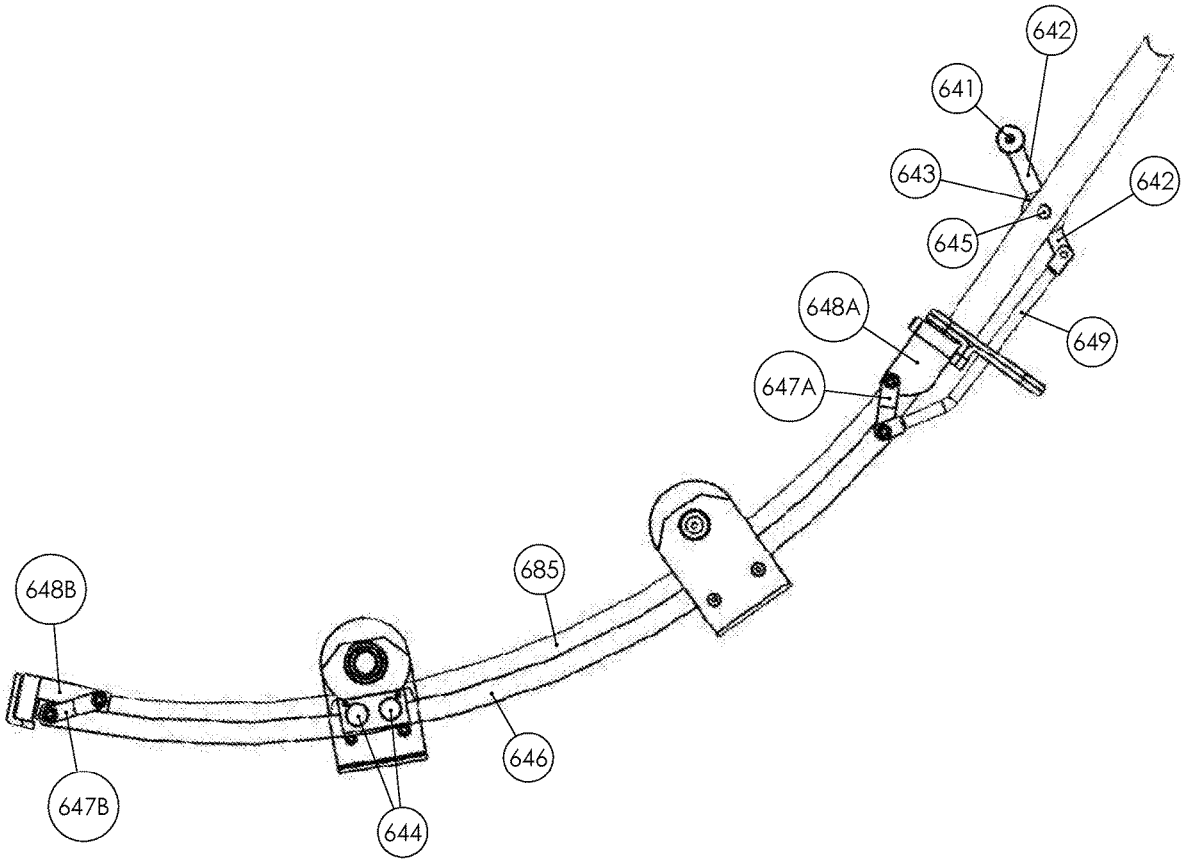
FIG. 61 is an isolated right side view of the reciprocating arcing magnetic resistance assembly of the invention set to a higher resistance setting.

A first magnet holder 650 is mounted on the inside surface of the first side wall 681A of housing 681 at a location median to the open and closed ends of housing 681 and a second magnet holder 650 is mounted in an opposing position on the upper portion of interior wall 681D of housing 681. A first set of two magnets 644 are secured with the first magnet holder 650 and a second set of two magnets are secured with the second magnet holder 650. Although four total magnets are represented in this embodiment, a different quantity of magnets may be used to achieve the same or similar results. An arc shaped conductive rail 646 intersects housing 681 below and perpendicular to axle 482 and proximal to the center point between interior wall 681D and the first side wall 681A. Conductive rail 646 is adjustably suspended at a first end with first pivot bar 647A and at a second end with second pivot bar 647B as previously described herein. A portion of conductive rail 646 is adjustably suspended within housing 681 such that a portion of conductive rail 646 can be raised and lowered within housing 681 wherein increasable portions or decreasable portions of conductive rail 646 can vertically intersect the space between the first set of two magnets 644 and the second set of two magnets 644. Conductive rails 646 can move into very close proximity of magnets 644 but conductive rails 646 and magnets 644 never come in contact. In this embodiment of the invention as described, when lower body user support wheels and magnetic resistance assembly 680A rolls along wheel track 685 and a portion of conductive rail 646 occupies the space between the first set of two magnets 644 and the second set of two magnets 644, a magnetic field is created between conductive rail 646 and magnets 644, which creates resistance to the movement of lower body user support wheels and magnetic resistance assembly 680A along wheel track 685. As illustrated in FIGS. 58 and 60 when a portion of conductive rail 646 is adjusted to occupy a smaller amount of the space between the first set of two magnets 644 and the second set of two magnets 644, a smaller amount of resistance is applied to the movement of lower body user support wheels and magnetic resistance assembly 680A along wheel track 685. As illustrated in FIGS. 59 and 61 when a portion of conductive rail 646 is adjusted to occupy a larger amount of the space between the first set of two magnets 644 and the second set of two magnets 644, a larger amount of resistance is applied to the movement of lower body user support wheels and magnetic resistance assembly 680A along wheel track 685.

As mentioned, reciprocating arcing resistance assembly 640 illustrated in FIG. 56 can be configured with magnetic resistance components or a friction resistance components. The amount of resistance created by the reciprocating arcing magnetic resistance and the reciprocating arcing friction resistance is adjustable. The adjustment components, mounting configuration and function of the components that adjust the level of resistance of the reciprocating arcing magnetic resistance and the reciprocating arcing friction resistance on machines 600 and 700 are identical.

The reciprocating arcing friction resistance assembly as best illustrated in FIGS. 62-65 and 68 is comprised of a grip handle 641, 741 mounted on a first end of adjustment lever 642 and the central portion of adjustment lever 642 pivots on pivot 643 about axle 645. Axle 645 is rigidly connected to the forward and upper portion of movable user support frame 610, 710. The second end of adjustment lever 642 is pivotally connected to the first end of adjustment linkage bar 649 and the second end of adjustment linkage bar 649 is pivotally connected to the first end of first pivot bar 647A. Pivot bar 647A is a rectangular shaped bar located on a forward portion of movable user support frame 610, 710. The second end of pivot bar 647A is pivotally connected to first connection bracket 648A and first connection bracket 648A is rigidly connection to movable user support frame 610, 710. The first end of first pivot bar 647A is also pivotally connected to the first ends of horizontally spaced left and right friction rails 653 and the second end of friction rails 653 are pivotally connected to the first end of second pivot bar 647B and horizontally spaced. Second pivot bar 647B is a rectangular shaped bar identical to first pivot bar 647A and located on a rearward portion of movable user support frame 610, 710. The second end of second pivot bar 647B is pivotally connected to second connection bracket 648B and second connection bracket 648B is rigidly connected to wheels tracks connection bracket 687B. In this configuration, left and right friction rails 653 are pivotally suspended between first pivot bar 647A and second pivot bar 647B to create a four-bar linkage such that the swinging movement of first pivot bar 647A and second pivot bar 647B causes left and right friction rails 646 to move two-dimensionally.

Friction rails 653 are elongated arc shaped rails with the same arc shape as wheel tracks 685. Friction rails 653 can be constructed of various metals with stainless steel being the most common. The profile of friction rails 653 is that of a rectangle modified into a wedge shape wherein one of the shorter tangents is shorter than the other short tangent. Friction rails 653 are horizontally spaced on either side of pivots bars 647A and 647B and pivot bars 647A and 647B are located between wheels tracks 685 such that left friction rail 653 is horizontally spaced from and adjacent to left wheels track 685 and right friction rail 653 is horizontally spaced from and adjacent to right wheels track 685.

FIGS. 62-65 best illustrate lower body user support wheel and friction resistance assembly 680B and how friction rail 653 cooperates with lower body user support wheel and friction resistance assembly 680A. In these views, multiple components are mounted on a housing 681 and in FIGS. 64 and 65 housing 681 is illustrated as outlined and transparent so that the components mounted on housing 681 can be more clearly illustrated and identified. Lower body user support wheel and friction resistance assembly 680B is comprised of an axle 682 connected to an upper portion of a U-shaped housing 681 such that axle 682 intersects a first side wall 681A and a second side wall 681B, proximal to the open end of housing 681. A first end of axle 682 is nearly flush with a first side wall 681A and the second end of axle 682 extends through and away from second side wall 681B. A first diameter wheel 683 is mounted on axle 682 within housing 681 more proximal to second side wall 681B. An interior wall 681D is rigidly connected to the base wall 681C of housing 681 and interior wall 681D is parallel to the first side wall 681A and second side wall 681B. Interior wall 681D is shorter than first side wall 681A and second side wall 681B such that interior wall 681D does not interfere with axle 682. A set of two axles 686 that are parallel to axle 682 intersect the lower portion of second side wall housing 681B and intersect the lower portion of interior wall 681D. A second diameter wheel 684 that is smaller in diameter than wheel 683 is mounted on each axle 686 within housing 681 such that the single wheel 683 and the pair of wheels 684 form a triangular mounting pattern within housing 681. An arc shaped wheel track 685 intersects housing 681 perpendicular to axle 682 and axles 686 and engages the lower central part of wheel 683 and the upper central part of wheels 684 such that wheel track 685 is captured by wheels 683 and 684 wherein lower body user support wheels assembly 680 can roll along wheel track 685.

A first friction pad holder 651 is mounted on the inside surface of the first side wall 681A of housing 681 at a location median to the open and closed ends of housing 681 and a second friction pad holder 651 is mounted in an opposing position on the upper portion of interior wall 681D of housing 681. A first friction pad 652 is mounted on the first friction pad holder 651 and a second friction pad 652 is mounted on the second friction pad holder 651. Friction pads 652 are constructed from flexible but durable material with examples including felt, wool, leather, or similar materials. Friction pads 652 are represented as being rectangular shaped, but various shapes of friction pads 652 could be used to achieve the same or similar function. Friction pads 652 have a wedge-shaped profile such that they are thicker at a first end and thinner at a second end.

First friction pad 652 is mounted on first friction pad holder 651 such that the thicker end of first friction pad 652 is proximal to the open end of housing 681 and the thinner end of first friction pad 652 is proximal to the closed end of housing 681. Second friction pad 652 is mounted on second friction pad holder 651 such that the thicker end of second friction pad 652 is proximal to the open end of housing 681 and the thinner end of second friction pad 652 is proximal to the closed end of housing 681. This mounting configuration of the first friction pad and the second friction pad creates a wedge-shaped space between the first friction pad and the second friction pad with the wedge-shaped space being wider at the end proximal to the closed end of housing 681 and the wedge-shaped space being narrower at the end proximal to the open end of housing 681.

Figure 62:
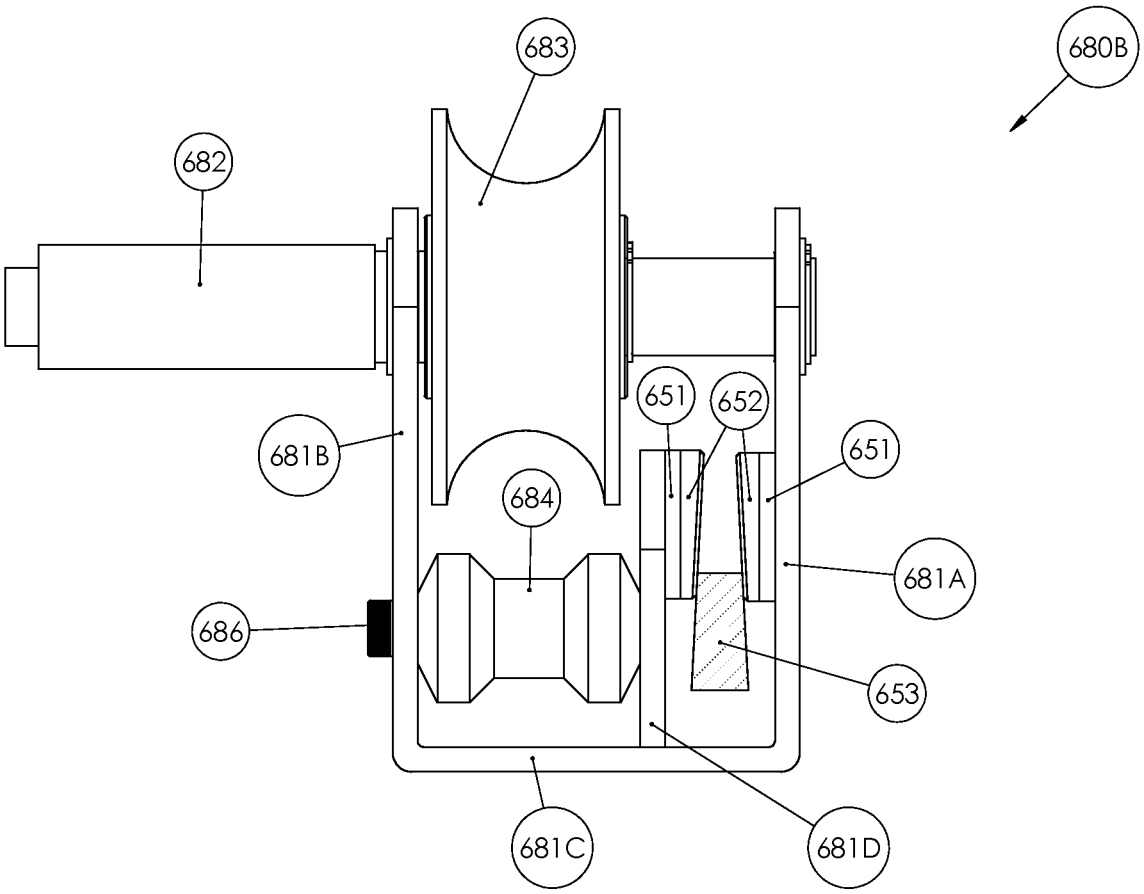
FIG. 62 is an isolated front view of the lower body user support wheels and reciprocating arcing friction resistance assembly of the invention set to a lower resistance setting.
Figure 63:
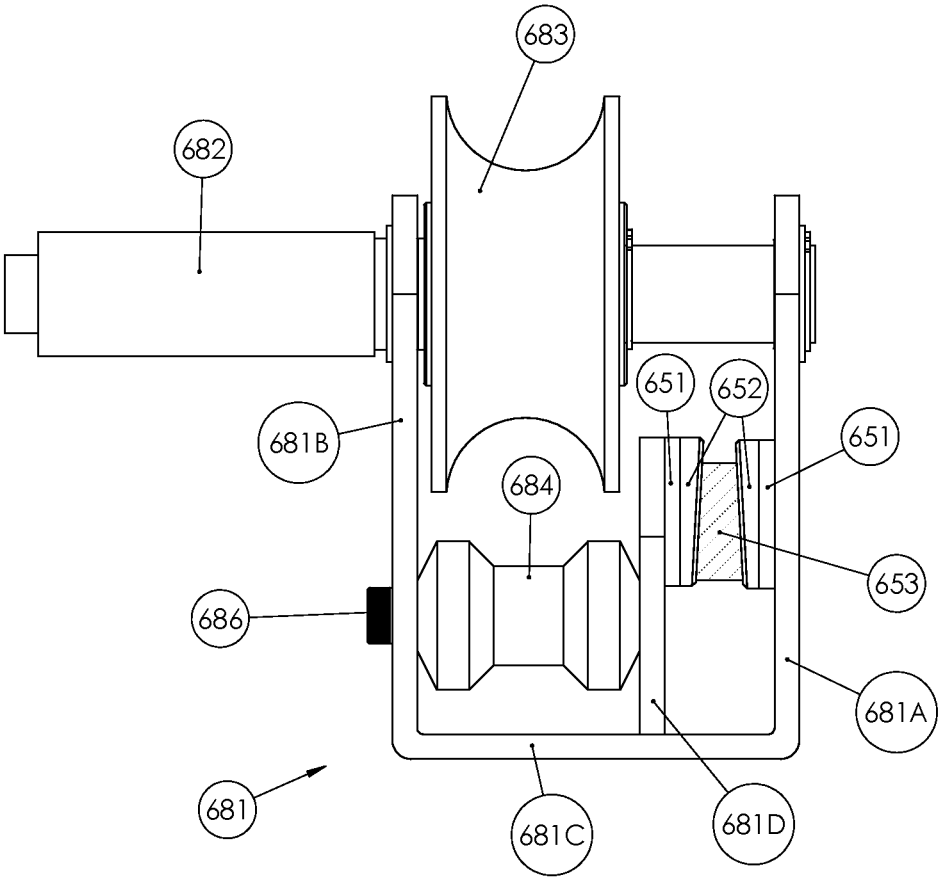
FIG. 63 is an isolated front view of the lower body user support wheels and reciprocating arcing friction resistance assembly of the invention set to a higher resistance setting.
Figure 64:
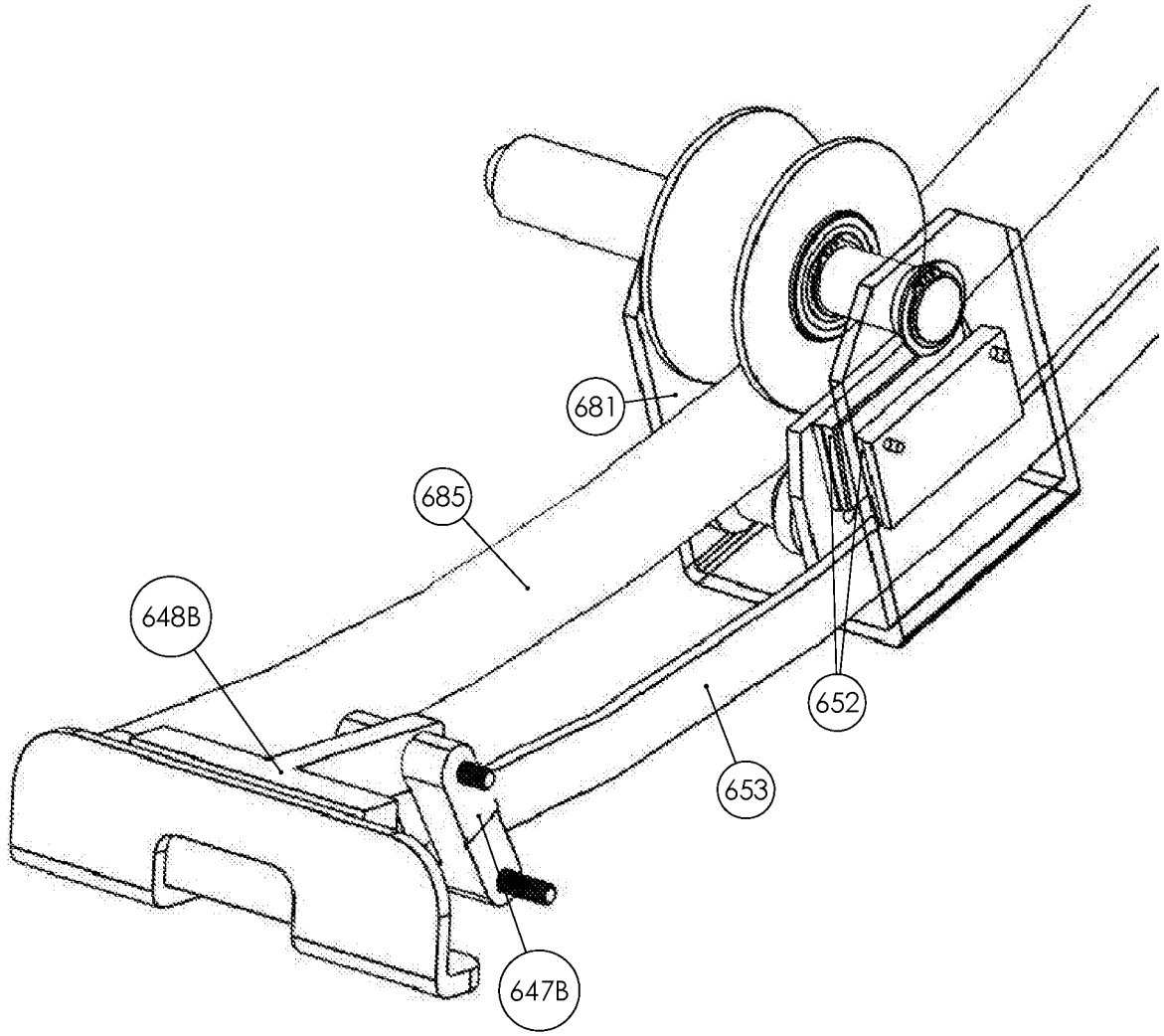
FIG. 64 is an isolated perspective view of the lower body user support wheels and reciprocating arcing friction resistance assembly of the invention set to a lower resistance setting.
Figure 65:
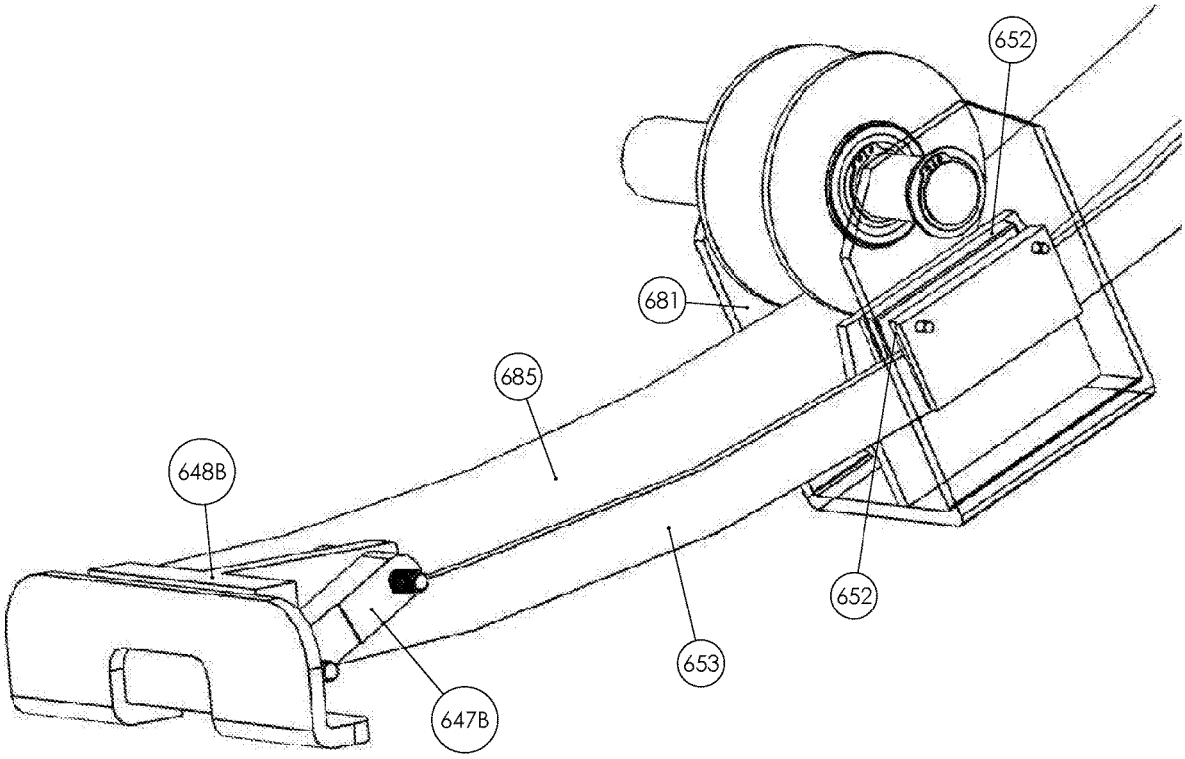
FIG. 65 is an isolated perspective view of the lower body user support wheels and reciprocating arcing friction resistance assembly of the invention set to a higher resistance setting.

An arc shaped friction rail 653 with a wedge-shaped profile intersects housing 681 below and perpendicular to axle 482 and proximal to the center point between interior wall 681D and the first side wall 681A of housing 681. The narrower surface of a portion of friction rail 653 is more proximal to the open end of housing 681 and the wider surface of a portion of friction rail 653 is more proximal to the closed end of housing 681. Friction rail 653 is adjustably suspended at a first end with first pivot bar 647A and at a second end with second pivot bar 647B as previously described herein. A portion of friction rail 653 is adjustably suspended within housing 681 such that a portion of friction rail 653 can be raised and lowered within housing 681 wherein increasable or decreasable portions of friction rail 653 can vertically intersect the space between the first friction pad 652 and the second friction pad 652. When any portion of friction rail 653 occupies any portion of the space between first friction pad 652 and second friction pad 652, it creates an interference fit between friction rail 653 and first and second friction pads 652, wherein a first side surface of friction rail 653 is engaging and compressing a portion of first friction pad 652 and a second side surface of friction rail 653 is engaging and compressing a portion of second friction pad 652. This interference fit creates a friction resistance between friction rail 653 and first and second resistance pads 652 when lower body user support wheels and friction resistance assembly 680B rolls along wheel track 685. As illustrated in FIGS. 62 and 64 when a portion of friction rail 646 is adjusted to occupy a smaller amount of the space between the first friction pad 652 and the second friction pad 652, a smaller amount of resistance is applied to the movement of lower body user support wheels and friction resistance assembly 680B along wheel track 685. As illustrated in FIGS. 63 and 65 when a portion of friction rail 653 is adjusted to occupy a larger amount of the space between the first friction pad 652 and the second friction pad 652, a larger amount of resistance is applied to the movement of lower body user support wheels and friction resistance assembly 680B along wheel track 685.

FIGS. 52, 55, 56, 59, 61, 63, 65, 67, and 68 illustrate machines 600 and machines 700 with a reciprocating arcing resistance assembly 640, 740 wherein, the reciprocating arcing resistance assembly 640, 740 is set to a higher resistance setting. To prevent excessive redundancy, the adjustment operation will be described as a reciprocating arcing magnetic resistance assembly, but it is to be expressly understood that the adjustment operation of the reciprocating arcing friction resistance assembly is identical and comprises like components. To adjust the reciprocating arcing resistance assembly 640, 740 to a lower resistance setting as illustrated in FIGS. 53, 54, 58, 60, 62, and 64, user U would grasp grip handle 641, 741 and urge it from a forward position on movable user support frame 610, 710 towards a rearward position on movable user support frame 610, 710. This causes the first end of adjustment lever 642 to move rearward and cause the central portion of adjustment lever 642 to pivot on pivot 643 about axle 645. This causes the second end of adjustment lever 642 which is below axle 645 to move forward. A first end of linkage bar 649 is pivotally connected to the second end of adjustment lever 642 so that linkage bar 649 moves forward with the second end of adjustment lever 642. The second end of linkage bar 649 is pivotally connected to a four-bar linkage created by first pivot bar 647A, second pivot bar 647B, and left and right conductive resistance rails 646 as previously described herein.

As illustrated in FIGS. 52, 55, 56, 59, 61, 63, 65, 67, and 68 the first ends of first pivot bar 647A and second pivot bar 647B are oriented in a rearward direction on movable user support frame 610, 710 such that conductive resistance rails 646 are suspended in a higher and more rearward position. In this position, conductive rails 646 are more engaged with the resistance components of lower body user support wheels and magnetic resistance assembly 680A as previously described herein. When the second end of linkage bar 649 urges the four-bar linkage created by first pivot bar 647A, second pivot bar 647B, and left and right conductive resistance rails 646 forward, conductive rails 646 move from a higher and rearward position towards a lower and forward position causing conductive rails 646 to be less engaged with the resistance components of lower body user support wheels and magnetic resistance assembly 680A as previously described herein.

To adjust the reciprocating arcing resistance assembly 640, 740 from a lower resistance setting as illustrated in FIGS. 53, 54, 58, 60, 62, and 64, to a higher resistance setting as illustrated in FIGS. 52, 55, 56, 59, 61, 63, 65, 67, and 68, user U would grasp grip handle 641, 741 and urge it from a rearward position on movable user support frame 610, 710 towards a forward position on movable user support frame 610, 710. This causes the first end of adjustment lever 642 to move forward and cause the central portion of adjustment lever 642 to pivot on pivot 643 about axle 645. This causes the second end of adjustment lever 642, which is below axle 645, to move rearward. A first end of linkage bar 649 is pivotally connected to the second end of adjustment lever 642 so that linkage bar 649 moves rearward with the second end of adjustment lever 642. The second end of linkage bar 649 is pivotally connected a four-bar linkage created by first pivot bar 647A, second pivot bar 647B, and left and right conductive resistance rails 646 as previously described herein.

As illustrated in FIGS. 53, 54, 58, 60, 62, and 64 the first ends of first pivot bar 647A and second pivot bar 647B are oriented in a rearward direction on movable user support frame 610, 710 and conductive resistance rails 646 are suspended in a lower and more forward position. In this position, conductive rails 646 are less engaged with the resistance components of lower body user support wheels and magnetic resistance assembly 680A as previously described herein. When the second end of linkage bar 649 urges the four-bar linkage assembly created by first pivot bar 647A, second pivot bar 647B, and left and right conductive resistance rails 646 rearward, conductive rails 646 move from a lower and forward position towards a higher and rearward position causing conductive rails 646 to be more engaged with the resistance components of lower body user support wheels and magnetic resistance assembly 680A as previously described herein.

Figure 66:
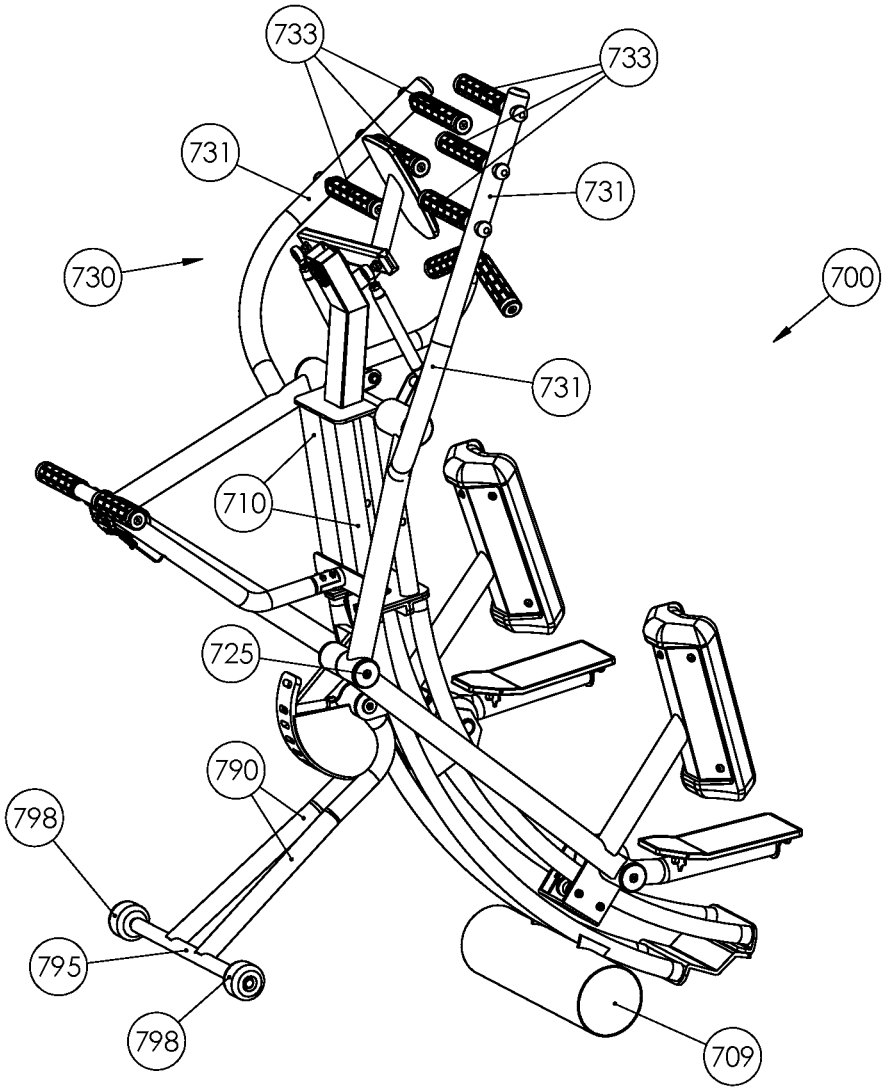
FIG. 66 is a front perspective view of the invention in a higher angle position with a manual angle adjustment assembly, without a stationary base frame, and without a resistance mechanism.
Figure 67:
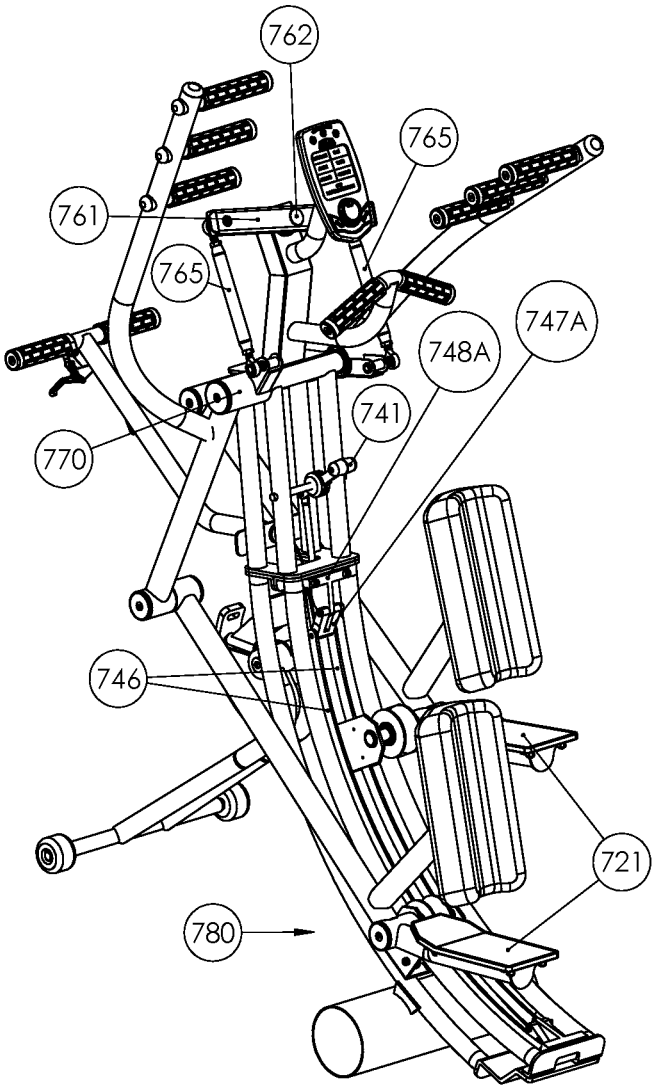
FIG. 67 is a rear perspective view of the invention in a higher angle position with a manual angle adjustment assembly, without a stationary base frame, and with a reciprocating arcing magnetic resistance assembly.

Now referring to FIGS. 66-68, which illustrate a machine 700 comprising a manual angle adjustment mechanism, the stationary base frame 405, 605 has been removed from machine 700 such that the movable user support frame and the angle adjustment mechanism of machine 700 directly engage the floor surface. Also, the upper body user support assembly 430 has been simplified and replaced on machine 700 with a set of left and right upper body user support levers 731 and a plurality of grip handles 733 as will be described in detail herein. The exercise function of machine 700 is the same or nearly identical to all other embodiments of the invention. However, some of the features of previously machines 400 and 600 of the invention have been removed to create a lower cost version of the machine.

The stationary base frame 405 of previously described embodiments has been removed from machine 700 such that a floor pivot foot 709 is rigidly connected to a rearward portion of movable user support frame 710 and floor pivot foot 709 movably engages the floor surface.

The angle adjustment assembly of machine 700 has been simplified so as to comprise fewer components than the embodiments of machines 400 and 600 such that wheels housings 497 have been removed and replaced with a left wheel 798 and a right wheel 798 that each directly engaged the floor surface. A wheel 798 is mounted on opposing ends of axle 795 and a central portion of axle 795 is rigidly connected to left and right lifting bars 790. Lifting assist springs 413 have also been removed. All other features and components of the angle adjustment assembly of machine 700 are identical and function identically to the angle adjustment assembly features and components of machines 400 and 600 as previously described herein such that the angle adjustment assembly of machine 700 lifts and lowers movable user support frame 710 as it pivots about floor pivot foot 709. The angle adjustment assembly of machine 700 also secures movable user support frame 710 at the selected angle position. The angle adjustment assembly of machine 700 is capable of adjusting movable user support frame 710 to any angle on one side of a vertical line between said vertical line and horizontal Prior to operating machine 700, user U would first select and set the angle of movable user support frame 710. This operation of selecting and setting the angle of movable user support frame 710 is identical to that of selecting and setting the angle of movable user support frame 410 on machine 400 and movable user support frame 610 on machine 600 as previously described herein.

The upper body user support of machine 700 is simplified and comprises fewer components than the upper body user support assembly 430 of embodiments of machine 400 and machine 600. The upper body user support of machine 700 comprises the following components. A plurality of grip handles 733 are rigidly connected to a first end of left side lever arm 731 and a second end of left side lever arm 731 is rigidly connected to an upper portion of the left side second linkage 726. A plurality of grip handles 733 are rigidly connected to a first end of right side lever arm 731 and a second end of right side lever arm 731 is rigidly connected to an upper portion of the right side second linkage 726. In this configuration, the left side lever arm 731 and the left side second linkage 726 move as one and the right side lever arm 731 and the right side second linkage 726 move as one. The upper end of left side second linkages 726 pivots about left side linkages connection hub pivot 770 and the upper end of right side second linkage 726 pivots about right side linkages connection hub pivot 770. The first end of left side lever arms 731 extends above left side linkages connection hub pivot 770 in a path that is mostly parallel to left side second linkage 726 such that when left side second linkage 726 pivots about left side linkages connection hub 700, left side grip handles 733 and left side second linkage 726 move in opposite directions. The first end of right side lever arms 731 extends above right side linkages connection hub pivot 770 in a path that is mostly parallel to right side second linkage 726 such that when right side second linkage 726 pivots about right side linkages connection hub 700, right side grip handles 733 and right side second linkage 726 move in opposite directions. The plurality of grip handles 733 mounted on the first ends of left and right side lever arms 731 allow a user U to select a grip position that is the most comfortable for the exercise angle at which they are operating machine 700.

The simplified configuration of the upper body user supports of machine 700 as previously described allows machine 700 to utilize a linkage assembly that is simplified to comprise fewer parts than the left side and right side linkage assemblies 460 of the embodiments of machine 400 and machine 600. The linkage assembly of machine 700 comprises a rocker arm 761 that is pivotally mounted on the upper and forward end of movable user support frame 710 wherein rocker arm 761 pivots about pivot 762. The first end of a left side linkage bar 765 is pivotally connected to the left side end of rocker arm 761 and the second end of left side linkage bar 765 is pivotally connected to a left side flange that is rigidly connected the left side linkages connection hub pivot 770. The first end of a right side linkage bar 765 is pivotally connected to the right side end of rocker arm 761 and the second end of right side linkage bar 765 is pivotally connected to a right side flange that is rigidly connected to right side linkages connection hub pivot 770. This linkage assembly configuration allows rocker arm 761 to synchronize and control the motion of the left side lower body user support, the left side upper body user support, the right side lower body user support, and the right side upper body user support. In this configuration, the movement of any user support concurrently causes movement of all of the user supports.

To operate the exercise function of machine 700, user U would enter the machine by placing user U's feet on foot platforms 721 and place user U's shins against shin support pads 723. User U would then select and grasp a left side grip handle 733 and a right side grip handle 733. User U would then concurrently urge the left side lower body user support assembly 720 and left side upper body user support assembly 730 in a pushing or pulling direction while concurrently urging right side lower body user support assembly 720 and right side upper body user support assembly 730 in the opposite direction. This motion would cause the first end of left side linkage bar 724 to move in a first direction as left side lower body user support wheels assembly 780 rolls along left side wheel track 785 in a first direction as the second end of left side linkage bar 724 and the first end of left side linkage bar 726 pivot about pivot 725 as left side linkage bar 726 swings in a first direction and the second end of left side linkage bar 726 pivots about left side linkages connection hub pivot 770. This causes left side flange 771 to rotate in a first direction on left side linkages connection hub pivot 770 and urge left side linkage bar 765 in first direction wherein the first end of left side linkage bar 765 pivots on left side flange 771 and the second end of left side linkage bar 765 pivots on the left end of rocker arm 761 causing rocker arm 761 to pivot about pivot 762 in a first direction. As user U urges a left side grip handle 733 in a first direction this causes left side lever arm 731, which is rigidly connected to an upper portion of the second end of left side linkage bar 726, to move in a first direction. This first directional urging of left side lower body user support assembly 720 and left side upper body user support assembly 730 by user U increases the distance between left side foot platform 721 and left side grip handles 733.

Rocker arm 761 connects and synchronizes the motion of the left side lower and upper body user supports with motion of the right side lower and upper body user supports such that the motion of the left side lower and upper body user supports in a first direction as previously described would cause the first end of right side linkage bar 724 to move in a second direction as right side lower body user support wheels assembly 780 rolls along right side wheel track 485 in a second direction as the second end of right side linkage bar 724 and the first end of right side linkage bar 726 pivot about pivot 725 as right side linkage bar 726 swings in a second direction and the second end of right side linkage bar 726 pivots about right side linkages connection hub pivot 770. This causes right side flange 771 to rotate in a second direction on right side linkages connection hub pivot 770 and urge right side linkage bar 765 in second direction wherein the first end of right side linkage bar 765 pivots on right side flange 471 and the second end of right side linkage bar 765 pivots on the right end of rocker arm 761 causing rocker arm 761 to pivot about pivot 762 in a second direction. As user U urges a right side grip handle 733 in a second direction this causes right side lever arm 731 which is rigidly connected to an upper portion of the second end of right side linkage bar 726 to move in a second direction. This second directional urging of right side lower body user support assembly 720 and left side upper body user support assembly 730 by user U decreases the distance between left side foot platform 721 and a left side grip handles 733. Anytime while operating machine 700, user U can disengage from hand grips 733 and grasp stationary grip handles 739 to operate the lower body user support assemblies 420 only.

When user U switches the direction of urging the left side lower body user support assembly 720 and the left side upper body user support assembly 730 from a first direction to a second direction, this causes the direction of the right side lower body user support assembly 720 and the right side upper body user support assembly 730 to switch from a second direction to a first direction and vice versa as previously described herein.

At any time while operating machine 700, user U can disengage from hand grips 733 and grasp stationary grip handles 739 to operate the lower body user support assemblies 720 only for a lower body only exercise motion.

While machine 700 is being operated, the reciprocating arcing pattern of exercise motion is defined by the configuration of the left side and right side movable upper body user support assemblies 730, the left side and right side movable lower body user support assemblies 720, the left side and right side linkage bars 765 and the rocker arm 761. However, while machine 700 is being operated, the range of movement of the reciprocating arcing pattern of exercise motion is controlled by the range of movement of the exercise motion of the user U. This allows users U of all sizes and physical flexibility to exercise comfortably within their own unique capabilities.

Machine 700 can be operated with or without a resistance feature. In FIG. 66, machine 700 is illustrated with no resistance. In FIGS. 67 and 68 machine 700 is illustrated with a reciprocating arcing resistance assembly 740. FIG. 67 illustrates an embodiment of machine 700 with a reciprocating arcing magnetic resistance assembly comprising a grip handle 741, a first connection bracket 785A, a first pivot bar 747A, and left and right conductive rails 746. FIG. 68 illustrates an embodiment of machine 700 with a reciprocating arcing friction resistance assembly comprising a linkage bar 749 and left and right friction rails 753. The reciprocating arcing resistance assemblies 740 function identically to and comprise the identical components of the reciprocating arcing resistance assemblies 640 of the machine 600 embodiments as previously described herein. The operation of adjusting the reciprocating arcing resistance assemblies 740 is also identical to that of adjusting the reciprocating arcing resistance assemblies 640 as previously described herein.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

REFERENCE NUMERALS

U User
1 Machine
5 Stationary base frame
6 Angle adjusting device lower pivot
7 Angle adjusting device
8 Angle adjusting shaft
9 Movable frame foot
10 Movable frame
11 Lower body support rail
12 Movable frame base pivot
13 Angle adjusting device upper pivot
15 Angle adjusting support arm assembly
16 Angle adjusting support arm
17 Angle adjusting support arm cross brace
18 Angle adjusting support arm wheels
19 Angle adjusting support arm pivot
20 Lower body user support assembly
21 Foot platform
22 Lower body user support frame
23 Shin pad
24 First Lower body user support linkage bar
25 Lower body user support linkage pivot
26 Second lower body user support linkage bar
29 Lower body user support frame pivot
30 Upper body user support assembly
31 Upper body user support lever arm
32 Upper body user support adjusting shaft
33 Upper body user support grip handle
34 Upper body user support pivot
35 Upper body user support linkage connection flange
36 Upper body user support linkage bar lower pivot
37 Upper body user support linkage bar
38 Upper body user support linkage bar upper pivot
40 Rotational resistance mechanism
41 Rotational resistance axle

42 Rotational resistance axle connection flange
50 Resistance drive assembly
51 Upper resistance drive sprocket
52 Lower resistance drive sprocket
53 One-way clutch
54 Flexible drive member
60 Rocker arm linkage assembly
61 Rocker arm
62 Rocker arm pivot
63 Rocker arm linkage lower pivot
64 Rocker arm linkage upper pivot
65 Rocker arm linkage bar
70L Left linkages connection hub
70R Right linkages connection hub
71L Left linkages connection hub flange
71R Right linkages connection hub flange
72 Linkages connection hub axle
80 Traveling member assembly
81 Traveling member inner frame plate
82 Traveling member outer frame plate
83 Traveling member wheels
84 Traveling member axle
100 Machine
105 Stationary base frame
107 Angle adjusting actuator
110 Movable user support frame
112 Movable user support frame base pivot
113 Angle adjusting actuator upper pivot
114 Angle adjusting actuator lower pivot
121 Foot platform
123 Shin pad
124 First lower body user support linkage bar
125 Lower body user support linkage pivot
126 Second lower body user support linkage bar
131 Upper body user support lever arm
133 Upper body user support grip handle
134 Upper body user support pivot
137 Upper body user support linkage bar
139 Stationary grip handle
140 Resistance assembly
141 Resistance drive axle
143 Resistance flywheel drive belt
144 Resistance flywheel resistance magnet
145 Resistance flywheel
146 Resistance drive axle coupling
147 Resistance flywheel drive pulley
148 Resistance drive axle bearing
150 Resistance drive assembly
151 Resistance drive cable guide pulley
153 One-way clutch resistance drive cable spool
154 Resistance drive cable
155 Resistance drive cable tensioner pulley
156 Resistance drive cable tensioner pulley springs
157 Resistance drive cable connector
158 Resistance drive cable tensioner pulley housing
160 Rocker arm linkage assembly
161 Rocker arm
162 Rocker arm pivot
163 Rocker arm linkage bar lower pivot
164 Rocker arm linkage bar upper pivot
165 Rocker arm linkage bar
170 Linkages connection hub
171 Linkages connection hub flange
175 Upper body user support height adjustment lever
176 Upper body user support height adjustment lever pivot
177 Upper body user support height adjustment lever push rod
178 Upper body user support height adjustment lever push rod upper pivot
179 Upper body user support height adjustment lever push rod lower pivot
183 Lower body user support wheel
185 Lower body user support wheel track
190 Angle adjustment assembly
191 Angle adjustment actuator
192 Angle adjustment actuator outer tube
193 Angle adjustment actuator inner shaft
194 First angle adjustment linkage bar
195 Second angle adjustment linkage bar
196 Angle adjustment linkage lower pivot
197 Angle adjustment linkage mid pivot
198 Angle adjustment linkage upper pivot
200 Machine
201 Angle adjusting drive assembly
202 Angle adjusting drive axle
203 First angle adjusting drive linkage bar
204 Second angle adjusting drive linkage bar
205 Stationary base frame
206 Second angle adjust drive link bar connection flange
207 Angle adjusting drive first pivot
208 Angle adjusting drive second pivot
209 Angle adjusting drive third pivot
210 Movable user support frame
211 Angle adjusting drive guide axle
212 Movable user support frame base pivot
213 First gear drive pulley
214 First gear drive axle
215 Manual gear drive angle adjusting assembly
216 Gear drive pulley belt
217 Second gear drive pulley
218 Second gear drive axle
219 First drive gears
220 Second drive gears
221 Foot platform
223 Shin pad
224 First lower body user support linkage bar
225 Lower body user support linkage pivot
226 Second lower body user support linkage bar
231 Upper body user support lever arm
233 Upper body user support grip handle
234 Upper body user support pivot
237 Upper body user support linkage bar
238 Upper body user support linkage bar pivot
239 Stationary grip handle
240 Resistance assembly
241 Resistance drive axle
243 Resistance flywheel drive belt
244 Resistance flywheel resistance magnet
245 Resistance flywheel
246 Resistance drive axle coupling
247 Resistance flywheel drive pulley
248 Resistance drive axle bearing
250 Resistance drive assembly
251 Resistance drive cable guide pulley
253 One-way clutch resistance drive cable spool
254 Resistance drive cable
255 Resistance drive cable tensioner pulley
256 Resistance drive cable tensioner pulley springs
257 Resistance drive cable connector
258 Resistance drive cable tensioner pulley housing
260 Rocker arm linkage assembly
261 Rocker arm
262 Rocker arm pivot
263 Rocker arm linkage bar lower pivot

264 Rocker arm linkage bar upper pivot
265 Rocker arm linkage bar
270 Linkages connection hub
271 Linkages connection hub flange
275 Upper body user support height adjustment lever
276 Upper body user support height adjustment lever pivot
277 Upper body user support height adjustment lever push rod
278 Upper body user support height adjustment lever push rod upper pivot
279 Upper body user support height adjustment lever push rod lower pivot
280 Clutch assembly
283 Lower body user support wheel
285 Lower body user support wheel track
286 Clutch drive axle
287 Clutch engagement fork
288 Clutch engagement linkage assembly
289 Clutch
290 Angle adjustment assembly
291 Clutch engagement switch
294 First angle adjustment linkage bar
295 Second angle adjustment linkage bar
296 Angle adjustment linkage lower pivot
297 Angle adjustment linkage mid pivot
298 Angle adjustment linkage upper pivot
300 Machine
305 Stationary base frame
310 Movable user support frame
389 Angle adjustment lever arm locking pin
390 Manual lever arm angle adjustment assembly
391 Angle adjustment lever arm
392 Angle adjustment lever arm hand grip
393 Angle adjustment lever arm lock release switch
394 First angle adjustment linkage bar
395 Second angle adjustment linkage bars
396 Angle adjustment linkage lower pivot
397 Angle adjustment linkage mid pivot
398 Angle adjustment linkage upper pivot
399 Angle adjustment lever arm locking plate
400 Machine
404 Cross bar
405 Stationary base frame
406 Cross bar
408 Bearing
409 Flange
410 Movable user support frame
411 Plate
412 Axle
413 Lifting assist spring
414 Mounting bracket
415 Locking plate
416 Locking pin
417 Connection bar
418 Locking pin cable
419 Receiver holes
420 Lower body user support assembly
421 Foot platform
422 Connection plate
423 Shin support pad
424 Linkage bar
425 Pivot
426 Linkage bar
427 Mounting tube
428 Step
430 Upper body user support assembly
431 Lever arm
433 Grip handle
434 Pivot
435 Axle
437 Linkage bar
438 Pivot
439 Stationary grip handle
460 Linkage assembly
461 Rocker arm
462 Pivot
463 Pivot
464 Pivot
465 Linkage bar
466 Support tube
467 Support tube
468 Support tube
470 Linkages connection hub pivot
471 Flange
475 Height adjustment lever
476 Pivot axle
477 Push rod
478 Pivot
479 Pivot
480 Lower body user support wheels assembly
481 Housing
481A First side wall
481B Second side wall
481C Base wall
481D Interior wall
482 Upper wheel axle
483 Upper wheel
484 Lower wheel
485 Wheel track
486 Lower wheel axle
487A Lower connection bracket
487B Lower connection bracket
488 Upper connection bracket
489 Angle adjustment assembly
490 Lifting bar
491 Adjustment lever
492 Grip handle
493 Activation lever
494 Pivot
495 Axle
496 Pivot
497 Wheels housing
498A Upper wheel
498B Lower wheel
499 Wheel track
500 Exercise information console
600 Machine
610 Movable user support frame
612 Pivot
640 Reciprocating arcing resistance assembly
641 Grip handle
642 Adjustment lever
643 Pivot
644 Magnet
645 Axle
646 Conductive rail
647A First pivot bar
647B Second pivot bar
648A First connection bracket
648B Second connection bracket
649 Linkage bar
650 Magnet holder
651 Friction pad holder
652 Friction pad

653 Friction rail
680A Lower body user support wheels and magnetic resistance assembly
680B Lower body user support wheels and friction resistance assembly
681 Housing
681A First side wall
681B Second side wall
681C Base wall
681D Interior wall
682 Upper wheel axle
683 Upper wheel
684 Lower wheel
685 Wheel track
686 Lower wheel axle
687B Lower connection bracket
692 Grip handle
700 Machine
709 Floor pivot foot
710 Movable user support frame
720 Lower body user support assembly
721 Foot platform
723 Shin support pad
724 Linkage bar
726 Linkage bar
730 Upper body user support assembly
731 Lever arm
733 Grip handle
740 Reciprocating arcing resistance assembly
741 Grip handle
746 Conductive rail
747A First pivot bar
748A First connection bracket
749 Linkage bar
753 Friction rail
761 Rocker arm
762 Pivot
765 Linkage bar
770 Linkages connection hub pivot
771 Flange
790 Lifting bar
795 Axle
797 Wheels housing
798 Wheel

What is claimed is:

1. An upper and lower body reciprocating arcing motion exercise machine with an adjustable angle user support frame, the exercise machine comprising:

a) a stationary base frame having a forward end and a rearward end;

b) a movable user support frame having a forward end and a rearward end, with a rearward portion of the movable user support frame at or proximal to the rearward end of the movable user support frame being pivotally connected at or proximal to the rearward end of the stationary base frame;

c) an angle adjustment assembly operatively connected to the movable user support frame for adjusting the angle of the movable user support frame relative to the stationary base frame and/or to a surface on which the exercise machine rests;

d) a left side movable lower body user support assembly comprising a foot support platform and a shin support pad, the left side movable lower body user support assembly being operatively connected to the movable user support frame for movement in a reciprocating arcing motion between the rearward portion of the movable user support frame and a central portion of the movable user support frame, and a right side movable lower body user support assembly comprising a foot support platform and a shin support pad, the right side movable lower body user support assembly being operatively connected to the movable user support frame for movement in a reciprocating arcing motion between the rearward portion of the movable user support frame and the central portion of the movable user support frame;

e) a left side movable upper body user support assembly comprising a gripping handle, the left side movable upper body user support assembly being operatively connected to the movable user support frame for movement in a reciprocating arcing motion between a forward portion of the movable user support frame and the central portion of the movable user support frame, and a right side movable upper body user support assembly comprising a gripping handle, the right side movable upper body user support assembly being operatively connected to the movable user support frame for movement in a reciprocating arcing motion between the forward portion of the movable user support frame and the central portion of the movable user support frame; and f) a left side linkage assembly operatively connecting the left side movable upper body user support assembly to the left side movable lower body user support assembly at a left side linkages connection hub pivot, and a right side linkage assembly operatively connecting the right side movable upper body user support assembly to the right side movable lower body user support assembly at a right side linkages connection hub pivot.

2. The exercise machine of claim 1, further comprising an arc shaped left side movable lower body user support assembly track and an arc shaped right side movable lower body user support assembly track, wherein the left side movable lower body user support assembly rolls or slides on the arc shaped left side movable lower body user support assembly track and the right side movable lower body user support assembly rolls or slides on the arc shaped right side movable lower body user support assembly track.

3. The exercise machine of claim 2, further comprising left and right pivoting levers and a common single height adjustment lever, wherein the left side and right side movable upper body user support assemblies gripping handles are respectively mounted on the left and right pivoting levers, which are independently pivotably mounted on a first end or a central portion of the common single height adjustment lever, and a second end of the common single height adjustment lever is pivotally mounted on the movable user support frame.

4. The exercise machine of claim 3, wherein the common single height adjustment lever is operatively connected to the angle adjustment assembly such that any time the angle adjusting assembly adjusts the angle of the movable user support frame, the angle adjusting assembly concurrently adjusts the angle of the common single height adjustment lever relative to the movable user support frame.

5. The exercise machine of claim 1, further comprising a rocker arm pivotably mounted on the movable user support frame, wherein the left side linkages connection hub pivot and the right side linkages connection hub pivot are operatively connected to opposing ends of the rocker arm such that the motion of the movable upper body user support assemblies and the movable lower body user support assemblies are synchronized and controlled by the motion of the rocker arm.

6. The exercise machine of claim 5, wherein the reciprocating arcing pattern of exercise motion is defined by the configuration of the left side and right side movable upper body user support assemblies, the left side and right side movable lower body user support assemblies, the left side and right side linkage assemblies, and the rocker arm, and wherein the range of movement of the reciprocating arcing pattern of exercise motion is controlled by the range of movement of the exercise motion of the user.

7. An upper and lower body reciprocating arcing motion exercise machine with an adjustable angle user support, the exercise machine comprising:

a) a stationary base frame having a forward end and a rearward end;

b) a movable user support frame having a forward end and a rearward end, with a rearward portion of the movable user support frame at or proximal to the rearward end of the movable user support frame being pivotally connected at or proximal to the rearward end of the stationary base frame;

c) an angle adjusting assembly operatively connected to the movable user support frame for adjusting the angle of the movable user support frame relative to the stationary base frame and/or to a surface on which the exercise machine rests;

d) a left side movable lower body user support assembly comprising a foot support platform and a shin support pad, the left side movable lower body user support assembly being operatively connected to the movable user support frame for movement in a reciprocating arcing motion between the rearward portion of the movable user support frame and a central portion of the movable user support frame, and a right side movable lower body user support assembly comprising a foot support platform and a shin support pad, the right side movable lower body user support assembly being operatively connected to the movable user support frame for movement in a reciprocating arcing motion between the rearward portion of the movable user support frame and the central portion of the movable user support frame;

e) a left side movable upper body user support assembly comprising a gripping handle, the left side movable upper body user support assembly being operatively connected to the movable user support frame for movement in a reciprocating arcing motion between a forward portion of the movable user support frame and the central portion of the movable user support frame, and a right side movable upper body user support assembly comprising a gripping handle, the right side movable upper body user support assembly being operatively connected to the movable user support frame for movement in a reciprocating arcing motion between the forward portion of the movable user support frame and the central portion of the movable user support frame;

f) a left side linkage assembly operatively connecting the left side movable upper body user support assembly to the left side movable lower body user support assembly at a left side linkages connection hub pivot, and a right side linkage assembly operatively connecting the right side movable upper body user support assembly to the right side movable lower body user support assembly at a right side linkages connection hub pivot; and g) an adjustable reciprocating arcing motion resistance assembly operatively mounted on the movable user support frame and operatively engaged with at least one of the movable upper body user support assemblies and/or at least one of the movable lower body user support assemblies for providing adjustable reciprocating resistance to the exercise motion of the movable upper body user support assemblies and/or the movable lower body user support assemblies.

8. The exercise machine of claim 7, further comprising an arc shaped left side movable lower body user support assembly track and an arc shaped right side movable lower body user support assembly track, wherein the left side lower body user support assembly rolls or slides on the arc shaped left side lower body user support assembly track and the right side lower body user support rolls or slides on the arc shaped right side lower body user support assembly track.

9. The exercise machine of claim 8, further comprising left and right pivoting levers and a common single height adjustment lever, wherein the left side and right side movable upper body user support assemblies gripping handles are respectively mounted on the left and right pivoting levers, which are independently pivotably mounted on a first end or a central portion of the common height adjustment lever, and a second end of the common single height adjustment lever is pivotally mounted on the movable user support frame.

10. The exercise machine of claim 9, wherein the common single height adjustment lever is operatively connected to the angle adjustment assembly such that anytime the angle adjustment assembly adjusts the angle of the movable user support frame, the angle adjustment assembly concurrently adjusts the angle of the common single height adjustment lever relative to the movable user support frame.

11. The exercise machine of claim 7, further comprising a rocker arm pivotably mounted on the movable user support frame, wherein the left side linkages connection hub pivot and the right side linkages connection hub pivot are operatively connected to opposing ends of the rocker arm such that the motion of the movable upper body user support assemblies and the movable lower body user support assemblies are synchronized and controlled by the motion of the rocker arm.

12. The exercise machine of claim 11, wherein the reciprocating arcing pattern of exercise motion is defined by the configuration of the left side and right side movable upper body user support assemblies, the left side and right side movable lower body user support assemblies, the left side and right side linkage assemblies, and the rocker arm, and wherein the range of movement of the reciprocating arcing pattern of exercise motion is controlled by the range of movement of the exercise motion of the user.

13. The exercise machine of claim 7, further comprising a reciprocating arcing motion resistance assembly for providing an adjustable magnetic resistance to the exercise motion of the movable upper body user support assemblies and the movable lower body user support assemblies, wherein the reciprocating arcing motion resistance assembly comprises conductive rails and magnets.

14. The exercise machine of claim 13, wherein at least one of the conductive rails is a left side conductive rail adjustably mounted on the movable user support frame and the left side conductive rail cooperates with at least one of the magnets that is mounted on the movable left side lower body user support assembly such that the distance of the left side conductive rail relative to the at least one magnet mounted on the movable left side lower body user support assembly is adjustable to create an adjustable magnetic resistance to the movement of the movable left side lower body user support assembly, and at least another of the conductive rails is a right side conductive rail adjustably mounted on the movable user support frame and the right side conductive rail cooperates with at least one of the magnets that is mounted on the right side movable lower body user support assembly such that the distance of the right side conductive rail relative to the at least one magnet mounted on the right side movable lower body user support assembly is adjustable to create an adjustable magnetic resistance to the movement of the movable right side lower body user support assembly.

15. The exercise machine of claim 7, further comprising a reciprocating arcing motion resistance assembly for providing an adjustable friction resistance to the exercise motion of the movable upper body user support assemblies and the movable lower body user support assemblies, wherein the reciprocating arcing motion resistance assembly comprises friction rails and friction pads.

16. The exercise machine of claim 15, wherein at least one of the friction rails is a left side friction rail adjustably mounted on the movable user support frame and the left side friction rail cooperates with at least one of the friction pads that is mounted on the movable left side lower body user support assembly such that the amount of surface contact and or the pressure of the surface contact between the left side friction rail and the at least one friction pad mounted on the movable left side lower body user support assembly is adjustable to create an adjustable friction resistance to the movement of the movable left side lower body user support assembly, and at least another of the friction rails is a right side friction rail adjustably mounted on the movable user support frame and the right side friction rail cooperates with at least one of the friction pads that is mounted on the movable right side lower body user support assembly such that the amount of surface contact and or the pressure of the surface contact between the right side friction rail and the at least one friction pad mounted on the movable right side lower body user support assembly is adjustable to create an adjustable friction resistance to the movement of the movable right side lower body user support assembly.

* * * * *